US008393341B2

(12) United States Patent
Li

(10) Patent No.: US 8,393,341 B2
(45) Date of Patent: Mar. 12, 2013

(54) AUDIO SYSTEM FOR OUTDOOR UMBRELLA

(75) Inventor: Wanda Ying Li, Santa Ana, CA (US)

(73) Assignee: Joen-An Oliver Ma, Arcadia, CA (US)

( * ) Notice: Subject to any disclaimer, the term of this patent is extended or adjusted under 35 U.S.C. 154(b) by 0 days.

(21) Appl. No.: 12/313,817

(22) Filed: Nov. 24, 2008

(65) Prior Publication Data

US 2009/0071516 A1 Mar. 19, 2009

Related U.S. Application Data

(63) Continuation-in-part of application No. 10/844,601, filed on May 11, 2004, which is a continuation-in-part of application No. 10/436,192, filed on May 12, 2003, now Pat. No. 6,830,058, and a continuation-in-part of application No. 11/796,264, filed on Apr. 27, 2007, and a continuation-in-part of application No. 11/147,781, filed on Jun. 7, 2005.

(51) Int. Cl.
*A45B 3/00* (2006.01)

(52) U.S. Cl. ..... 135/16

(58) Field of Classification Search ..... 135/16
See application file for complete search history.

(56) References Cited

U.S. PATENT DOCUMENTS

| | | | | |
|---|---|---|---|---|
| 4,787,019 | A * | 11/1988 | van den Broeke | 362/249.07 |
| 4,915,670 | A * | 4/1990 | Nesbit | 455/344 |
| 5,007,811 | A * | 4/1991 | Hopkins | 135/16 |
| 5,029,239 | A * | 7/1991 | Nesbit | 455/344 |
| 5,273,062 | A * | 12/1993 | Mozdzanowski | 135/16 |
| 5,349,975 | A * | 9/1994 | Valdner | 135/16 |
| 5,996,511 | A * | 12/1999 | Swoger | 108/157.13 |
| 6,027,309 | A * | 2/2000 | Rawls et al. | 416/5 |
| 6,298,866 | B1 * | 10/2001 | Molnar, IV | 135/16 |
| 6,347,776 | B1 * | 2/2002 | Chuang | 248/288.51 |
| 2006/0196532 | A1 * | 9/2006 | Tung | 135/16 |
| 2007/0242450 | A1 * | 10/2007 | Blatecky | 362/102 |
| 2009/0056775 | A1 * | 3/2009 | Kuelbs | 135/16 |

* cited by examiner

*Primary Examiner* — Noah Chandler Hawk
(74) *Attorney, Agent, or Firm* — Raymond Y. Chan; David and Raymond Patent Firm

(57) ABSTRACT

An outdoor umbrella includes an umbrella frame and an audio system. The umbrella includes a supporting frame and an awning frame supported by the supporting frame to define a shadowing area under the awning frame. The audio system includes at least a speaker unit supported by the umbrella frame and an audio input operatively linked to the speaker unit such that when the audio input sends an audio signal to the speaker unit, the speaker unit is adapted for producing audio effect within the shadowing area as an additional function for the outdoor umbrella.

7 Claims, 49 Drawing Sheets

100B

100B

AUDIO SYSTEM FOR OUTDOOR UMBRELLA

CROSS REFERENCE OF RELATED APPLICATION

This is a Continuation-In-Part application of three non-provisional applications. The first non-provisional application has an application Ser. No. 10/844,601 and a filing date of May 11, 2004, which is a Continuation-In-Part application of a non-provisional application having an application Ser. No. 10/436,192 and a filing date of May 12, 2003 now U.S. Pat. No. 6,830,058. The second non-provisional application has an application Ser. No. 11/796,264 and a filing date of Apr. 27, 2007. The third non-provisional application has an application Ser. No. 11/147,781 and a filing date of Jun. 7, 2005.

BACKGROUND OF THE PRESENT INVENTION

1. Field of Invention

The present invention relates to an outdoors umbrella, and more particularly to an outdoors umbrella incorporated with an audio system for providing an add-on function of the outdoors umbrella.

2. Description of Related Arts

Outdoors umbrellas are set up in many places such as in beach areas, in patio areas, in campsites or in domestic gardens etc. They are usually used for shading sunlight in the daytime. A conventional outdoors umbrella usually comprises an umbrella base, a supporting stem upwardly extended therefrom, a foldable awning frame which comprises a plurality of awning supporting arms radically and outwardly extended from an upper end portion of the supporting stem, and n fabric-made awning securely and foldably mounted on the awning supporting arms.

Users would always like to listen to the music at their leisure such that the users usually carry a portable music player. However, such portable music player cannot be mounted to the outdoor umbrella. In other words, most of the users prefer the outdoor umbrella with built-in audio system. Actually, mounting an audio system on the outdoors umbrella is a challenging task. Not to mention the problems arise when one tries to design the mechanical connection between the audio system and the outdoors umbrella without interfering its smooth folding action, it is the problem as how to provide the audio system with enough and convenient power source which simply possesses the main difficulty in designing a practical audio system.

Since the outdoors umbrellas, as the name implies, are designed for use in outdoors, existence of an electrical power source cannot be guaranteed. Even through there are electrical sources exist, a tedious connection between the audio system and the electrical source is unavoidable in that long wires have to be used. For some cases, the audio systems may be compatible with portable dynamos, however, bring a bulky dynamo with the outdoor umbrella is not really a wise decision. Once the electrical connection the audio system is broken, the user is unable to replace the audio system. In other words, once the audio system is malfunction, the mood of all the participants may be ruined.

As a matter of fact, the very purpose of using outdoors umbrella is to shade vigorous sunlight. Therefore, it would be more economical, more convenient and more environmentally friendly if one were able to detachably add an additional audio system to any conventional outdoor umbrella for providing an add on function thereto without alternating the original structure of the outdoor umbrella.

In addition, outdoors umbrellas have been proved to be extremely popular among those frequently expose to outdoor environment. In the daytime, a typical outdoor umbrella may be utilized as a temporary shelter so that people or instruments under the umbrella are protected from high temperature or vigorous sunlight. Moreover, depending on the material by which the umbrella fabric is fabricated, even in cloudy or rainy weather, the outdoors umbrella may be utilized as a rain shelter or wind shelter. On the other hand, the typical outdoors umbrella is adapted to incorporate with a lighting system wherein a plurality of illuminating units are mounted on the awning ribs for providing a predetermined degree of illumination to a lighting zone defined as the area under the umbrella fabric. Therefore, people may utilize the outdoors umbrella with the lighting system in a variety of outdoors activities during nighttime, such as barbecuing, camping, outdoors gathering, or other events which involve considerable outdoors exposure at night.

The very advantage and convenience of the typical outdoors umbrella, however, do not shelter its disadvantages. It is the feature that the umbrella is capable of being utilized as a light source in an outdoors environment that renders its desirability to locate close to an external power source. Yet in an outdoors environment, the external power source, at least in the sense of the most typical power source for lighting system—electrical power source, cannot be guaranteed. One might utilize a rechargeable battery as the power source, but an additional step of charging the battery is inevitably needed. Very often, charging the battery can only be taken place when the umbrella is idle. Therefore, for example, when the user of the umbrella forgets charging the battery, the lighting system would not work on the next day. Sometimes, where the rechargeable battery cannot be conveniently detached from the outdoors umbrella, charging the battery would mean allocating extra space to store or to place the outdoor umbrella while the battery is being recharged.

The mounting arrangement of most of the outdoors umbrellas represents another problem. A considerable numbers of outdoors umbrellas have their lighting system mounted insecurely or in such a manner that the lighting system is functionally incompatible with the normal operation of the outdoor umbrellas themselves. As result, the performance of the respective lighting system is far from satisfactory. For example, during folding and unfolding operations of the outdoors umbrella, the awning ribs thereof may accidentally destroy the illuminating units of the lighting system. Since such outdoors umbrellas are designed for use in outdoors environment, as a result, secure mounting of the illuminating units are of utmost importance. If the lighting system is so insecure that, when subject to certain outdoors phenomenon, such as against a sudden strong wind, the lighting system is incapable of safely or unstably operating, it would not only cause disruption to the activities in which it uses, but also harm to the users, especially those standing or sitting within the lighting zone.

Furthermore, from the dawn to the twilight, the sunlight fell on the ground keeps changing at the time. In other to obtain the optimum shade from the outdoor umbrella, the user has to move the entire outdoor umbrella back and forth sometimes.

Last but not least, the typical lighting system of the outdoors umbrellas tend to be immovable in the sense that the illuminating units are permanently affixed on the awning ribs so that the illuminating directions are limited by the orientation and movement of the awning ribs. As a result, where the outdoors umbrella needs to be inclinedly supported on the ground in order to shield a particular direction, or partially opened for a particular purpose, the lighting system could not be satisfactorily operated.

SUMMARY OF THE PRESENT INVENTION

A main object of the present invention is to provide an audio system for an outdoor umbrella, wherein the audio system is adapted to detachably mount to a conventional outdoor umbrella so as to provide an add-on function for the conventional outdoor umbrella without altering its original structure.

Another object of the present invention is to provide an audio system for an outdoor umbrella, wherein no electric wire is required to electrically connect the audio system with the outdoor umbrella. In other words, the audio system provides an independent power supply such that the audio system does not require any power supply from the outdoor umbrella.

Another object of the present invention is to provide an audio system for an outdoor umbrella, wherein the audio system is adapted to detachably mount to any type of outdoor umbrella having an elongated shaft. Therefore, the user is able to mount the audio system from one outdoor umbrella to another outdoor umbrella easily.

Another object of the present invention is to provide an audio system for an outdoor umbrella, wherein the audio system does not significantly alter the original structure of the outdoors umbrella, so as to minimize the manufacturing and marketing costs of the audio system incorporating with the outdoor umbrella.

Another object of the present invention is to provide an audio system for an outdoor umbrella, wherein no complicated mechanical and electrical processes are involved in installing and mounting the audio system on the outdoor umbrella.

Another object of the present invention is to provide an audio system for an outdoor umbrella, wherein the audio system further provides an added lighting function for providing illumination.

Another object of the present invention is to provide an outdoors umbrella which incorporates with an audio system and a solar lighting system for providing audio output and illumination utilizing solar energy as an external energy source. Thus, the solar lighting system is environmentally friendly and economical to operate.

Another object of the present invention is to provide an outdoors umbrella with a solar lighting system, wherein the electrical operation of the solar light system is substantially unaffected by the folding and unfolding operation of the outdoors umbrella so that it is capable of fully operating while the outdoors umbrella is partially or inclinedly erected.

Another object of the present invention is to provide an outdoors umbrella with a solar lighting system which does not alter the original structural design of the outdoors umbrella, so as to minimize any potential risk of damage to the solar lighting system while the outdoor umbrella is folding or unfolding.

Another object of the present invention is to provide an outdoors umbrella with a solar lighting system which is capable of collecting solar energy while being exposed to sunlight to convert into electrical energy for recharging a power source to the illuminating units whenever necessary.

Another object of the present invention is to provide an outdoors umbrella comprising a solar lighting system, wherein no complicated mechanical and electrical structure and mechanism is required to incorporate with the outdoors umbrella so as to minimize the manufacturing and related cost of the present invention.

Accordingly, in order to accomplish the above objects, the present invention provides an audio system for an outdoor umbrella having a shaft, comprising:

an audio housing which comprises a first housing body and a second housing body defining a mounting slot when the first and second housing bodies are coupled with each other, wherein the mounting slot has a size for the shaft of the outdoor umbrella fitting therewithin;

a detachable locker comprising a first locker provided at the first housing body and a second locker which is provided at the second housing body and is releasably locked with the first locker so as to detachably lock up the second housing body with the first housing body; and an audio device which comprises a speaker supported in the first housing body and an audio input operatively coupling with the speaker such that when the audio input sends an audio signal to the speaker, the speaker is adapted for producing audio sound as an additional function for the outdoor umbrella.

The present invention also provides an outdoors umbrella, comprising:

an awning frame comprising a plurality of elongated awning arms radially extended in a pivotally movable manner and a shading awning substantially supported by the awning to define a shadowing area thereunder;

a supporting frame comprising a supporting shaft having an upper portion connected to the awning frame; and a solar lighting system, comprising:

a solar energy collector mounted on top of the awning frame for collecting solar energy;

a light support, which is adjustably mounted along the supporting shaft at a position within the shadowing area of the awning frame, comprising a plurality of supporting arms radially extended from the supporting shaft;

a plurality of illuminating units each comprising an illuminator electrically connected to the solar energy collector through the awning frame and a coupling joint connecting the illuminator to the respective supporting arm in a movably suspended manner such that by selectively adjusting a position of the light support along the supporting shaft, the illuminators are suspendedly self-repositioned for maximizing a light coverage area within the shadowing area;

a chain lighting arrangement comprising a plurality of illumination holders provided along the awning arms respectively, and a plurality of chain lighting units, which is electrically connected to the solar energy collector, aligned held by the illumination holders along the awning arms for reinforcing the illumination effects; and an attachable lighting arrangement comprising at least an illuminating unit, a plurality of illuminating unit supporters, each of which is formed on a lower end of respective awning arm, and a plurality of illuminating unit adaptors each of which has a holding member securely connected the illuminating unit and an engagement member slidably engaged with the illuminating unit supporters, wherein the illuminating unit adaptor is detachably attached to the illuminating unit supporters in such a manner that the illuminating unit connected to the illuminating unit adaptor is capable of sliding to maintain a substantially vertical orientation no matter the awn frame is in folding or unfolding position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
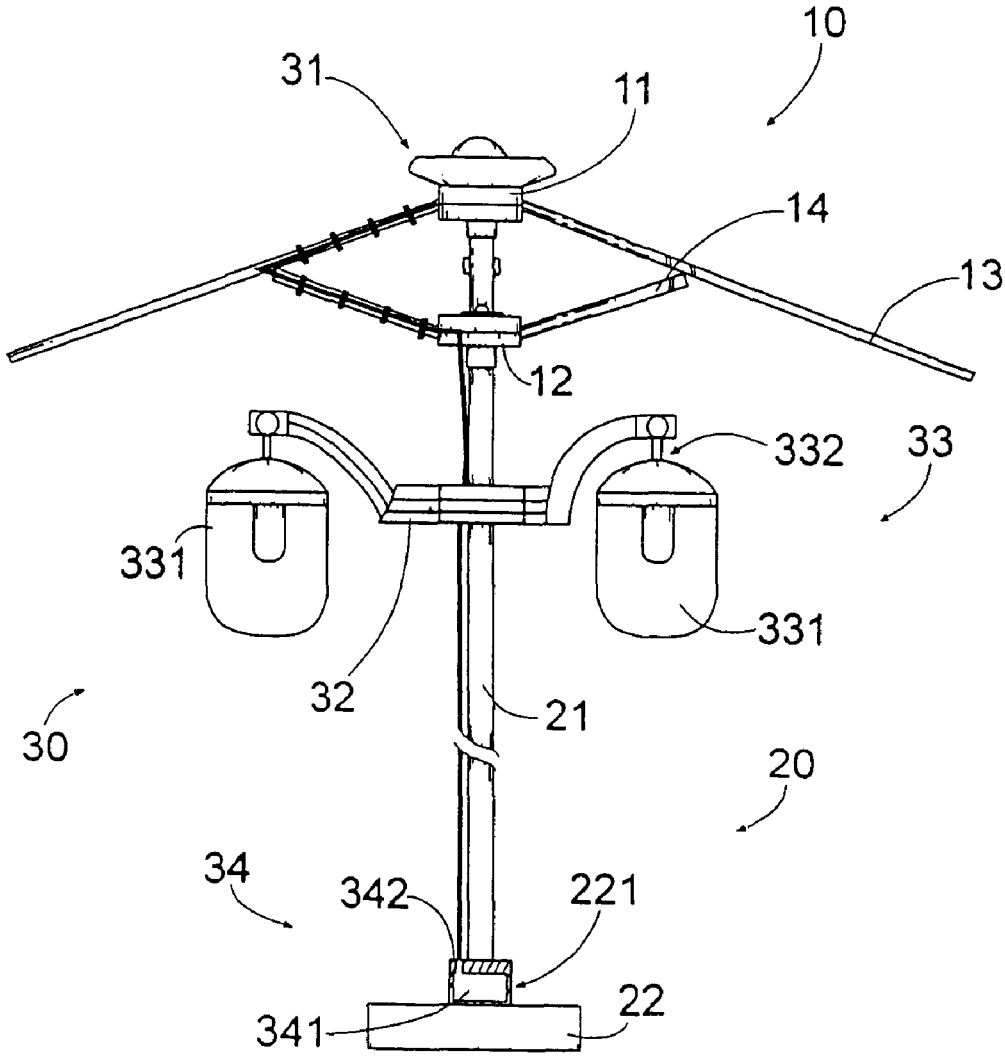
FIG. 1 is a schematic diagram of an outdoors umbrella incorporated with a solar lighting arrangement according to a preferred embodiment of the present invention.

Referring to FIG. 1 of the drawings, an outdoor umbrella 1 according to a preferred embodiment of the present invention is illustrated, wherein the outdoor umbrella 1, such as a conventional outdoor umbrella, comprises an awning frame 10 defining a shadowing area 101 thereunder and a supporting frame 20 comprising a supporting shaft 21 having an upper portion connected to the awning frame 10.

The outdoor umbrella 1 further comprises a solar lighting system 30 comprising a solar energy collector 31 mounted on top of the awning frame 10 for collecting solar energy, a light support 32, and a plurality of illuminating units 33.

The light support 32, which is adjustably mounted along the supporting shaft 21 at a position within the shadowing area 101 of the awning frame 10, comprises a plurality of supporting arms 321 radially extended from the supporting shaft 21.

Each of illuminating units 33 comprises an illuminator 331 electrically connected to the solar energy collector 31 through the awning frame 10 and a coupling joint 332 connecting the illuminator 331 to the respective supporting arm 321 in a movably suspended manner such that by selectively adjusting a position of the light support 32 along the supporting shaft 21, the illuminators 331 are suspendedly self-repositioned for maximizing a light coverage area within the shadowing area, 101.

According to the preferred embodiment, the awning frame 10 comprises an upper housing 11 affixed on top of the supporting shaft 21, a lower housing 12 slidably connected to the supporting shaft 21 at a position below the upper housing 11, a plurality of awning arms 13 radially and pivotally extended from the upper housing 11 to support an awning shelter 15 thereon, and a plurality of awning ribs 14 pivotally connecting the lower housing 12 with the awing arms 13 respectively in such a manner that when the lower housing 12 is slid along the supporting shaft 21 towards the upper housing 11, the awning arms 13 are pivotally driven by the awning ribs 14 to radially extended from the upper housing 11 so as to provide the shadowing area 101 under the awning shelter 15.

The supporting frame 20 further comprises a ground stand 22 wherein the supporting shaft 21 is upwardly extended from the ground stand 22 to support the awning frame 10.

Figure 2:
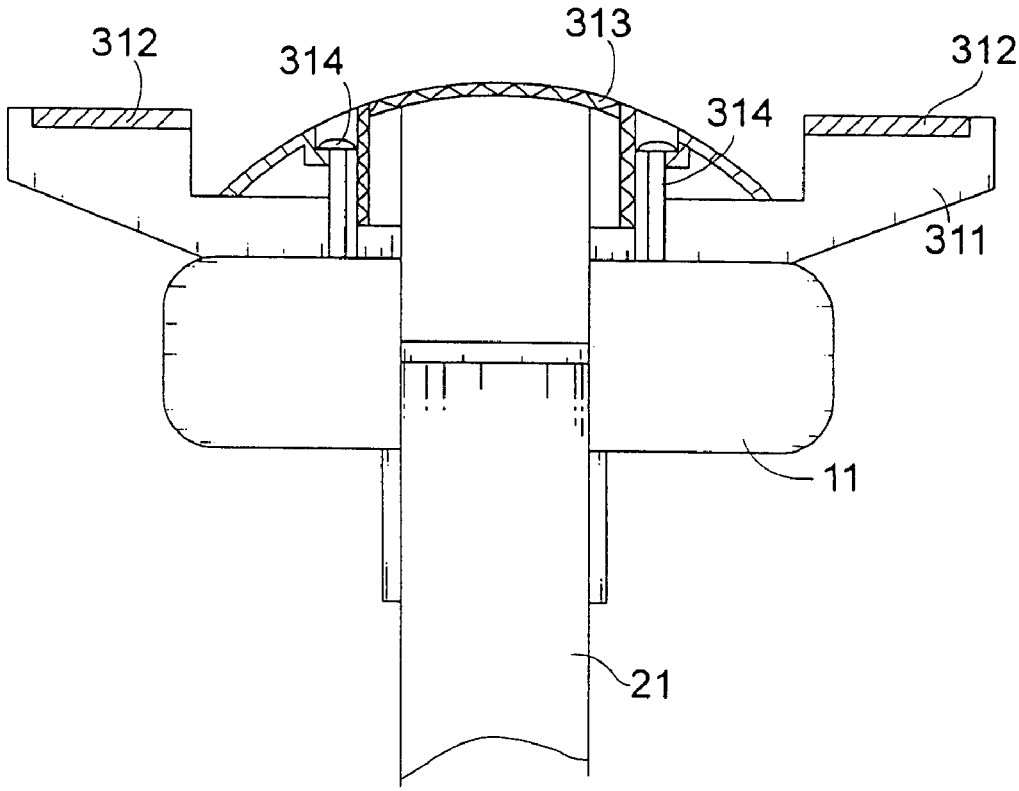
FIG. 2 is a sectional view of the solar lighting arrangement of the outdoors umbrellas according to the above preferred embodiment of the present invention, illustrating the solar energy collector of the solar lighting arrangement.

Referring to FIG. 2, the solar energy collector 31 comprises a collector base 311, having a circular shaped, coaxially mounted on a top end portion of the supporting shaft 21 at a position above the upper housing 11, and a solar energy collecting device 312 which is provided on a platform of the collector base 311 and is upwardly oriented for collecting the solar energy so as to convert the solar energy into electrical energy to the illuminators 331.

In order to further secure the attachment between the solar energy collector 31 and the supporting shaft 21, the solar energy collector 31 further comprises a protective cover 313 substantially affixed to the upper housing 11 on top of the supporting shaft 21 so as to securely sandwich the collector base 311 between the upper housing 11 and the protective cover 313. As shown in FIG. 2, in order to facilitate the secure attachment, two connecting elements 314, which are preferably two rivets, can be utilized to mount the protective cover 313 to the upper housing 11 through the upper housing 11 to securely clamp the collector base 311 between the upper housing 11 and the protective cover 313, so as to retain the solar energy collecting device 312 in position.

Figure 3:
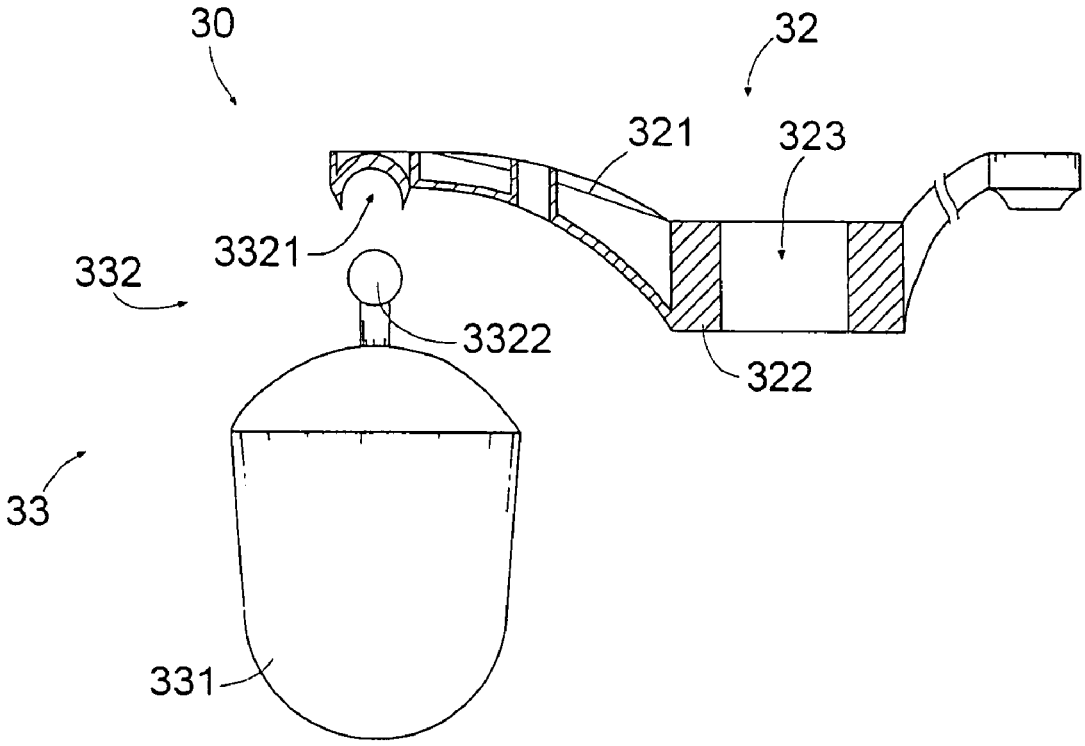
FIG. 3 is a partially sectional view of the lighting system of the outdoors umbrella according to the above preferred embodiment of the present invention, illustrating the illuminating unit of the solar lighting arrangement.

As shown in FIG. 3, the light support 32 further comprises a central hub 322 having a central sliding through slot 323 for the supporting shaft 21 sliding therethrough, wherein the supporting arms 31 are spacedly and radially extended from the central hub 322.

Each of the illuminators 331 is embodied as a light bulb wherein the illuminators 331 are electrically connected to the solar energy collecting device 312 of the solar energy collector 31 along one of the awning arms 13 and the respective awning rib 14 via an electric cable, as shown in FIG. 1, in such a manner that the electrical connection between the illuminators 331 and the solar energy collector 31 will not be interfered by the awning frame 10, especially the folding and unfolding operation of the awning frame 10 of the outdoor umbrella 1. Accordingly, the awning arms 13 and the awning ribs 14 are constructed to have a hollow shape such that the electric cable is adapted to pass through the respective awning arm 13 and the awning rib 14 to electrically connect the solar energy collector 31 to the respective illuminator 331.

It is worth to mention that each illuminator 331 is preferably embodied as a Light Emitting Diode (LED) received in a light housing since the LED of the illuminator 331 provides a predetermined set of illumination parameters, such as brightness, color etc. so as to provide optimal illumination for a range of designated applications while being energy effective.

Furthermore, the solar lighting system 30 further comprises a chain lighting arrangement 34 and an attachable lighting arrangement 35, respectively mounted on the body and the lower end of awning arms 13 for primarily providing illumination effect to the shadowing area 101 defined by the awning frame 10 so as to enrich the illuminating effects.

Figure 4:
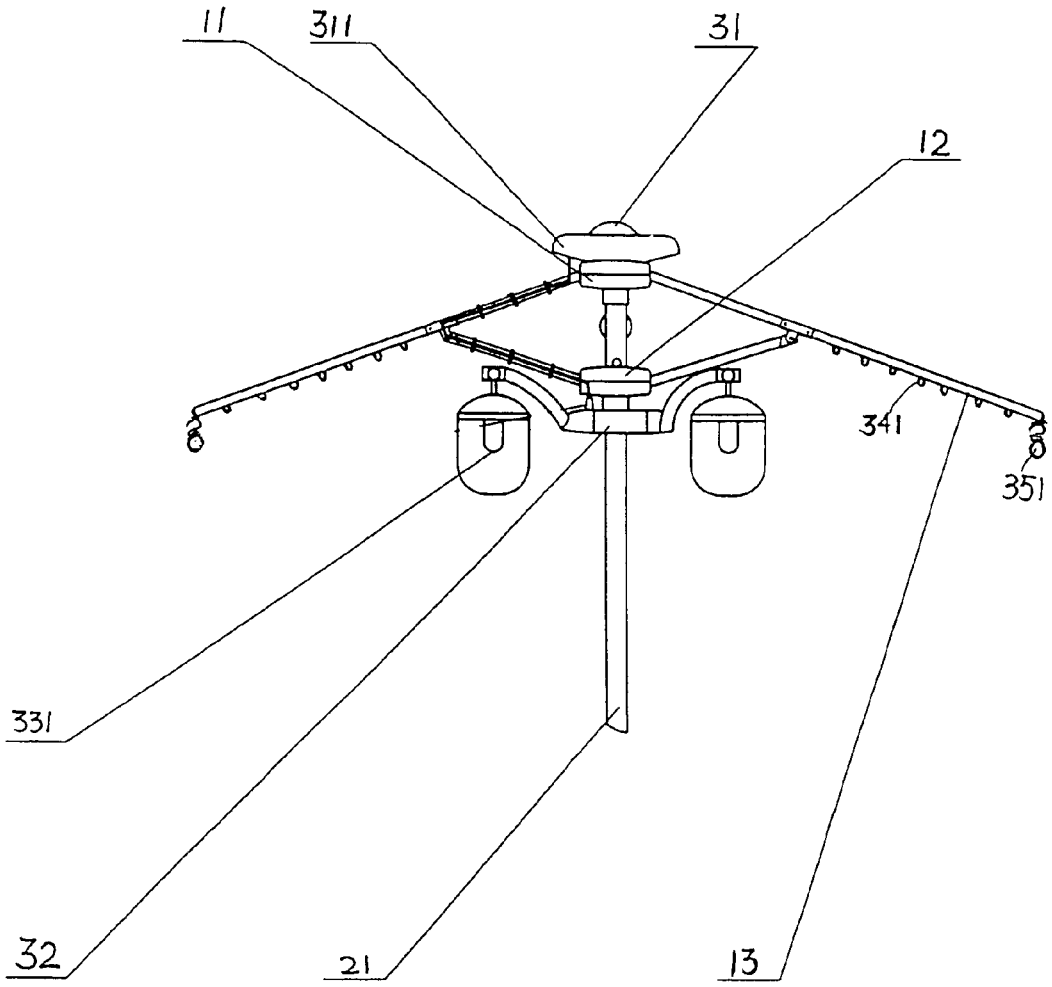
FIG. 4 is a schematic diagram of the outdoors umbrella showing the chain lighting arrangement and attachable lighting arrangement of the solar lighting arrangement according to the first preferred embodiment of the present invention.
Figure 5:
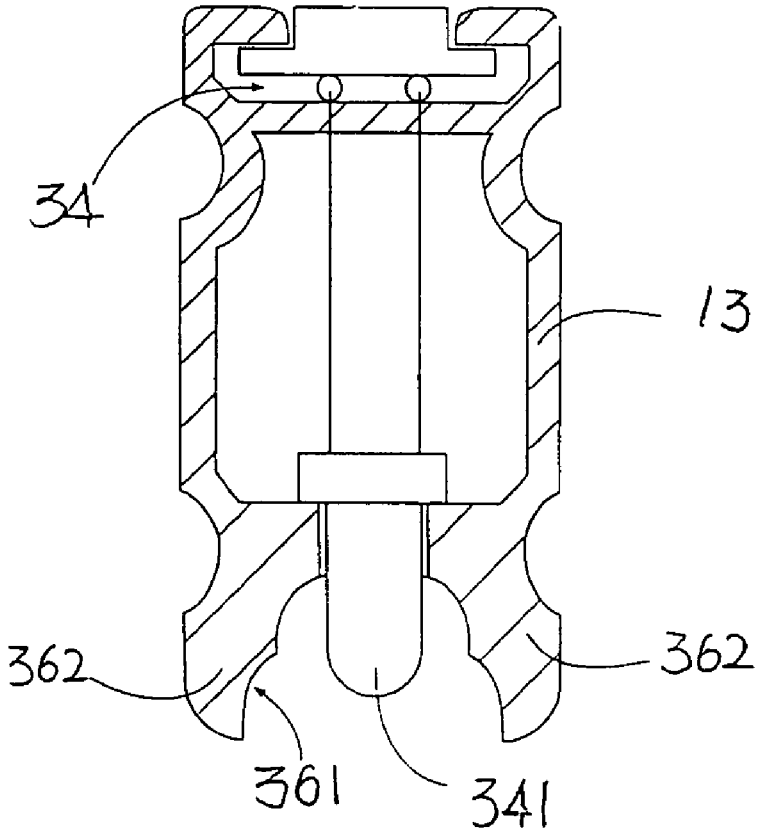
FIG. 5 is a sectional view of an elongated awning arm incorporated the chain lighting arrangement according to the first preferred embodiment of the present invention.
Figure 6:
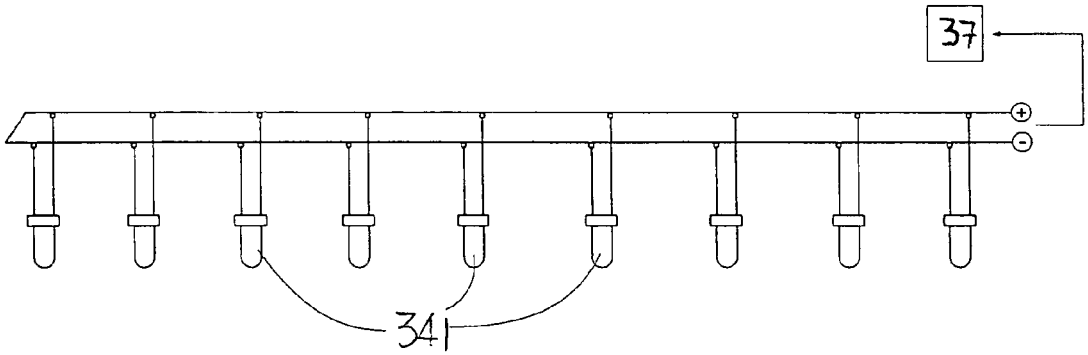
FIG. 6 is a schematic diagram of the connection of the chain lighting units according to the above preferred embodiment of the present invention.

Referring to FIG. 4-6 of the drawings, the chain lighting arrangement 34 according to the first preferred embodiment of the present invention is illustrated. First of all, the chain lighting arrangement 34 further comprises a plurality of illumination holders 36 provided along the awning arm 13 respectively. Accordingly, each of the illumination holders 36 is embodied as an elongated receiving groove 361 formed along a bottom side of the respective awning arm 13. According to the first preferred embodiment of the present invention, two retaining walls 362 downwardly and integrally extended along the bottom side of each of the awning arms 13 wherein the receiving groove 361 is defined between the respective two retaining walls 362 and the bottom side along the respective awning arm 13. Accordingly, an inner side of each of the retaining walls 362 is concavely curved so that it is capable of intensively reflecting any illumination generated within the receiving groove 361 to an outside thereof.

Second, the chain lighting arrangement 34 comprises a plurality of chain lighting units 341 alignedly received in the receiving grooves 361 respectively wherein the illumination generated by the chain lighting units 341 are substantially reflected out of the receiving grooves 361 by the retaining walls 362 so as to illuminate the shadowing area 101 of the outdoors umbrella 1. Moreover, since the chain lighting units 341 are substantially received in the receiving grooves 361 respectively, they are substantially protected from any potential damage resulting from any mechanical operation of the outdoors umbrella 1 of the present invention, such as folding or unfolding. In other words, the chain lighting arrangement 34 of the present invention substantially overcome the conventional disadvantage of frangibility of illuminating elements caused by the umbrella's own mechanical operations, such as folding and unfolding movement.

According to the preferred embodiment, each of the awning arms 13 is a hollow body wherein the electrical wires could be inserted. As a result, it is convenient for communicating the interior of awning arm 13 and the receiving groove 361, for example, through a plurality of slots or a continuous slit, etc.

In order to further protect the chain lighting arrangement 34 from potential physical damage by external objects, the chain lighting arrangement 34 further comprises a plurality of light holders 343 slidably inserted into the awning arm 13 respectively. The chain lighting units 341 are spacedly mounted at the respective light holder 343 such that light holder 343 is capable of holding the chain lighting units 341 in position along the awning arms 13 thus protecting the chain lighting units 341 within the receiving grooves 361 respectively.

Referring to FIG. 6 of the drawings, the chain lighting units 341 disposed in each of the awning arm 13 are electrically connected in series through the respective awning arms 13 wherein an electric cord is received in the respective awning arm 13 for electrical connection. Further, the electric cord has two terminals, namely positive and negative, which are extended to the upper housing 11 and then electrically connected to a power source for the provision of energy so as to light up the chain lighting units 341. According to the preferred embodiment, the chain lighting units 341 could be embodied as regular LEDs which are capable of illuminating light of different colors and brightness.

The chain lighting arrangement 30 further comprises an IC board 37 mounted in the upper housing 11 wherein the terminals for electric cord mounted on each of the awning arms 13 are electrically connected to the IC board 37 which is further electrically connected to a power source via electrical wires.

From the forgoing description, it is shown that the outdoors umbrella 1 of the present invention comprises the chain lighting units 341 which are embedded in the awning arms 13 respectively to form an integral awning body. As a result, users of the present invention can enjoy illumination without fear of any storage or operational damages to the outdoors umbrella 1.

Figure 7:
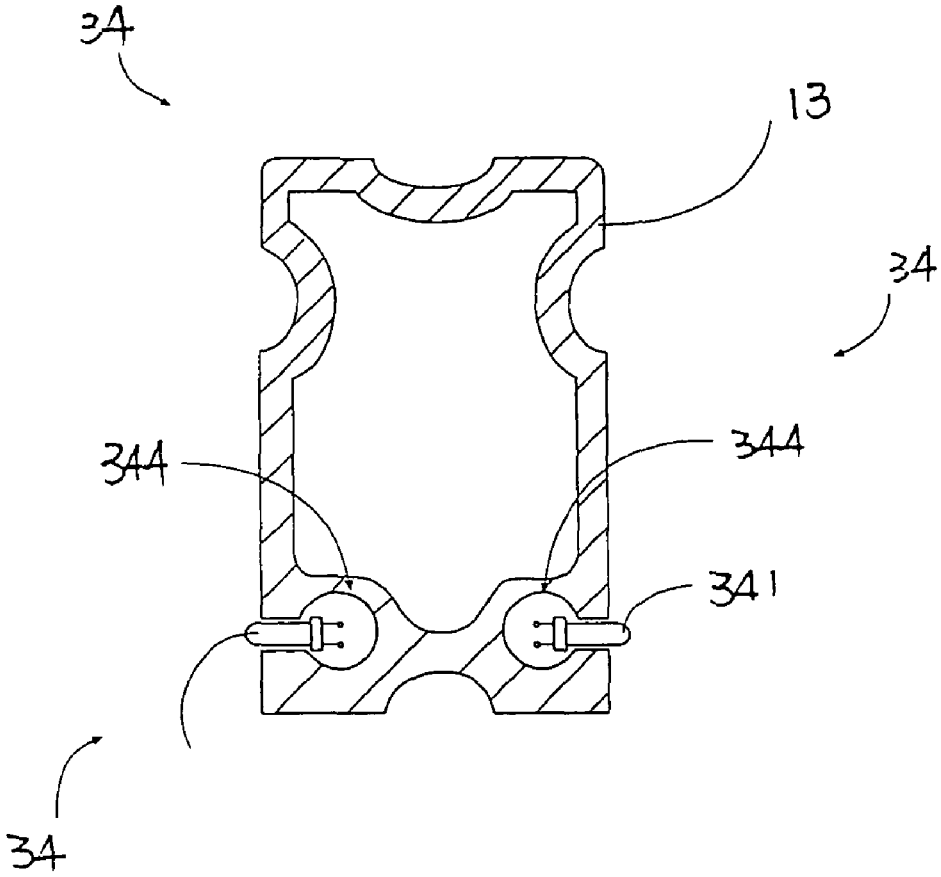
FIG. 7 is a first alternative mode of the chain lighting arrangement according to the above preferred embodiment of the present invention.

Referring to FIG. 7 of the drawings, a first alternative mode of the chain lighting arrangement 34 according to the above preferred embodiment of the present invention is illustrated. According to the first alternative mode, there are two lighting slots 344 indentedly formed on two sidewalls of each of the awning arms 13 respectively wherein the chain lighting units 341 of the chain illuminating system 34 are alignedly received in the lighting slots 37 respectively. Here, the chain lighting units 341 in each of awning arms 13 are also electrically connected in series through the respective awning arms 13 by the electric cord which is received in the respective lighting slot 344, wherein the electrical cord has two terminals, namely positive and negative, which are extended to the upper housing 11 and then electrically connected to a power source for the provision of energy to light up the chain lighting units 341.

Figure 8:
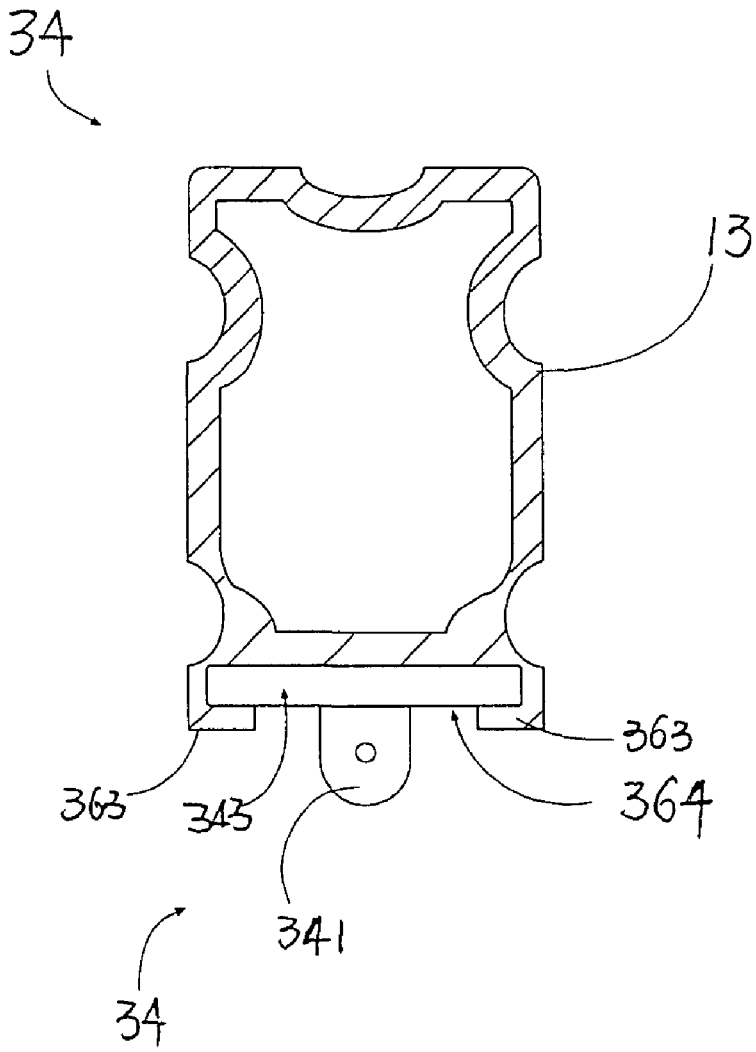
FIG. 8 is a second alternative mode of the chain lighting arrangement according to the above preferred embodiment of the present invention.

Referring to FIG. 8 of the drawings, a second alternative mode of the chain lighting arrangement 34 is illustrated. Here, the retaining wall 362 and the receiving groove 361 in the preferred embodiment cease to exist. Furthermore, the L-shaped electric boundaries 363 are provided at a bottom side of each of the awning arms 13 to define a receiving groove 364, while the light holders 343 is embodied as an elongated protective strip being slidably mounted into the receiving groove 364. The electric cord connecting—the illuminating units 341 is arranged to be embedded or totally buried into the elongated protective strip to prevent any possible direct contact with external objects, thus reducing the possibility of being damaged thereby. Likewise, the electric cord is then extended to a power source for acquiring transmitting electricity to the chain lighting units 341.

Figure 9:
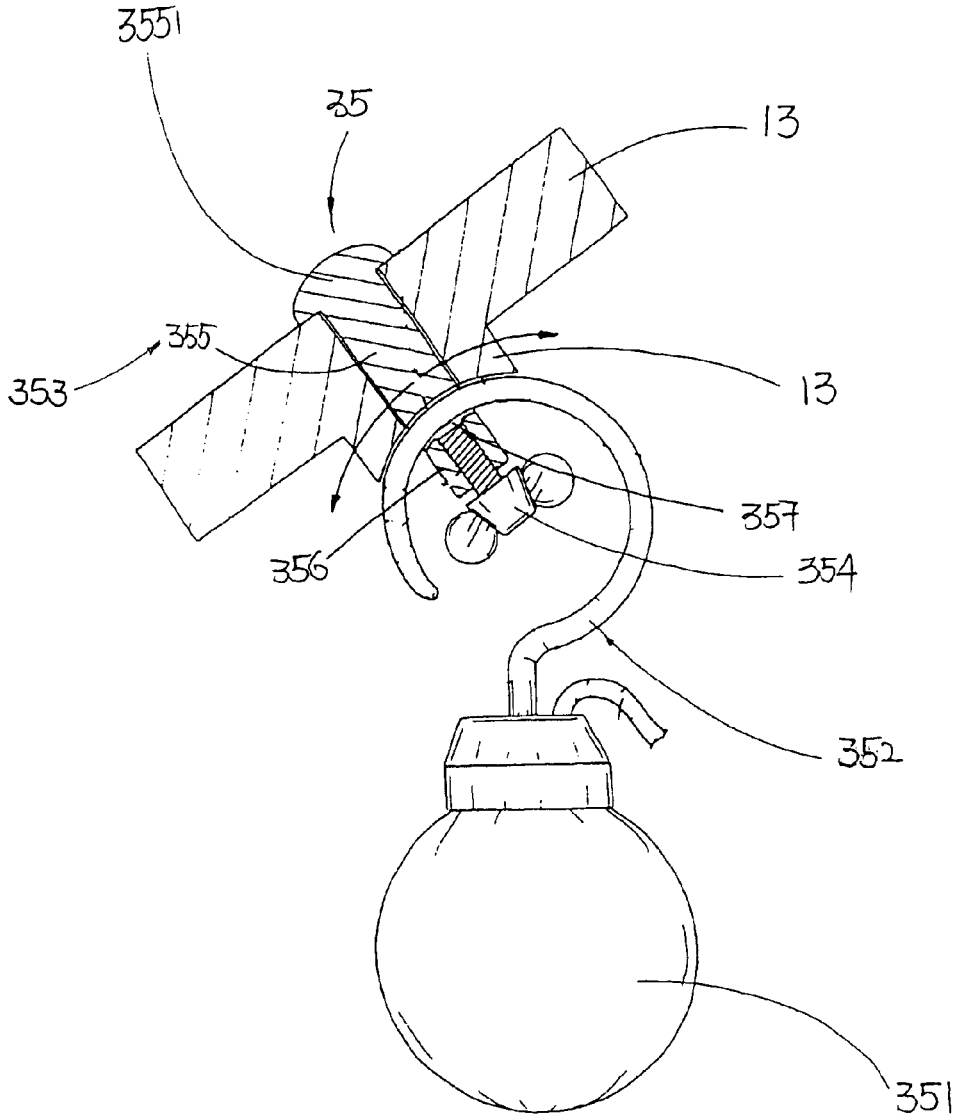
FIG. 9 is a sectional view of the attachable illuminating arrangement according to the above preferred embodiment of the present invention illustrating how the illuminating unit maintains its substantially vertical orientation while the awning arm is extended in an inclined position.

Referring to the FIG. 9 of the drawing, the attachable lighting arrangement 35 is illustrated. Here, the attachable lighting arrangement 35 comprises at least an attachable illuminating unit 351 for generating light, and means for attaching the illuminating unit 351 to the lower end of the respective awning arm 13 in a vertically down hanging manner so as to maintain the light generated by the illuminating unit 351 directing downwards no matter the awning frame 10 is in the unfolded position or in folded position. Preferably, the illuminating unit 351 is a typical light bulb. It is noted that the illuminating unit 351 can be other illuminating article such as LED, halogen lamp, fluorescent lamp, and so on.

As shown in the FIG. 9, the attaching means comprises an illuminating unit adaptor 352 connected to the illuminating unit 351 and an illuminating unit supporter 353 provided at the respective lower end of the awning arm 13, wherein the illuminating unit adaptor 352 is detachably mounted to the illuminating unit supporter 353 in a suspending manner. Moreover, the attachable lighting arrangement 35 further comprises a locking means 354 for locking the illuminating unit 351 at any position with respect to the awning frame 10.

Furthermore, the attachable lighting arrangement 35 is embodied to be detachably mounted at the lower end of the respective awning arm 13. According to the preferred embodiment, the illuminating unit supporter 353 is embodied as (but not limited to) a shank body 355 transversely extended therethrough, which has an enlarged head 3551 mounted on an outer side of lower end of the respective awning arm 13 and a connecting member 356 protruded from an inner side of the lower end of the awning arm 13, wherein a mounting slot 357 is transversely penetrating through the connecting member 356.

Figure 10:
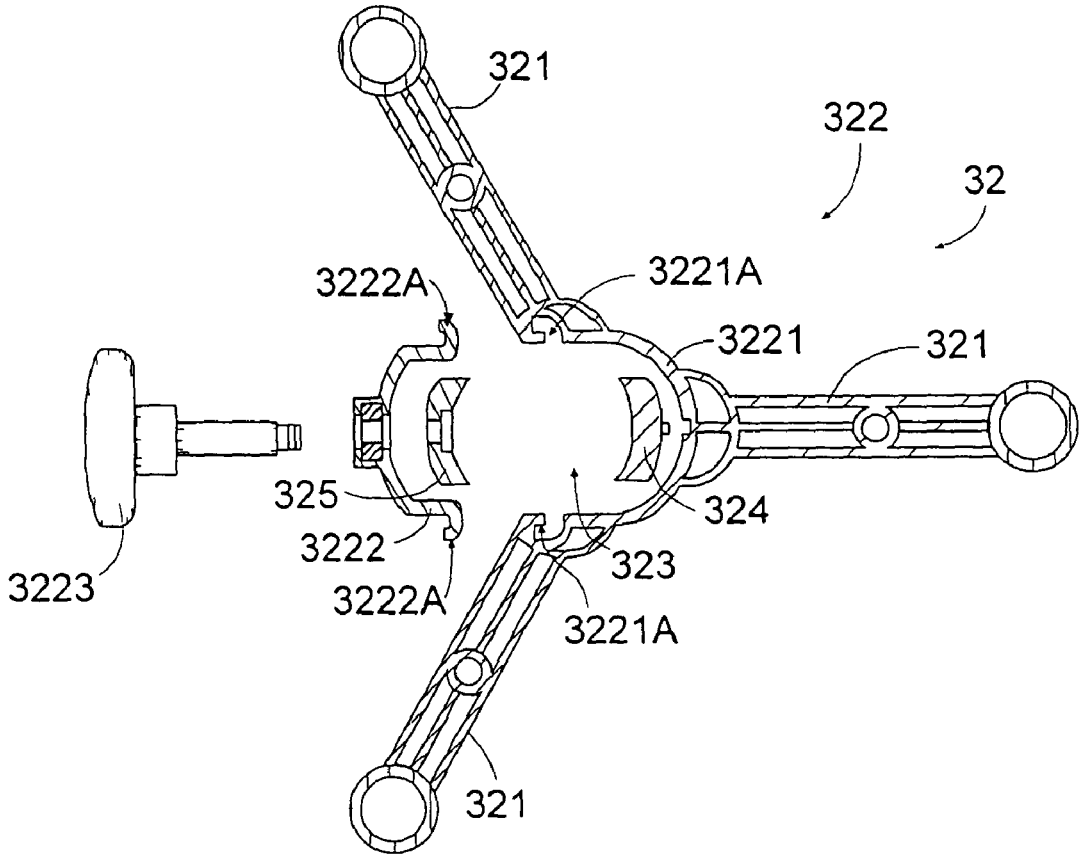
FIG. 10 is an exploded sectional view of the light support of the solar lighting arrangement according to the above preferred embodiment of the present invention.

Here, as shown in the FIG. 10, each of the coupling joints 332 has a ball slot 3321 formed at a distal end of the respective supporting arm 321 and comprises a spherical head 3322 which is formed on top of the respective illuminator 331 and is arranged to engage with the respective ball slot 3321 in a rotatably movable manner, so as to provide a ball joint to connect the each of the illuminators 331 with the respective supporting arm 321. In other words, the illuminators 331 are capable of self-rotating while being suspendedly supported by the supporting arms 321 so as to enhance the flexibility of the provision of illumination to the outdoors umbrella 1.

It is worth to mention that a size of the spherical head 3322 is slightly smaller than the size of the respective ball slot 3321 wherein an outer wall of the ball slot 3321 is fabricated by elastic materials, such as plastic, so that by slightly pressing the spherical head 3322 to the respective ball slot 3321, the spherical head 3322 is capable of moving within the respective ball slot 3321 in free-swinging manner.

According to the preferred embodiment, there are three supporting arms 321 radially and suspendedly extended from the central hub 322 wherein there are three illuminators 331 are suspendedly supported by the supporting arms 321 via the coupling joints 332 respectively.

Figure 11:
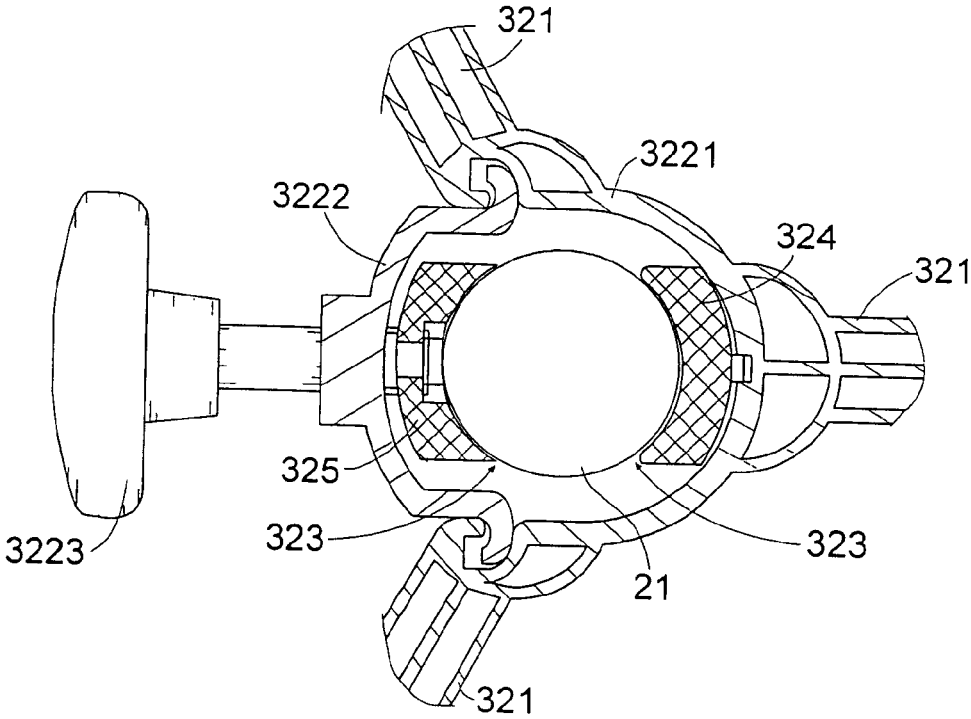
FIG. 11 is a partially sectional view of the light support of the solar lighting arrangement according to the above preferred embodiment of the present invention, illustrating the light support being mounted on the supporting shaft.

Referring to FIGS. 10 to 11 of the drawings, the central hub 322 comprises a boundary sleeve 3221 having an arc-shaped and a boundary cover 3222 interlocked with the boundary sleeve 3221 to form the central sliding through slot 323 within inner walls of the boundary sleeve 3221 and the boundary cover 3222, and a locking member 3223 having a locking end rotatably penetrated through the boundary cover 3222 to bias against the supporting shaft 21 so as to lock up the central hub 322 at the supporting shaft 21 in position.

As shown in FIG. 11 of the drawings, the boundary sleeve 3221 has two locking grooves 3221A formed along two edge portions and the boundary cover 3222 has two locking edges 3222A, each having a hook shaped corresponding to the locking groove 3221A, fittedly engaged with the locking grooves 3221A so as to interlock the boundary cover 3222 with the boundary sleeve 3221. Therefore, when the boundary cover 3222 is interlocked with the boundary sleeve 3221 to retain the supporting shaft 21 within the central sliding through slot 323, the locking member 3223 is rotated through the boundary cover 3222 until the locking end of the locking member 3223 is driven to bias against the supporting shaft 21 to lock up the light support 32 on the supporting shaft 21.

The light support 32 further comprises a first securing member 324 detachably attached to the inner wall of the boundary sleeve 3221 to bias against the supporting shaft 21 and a second securing member 325 attached to the locking end of the locking member 3223 at the inner wall of the boundary cover 3222 wherein the second securing member 325 is driven by the locking member 3223 to adjust a size of the central sliding through slot 323 for fittingly biasing against the supporting shaft 21 such that the supporting shaft 21 is securely clamped between the first and second securing members 324, 325. In other words, the light support 32 is capable of fittingly mounting on different sizes of the supporting shafts having various diameters by selectively adjusting a distance between the first and second securing members 324, 325.

As shown in FIG. 1, the solar lighting system 30 further comprises a power source unit 34 which comprises a power source 341 supported by the supporting frame 20 to receive in a power source compartment 221 provided at the ground stand 22 and to electrically connect with the illuminating units 33 and an recharging device 342 electrically connecting the solar energy collector 31 with the power source 341 for converting the solar energy into the electrical energy so as to recharge the power source 341. Accordingly, during the daytime, the solar energy collector 31 collects the solar energy and charges up the power source 341 via the recharging device 342 such that the power source 341 is capable of providing electrical energy to the illumination units 33 during the nighttime. It is worth to mention that the recharging device 342 functions as an auto switch to automatically recharging the power source 341. Therefore, the recharging device 342 is capable of determining an electric capacity of the power source 341 wherein when the electric capacity of the power source 341 is full of charge, the recharging device 342 stops recharging the power source 341. However, when the electric capacity of the power source 341 is below a predetermined level, the recharging device 342 will start recharging the power source 341 from the solar energy collector 31 until the electric capacity of the power source 341 is full of charge.

It is also worth mentioning that from the forgoing elaboration, one can easily see that the solar lighting system 30 is capable of securing mounting onto the supporting shaft 21 of the supporting frame 20 without affecting the operation of the outdoors umbrella 1 as a whole. Moreover, the illuminating units 33 of the solar lighting system 30 are capable of freely orientating so that when the outdoors umbrella 1 occasionally requires inclined erection or open partially, the solar lighting system 30 will always provide optimal illumination, irrespective of such occasions.

Figure 12:
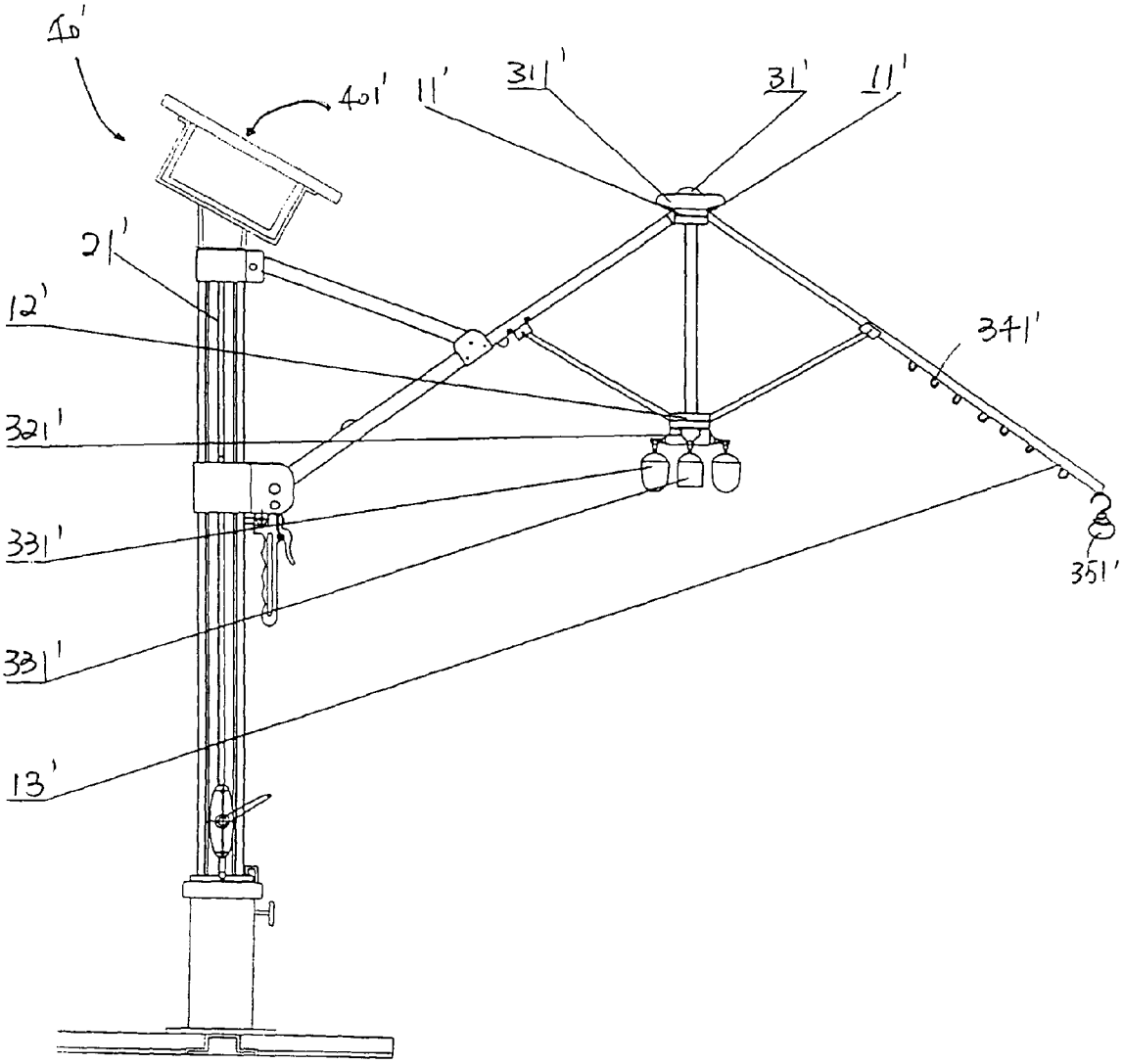
FIG. 12 is schematic view of the outdoors umbrella according to the second preferred embodiment of the present invention.

Referring to FIG. 12 of the drawings, an outdoor umbrella 1' according to a second preferred embodiment of the present invention is illustrated, wherein the outdoor umbrella 1', such as a conventional outdoor umbrella, comprises an awning frame 10' defining a shadowing area 101' thereunder and a supporting frame 20' comprising a supporting shaft 21' having an upper portion connected to the awning frame 10'.

The outdoor umbrella 1' further comprises a connecting arm 22' sidewardly extended from a top portion of the main supporting shaft 21' in a pivotally moveable manner, and an supporting arm 23' slidably mounted on the connecting arm 22' for supporting an awning frame 10'.

Here, the awning frame 10' comprises a longitudinal awning shaft 16', an upper housing 11' affixed on top of the awning shaft 16', a lower housing 12' slidably connected to the awning shaft 16' at a position below the upper housing 11', a plurality of awning arms 13 radially and pivotally extended from the upper housing 11' to support an awning shelter 15' thereon, and a plurality of awning ribs 14' pivotally connecting the lower housing 12' with the awing arms 13' respectively in such a manner that when the lower housing 12' is slid along the awning shaft 16' towards the upper housing 11, the awning arms 13 are pivotally driven by the awning ribs 14' to radially extended from the upper housing 11' so as to provide the shadowing area 101' under the awning shelter 15'.

In other words, the awning frame 10' are capable of being moved in such a manner that they are adapted to move between a folded position and a unfolded position, wherein the folded position, the awning arms 13' are pivotally and inwardly folded to overlappedly lay in position, wherein in the unfolded position, the awning arms 13' are pivotally and outwardly extended to support the awning frame 10' thereon and to define a shadowing area 101' under the awning shelter 15'.

The outdoor umbrella 1' further comprises a solar lighting system 30' comprising a solar energy collector 31' mounted on top of the awning frame 10' and top of the supporting shaft 21' for collecting solar energy, a light support 32', and a plurality of illuminating units 33'.

The light support 32', which is adjustably mounted on the lower housing 12' for strengthening the illumination effects. Preferably, the awning frame 10' comprises a plurality of supporting arms 321' radially extended from the lower housing 12'.

Each of illuminating units 33' comprises an illuminator 331 electrically connected to the solar energy collector 31' through the awning frame 10' and a coupling joint 332' connecting the illuminator 331' to the respective supporting arm 321' in a movably suspended manner such that by selectively adjusting a position of the light support 32' along the awning shaft 16', the illuminators 331' are suspendedly self-repositioned for maximizing a light coverage area within the shadowing area 101'.

It is worth to mention that illuminating 33' could be embodied as a regular bulb mounted on the lower housing 12'.

The supporting frame 20' further comprises a ground stand 22' wherein the supporting shaft 21' is upwardly extended from the ground stand 22' to support the awning frame 10'.

Compared with the first preferred embodiment of the present invention, the awning frame 10 is further extended away from the supporting shaft 21'. As a result, the user is able to adjust the outdoor umbrella according to the sun's position from the dawn to twilight.

Furthermore, the solar lighting system 30 further comprises a chain lighting arrangement 34' and an attachable lighting arrangement 35', respectively mounted on the body and the lower end of awning arms 13' for primarily providing illumination effect to the shadowing area 101' defined by the awning frame 10' so as to enrich the illuminating effects.

It is noted that the above chain lighting arrangement 34' and attachable lighting arrangement 35, are with identical structure and design with chain lighting arrangement 34 and attachable lighting arrangement 35 of the first preferred embodiment of the present invention.

According to the alternative mode of the second preferred embodiment of the present invention, the solar lighting system 30' comprises at least a central lighting element 301' and a plurality of chain illuminating units 341' mounted on the awning frame 10' for primarily providing illumination to the shielding zone defined by the plurality of awning arms 13'. Here, in this mode, the central lighting elements 301' is a regular lights bulb mounted on the lower housing 12' for providing strong illumination at a central portion of the shielding zone. The plurality of illuminating units 341' are Light Emitting Diodes (LEDs) mounted on the plurality of awning arms 13' respectively for providing mild illumination for the shielding zone.

Likewise, there is a solar energy collector 33' comprises a collector base 311', having a circular shaped, coaxially mounted on a top end portion of the awning shaft 16' at a position above the upper housing 11', and a solar energy collecting device 312' which is provided on a platform of the collector base 311' and is upwardly oriented for collecting the solar energy so as to convert the solar energy into electrical energy to the illuminators 331'.

In addition, in the second preferred embodiment, there is a solar energy collecting device 40' nested on a top portion of the supporting shaft 21', wherein the solar collecting device 40' has a collecting surface 401' arranged to face upward so that it can be exposed to sunlight for extensively collecting solar energy. Moreover, the solar collecting device 40' is adapted to collect solar energy from sunlight impinged on the collecting surface 401', and converts the collected solar energy into electrical energy, wherein the solar lighting system 30' is electrically connected with the solar collecting device 401' so that the converted electrical energy is supplied to the light system 30'.

Conclusively, the solar collecting device 40' is mounted on top of the supporting shaft 21' while the solar energy collector 33' is mounted on the upper housing 11', so that the user of the outdoors umbrella can be able to adjust its orientation for maximizing the absorption of solar energy and enjoy the maximum solar energy.

At the meanwhile, it is worth to mention that in the second preferred embodiment of the present invention, the illuminators 331' are with same structure and design as the illuminator 331 in the first preferred embodiment.

Each of the illuminators 331' is embodied as a light bulb wherein the illuminators 331' are electrically connected to the solar energy collecting device 312' of the solar energy collector 31' via the awning shaft 16'.

Figure 13:
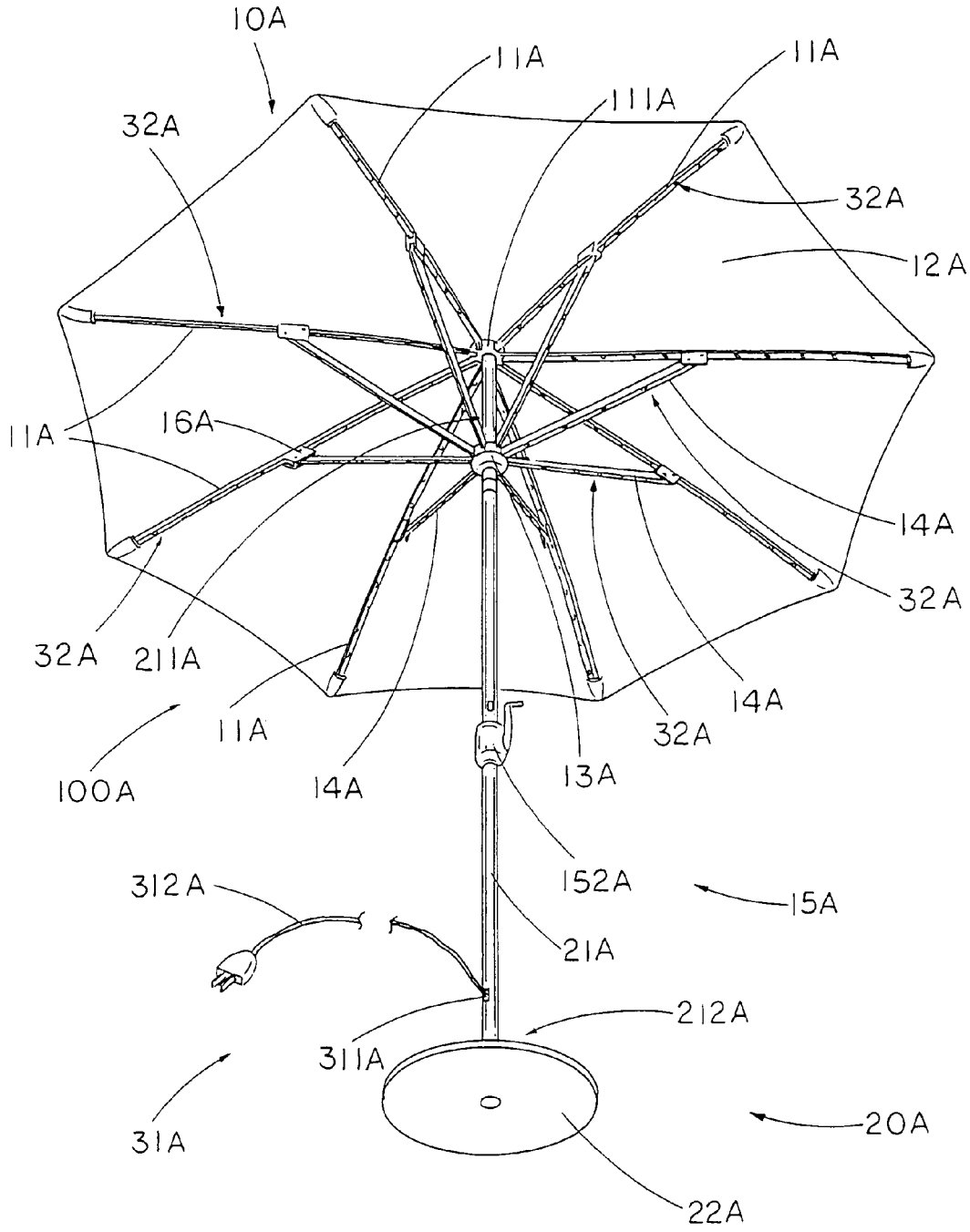
FIG. 13 is a perspective view of an outdoor umbrella according to a third preferred embodiment of the present invention.

Here, as shown in the FIG. 13, each of the coupling joints 332' has a ball slot 3321' formed at a distal end of the respective supporting arm 321' and comprises a spherical head 3322' which is formed on top of the respective illuminator 331' and is arranged to engage with the respective ball slot 3321' in a rotatably movable manner, so as to provide a ball joint to connect the each of the illuminators 331 with the respective supporting arm 321'. In other words, the illuminators 331' are capable of self-rotating while being suspendedly supported by the supporting arms 321' so as to enhance the flexibility of the provision of illumination to the outdoors umbrella 1.

It is worth to mention that a size of the spherical head 3322' is slightly smaller than the size of the respective ball slot 3321' wherein an outer wall of the ball slot 3321' is fabricated by elastic materials, such as plastic, so that by slightly pressing the spherical head 3322' to the respective ball slot 3321', the spherical head 3322' is capable of moving within the respective ball slot 3321' in free-swinging manner.

According to the preferred embodiment, there are three supporting arms 321' radially and suspendedly extended from the lower housing 12' wherein there are three illuminators 331' are suspendedly supported by the supporting arms 321' via the coupling joints 332' respectively.

As shown in FIG. 13, an outdoor umbrella of a third embodiment illustrates an alternative mode of the first embodiment of the present invention, wherein the outdoor umbrella comprises an awning frame 10A, a supporting frame 20A and a lighting system 30A.

The awning frame 10A comprises a plurality of elongated awning arms 11A radially extended in a pivotally movable manner and a fabric awning 12A substantially supported by the awning arms 11A to define a shadowing area 100A thereunder.

The supporting frame 20A comprises a supporting shaft 21A having an upper portion 211A connected to the awning frame 10A.

The lighting system 30A comprises a power unit 31A and a plurality of illuminating units 32A mounted to the awning frame 10A and electrically connected to the power unit 31A along the awning frame 10A for illuminating the shadowing area 100A under the awning 12A.

Figure 14:
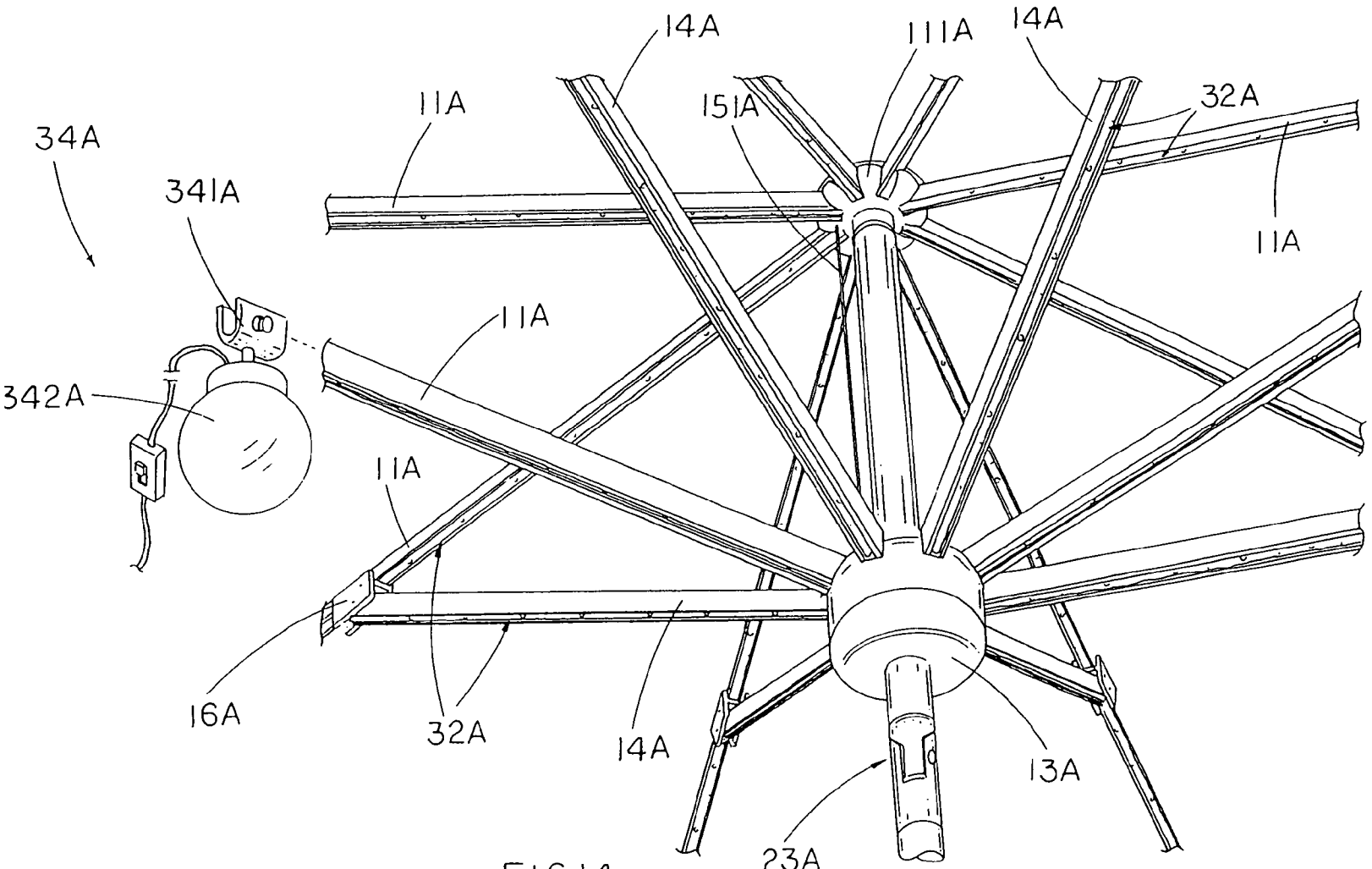
FIG. 14 is a partially perspective view of the outdoor umbrella according to the above third preferred embodiment of the present invention.

As shown in FIGS. 13 and 14, each of the awning arms 11A has an inner end and an outer end, wherein the inner ends of the awning arms 11A are pivotally connected with each other via an upper hub 111A such that the outer ends of the awning arms 11A are radially and outwardly extended from the upper hub 111A.

The awning frame 10A further comprises a central hub 13A and a plurality of folding ribs 14A pivotally and radially extended from the central hub 13A to pivotally connect with the awning arms 11A respectively such that when the central hub 13A is driven downwardly, the awning arms 11A are pivotally folded to fold up the awning 12A, and when the central hub 13A is driven upwardly, the awning arms 11A are pivotally folded to tensionally stretch out the awning 12A for providing the shadowing area 100A thereunder. Accordingly, the central hub 13A is coaxially positioned below the upper hub 111A such that when the central hub 13A is driven upwardly towards the upper hub 111A, the awning arms 11A are folded pivotally and outwardly to stretch the awning 12A in a tension manner. When the central hub 13A is driven downwardly away from the upper hub 111A, the awning arms 11A are folded pivotally and inwardly to fold up the awning 12A.

The supporting frame 20A further comprises a ground stand 22A to support the awning frame 10A in stable manner, wherein a lower portion 212A of the supporting shaft 21A is upwardly extended from the ground stand 22A to connect with the awning frame 10A. Accordingly, the upper portion 211A of the supporting shaft 21A is slidably penetrated through the central hub 13A to connect the upper hub 111A such that the central hub 13A is adapted to slide along the supporting shaft 21A to fold and unfold the awning 12A. Furthermore, the supporting frame 20A further comprises a pivot joint 23A pivotally connecting the upper portion 211A of the supporting shaft 21A with the lower portion 212A thereof for selectively adjusting a shadowing angle of the awning frame 10A. In other words, the upper portion 211A of the supporting shaft 21A is adapted to pivotally bend with respect to the lower portion 212A thereof via the pivot joint 23A to change the shadowing area 100A of the awning 12A.

The awning frame 10A further comprises a folding unit 15A for folding the awning 12A, wherein the folding unit 15A comprises an elongated element 151A having a control portion extended from the central hub 13A to the upper hub 111A and a hidden portion extended within an interior of the supporting shaft 21A, and a hand crank 152A mounted at the supporting shaft 21A to connect the hidden portion of the elongated element 151A and arrange to control a length of the control portion of the elongated element 151A to drive the central hub 13A sliding along the supporting shaft 21A.

As shown in FIG. 14, the elongated element 151A is a durable cable extended from the central hub 13A to the hand crank 152A through the upper hub 111A such that when the hand crank 152A rolls up the elongated element 151A to shorten the length of the control portion of the elongated element 151A, the central hub 13A is slid upwardly along the supporting shaft 21A to stretch out the awning 12A. Likewise, when the hand crank 152A is released to prolong the length of the control portion of the elongated element 151A, the central hub 13A is dropped downwardly along the supporting shaft 21A to fold up the awning 12A.

The power unit 31A according to the third embodiment comprises a power outlet 311A provided on the supporting shaft 21A to electrically extend from the illuminating units 32A, an extension cable 312A electrically extended from the power outlet 311A for electrically plugging into an external power source, and a power switch 313A provided on the supporting shaft 21A to control the illuminating units 32A in an on and off manner. It is worth to mention that the power unit 31A comprises a transformer to convert an AC power from the external power source into a desired DC power for the illuminating units 32A.

Figure 15:
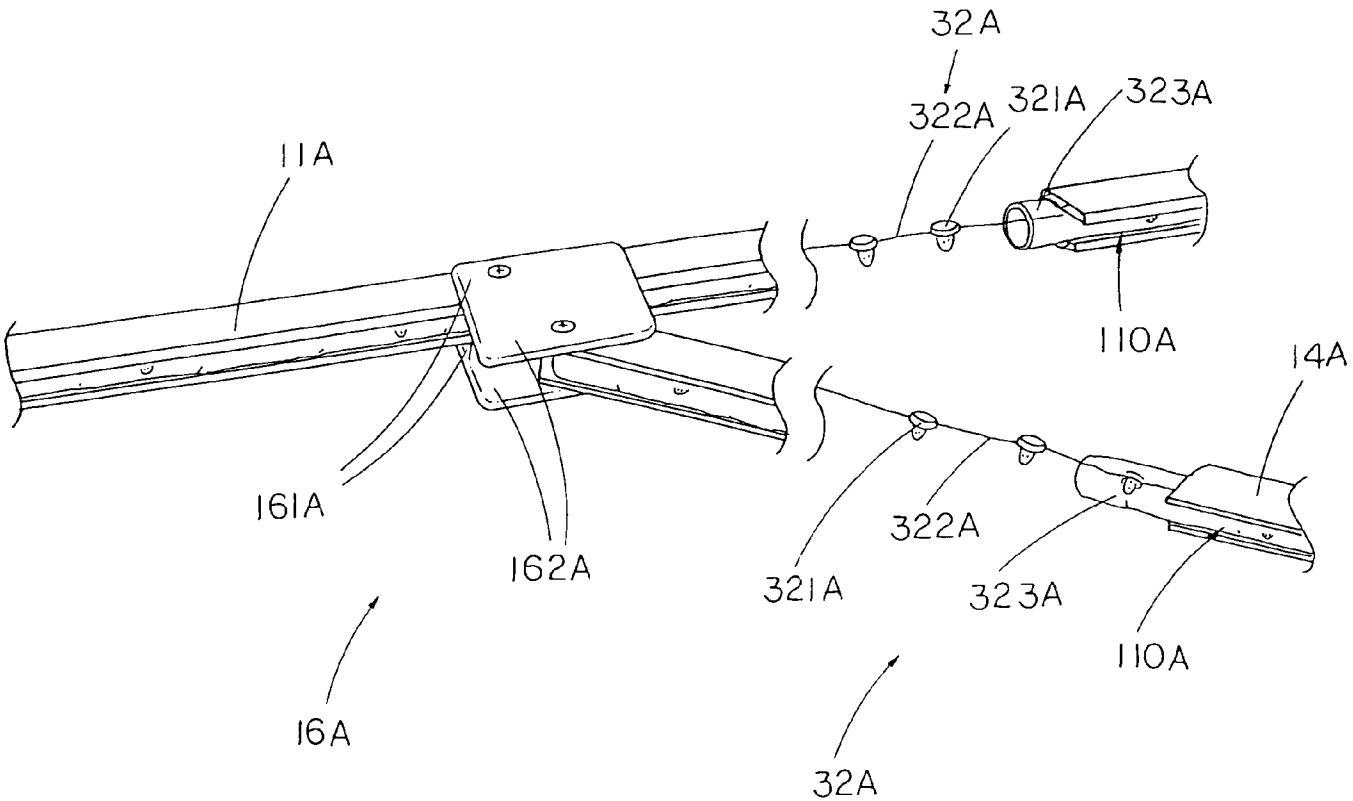
FIG. 15 is a perspective view of the lighting system of the outdoor umbrella according to the above third preferred embodiment of the present invention.

As shown in FIG. 15, the illuminating units 32A are mounted to the awning arms 11A respectively, wherein each of the illuminating units 32A comprises a plurality of illuminators 321A spacedly mounted along the respective awning arm 11A and an extension wire 322A extended along the respective awning arm 11A to electrically connect the illuminators 321A with the power unit 31A.

As shown in FIG. 15, each of the illuminators 321A is embodied as a LED electrically connected to the power unit 31A via the extension wire 322A to provide a predetermined set of illumination parameters, such as brightness, color etc. so as to provide optimal illumination for a range of designated applications while being energy effective.

Each of the illuminating units 32A further comprises a tubular light housing 323A receiving the illuminators 321A and the extension wire 322A therein such that the illuminators 321A generate light to penetrate through the light housing 323A for illuminating the shadowing area 100A of the awning 12A. Accordingly, the light housing 323A is made of transparent and insulating material, such as plastic, to protect the illuminators 321A and the extension wire 322A therein. In other words, the illuminating units 32A are preferably embodied as a plurality of rope lights extending along the awning arms 11A respectively.

Each of the awning arms 11A having a U-shaped cross structure has a bottom opening slot 110A that the respective illuminating unit 32A is received along the bottom opening slot 110A to securely retain the illuminating unit 32A in position, as shown in FIG. 15. In other words, the illuminating unit 32A is embedded into the respective awning arm 11A while the extension wire 322A is hidden within the awning frame 10A to electrically extend to the power unit 31A.

In order to allow the illuminating unit 32A to extend along the respective awning arm 11A at a pivot connection between the awning arm 11A and the folding rib 14A, the awning arm 11A is pivotally connected to the folding rib 14A via a pivot joint 16A having a H-shaped cross section and defining two upper wings 161A pivotally connecting to the awning arm 11A and two lower wings 162A pivotally connecting to the folding rib 14A such that the illuminating unit 32A is received in the bottom opening slot 110A to extend between the two upper wings 161A of the pivot joint 16A, as shown in FIG. 15, so as to ensure the pivot movement of each of the awning arms 11A without interfering with the illuminating unit 32A.

It is worth to mention that the bottom opening slot 110A is formed along each of the folding ribs 14A to receive the respective illuminating unit 32A wherein the illuminating unit 32A is received in the bottom opening slot 110A of the folding rib 14A to extend between the two lower wings 162A of the pivot joint 16A. In other words, each of the folding ribs 14A having a U-shaped cross structure forms the bottom opening slot 110A to receive the respective illuminating unit 32A. Therefore, the illuminating units 32 can be either mounted along the awning arms 11A or the folding ribs 14A by forming the bottom opening slot 110A.

It is obvious that the illuminating units 32A can be mounted along both the awning arms 11A and the folding ribs 14A, as shown in FIGS. 14 and 15, wherein the bottom opening slots 110A are formed on the awning arms 11A and the folding ribs 14A to receive the illuminating units 32A respectively.

Figure 16:
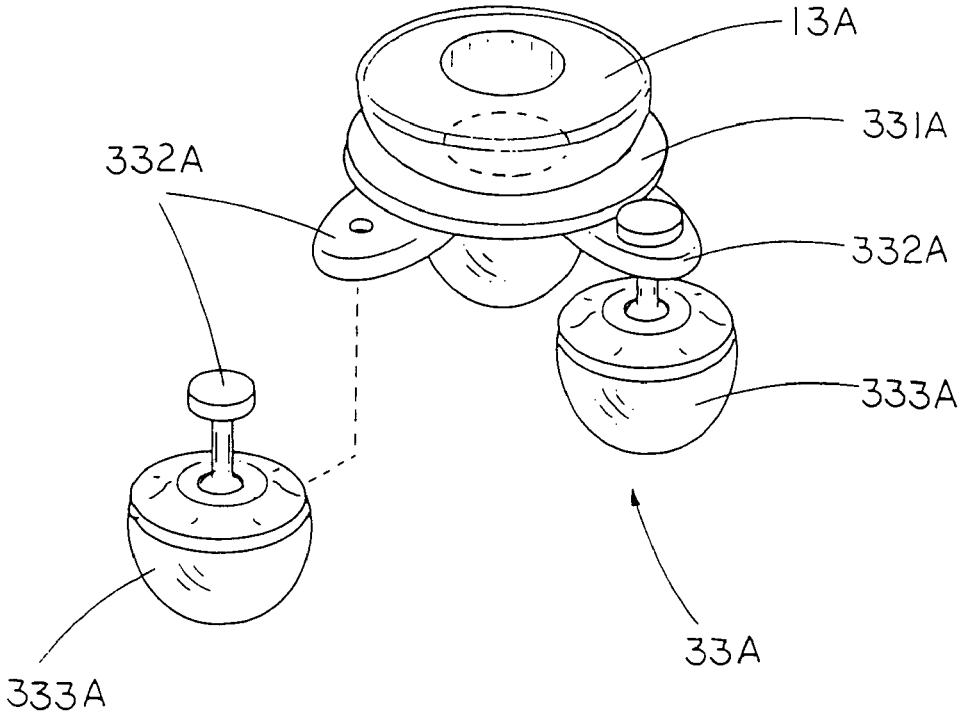
FIG. 16 is a perspective view of the central illuminator of the outdoor umbrella according to the above third preferred embodiment of the present invention.

As shown in FIG. 16, the lighting system 30A further comprises a central illuminator 33A suspendedly supported by the central hub 13A to electrically connect with the power unit 31A for providing extra illumination of the shadowing area 100A. Accordingly, the central illuminator 33A comprises a mounting hub 331A, having a plurality of radial extending arms 332A, securely mounted to the central hub 13A and a plurality of illuminating elements 333A pivotally mounted to the radial extending arms 332A respectively such that each of the illuminating elements 333A is adapted to pivotally fold to selectively adjust an illumination orientation for illuminating the shadowing area 100A.

The mounting hub 331A, having a ring shape, is coaxially attached to the central hub 13A to slide along the supporting shaft 21A corresponding to the sliding movement of the central hub 13A, wherein the radial extending arms 332A are outwardly and radially extended from the mounting hub 331A to pivotally connect the illuminating elements 333A respectively.

Each of the illuminating elements 333A is preferably embodied as a high-intensity light bulb for generating high-intensity light to provide extra illumination of the shadowing area 100A. Accordingly, in order to enhance the adjustment of the illumination orientation of each of the illuminating elements 333A, each of the illuminating elements 333A is connected to the respective radial extending arm 332A via a ball joint that maximize the adjustment of the illumination orientation of the illuminating element 333A. It is worth to mention that the illuminating element 333A can be a regular light bulb or a set of LEDs for providing extra illumination of the shadowing area 100A.

As shown in FIG. 14, the lighting system 30A further comprises a detachable illuminator 34A detachably mounting to the awning frame 10A, wherein the detachable illuminator 34A comprises a detachable clip 341A detachably mounting to one of the awning arms 11A and the folding ribs 14A and a supplement illuminator 342A downwardly extended from the detachable clip 341A to electrically connect to the power unit 31A such that the detachable illuminator 34A is adapted to be selectively mounted to the awning frame 10A to provide an illumination for the shadowing area 100A.

Figure 17:
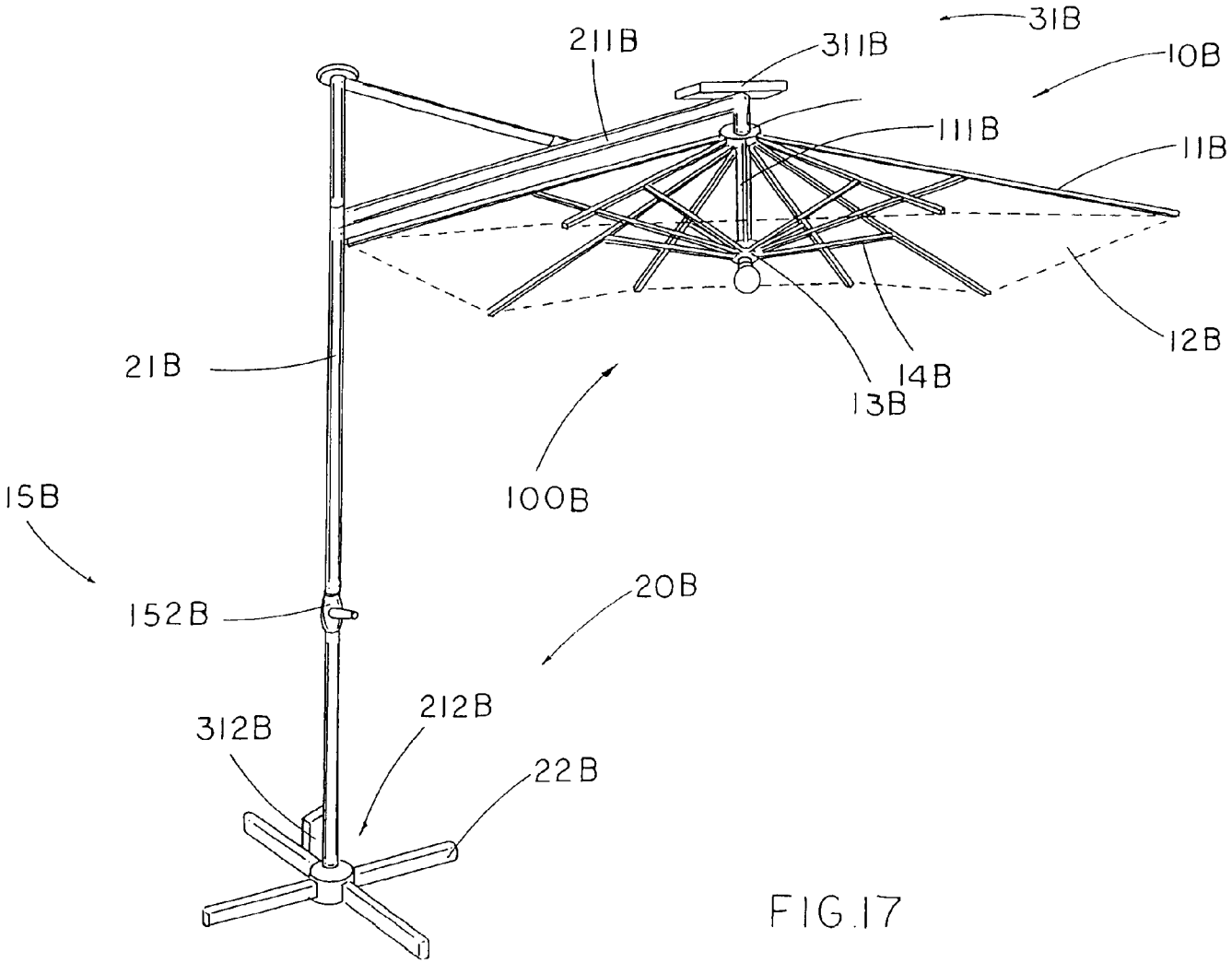
FIG. 17 is a perspective view of an outdoor umbrella according to a fourth preferred embodiment of the present invention.

As shown in FIG. 17, an outdoor umbrella of a fourth embodiment illustrates an alternative mode of the third embodiment of the present invention, wherein the outdoor umbrella comprises an awning frame 10B, a supporting frame 20B and a lighting system 30B. Accordingly, the outdoor umbrella of the fourth embodiment illustrates another type of outdoor umbrella of the third embodiment wherein the outdoor umbrella of the fourth embodiment illustrates the supporting frame 20B is not positioned within the awning frame 10B.

Having the same structural design of the outdoor umbrella of the third embodiment, the awning frame 10B comprises a plurality of elongated awning arms 11B radially extended in a pivotally movable manner and a fabric awning 12B substantially supported by the awning arms 11B to define a shadowing area 100B thereunder. The supporting frame 20B comprises a supporting shaft 21B having an upper portion 211B connected to the awning frame 10B. The lighting system 30B comprises a power unit 31B and a plurality of illuminating units 32B mounted to the awning frame 10B and electrically connected to the power unit 31B along the awning frame 10B for illuminating the shadowing area 100B under the awning 12B.

Figure 18:
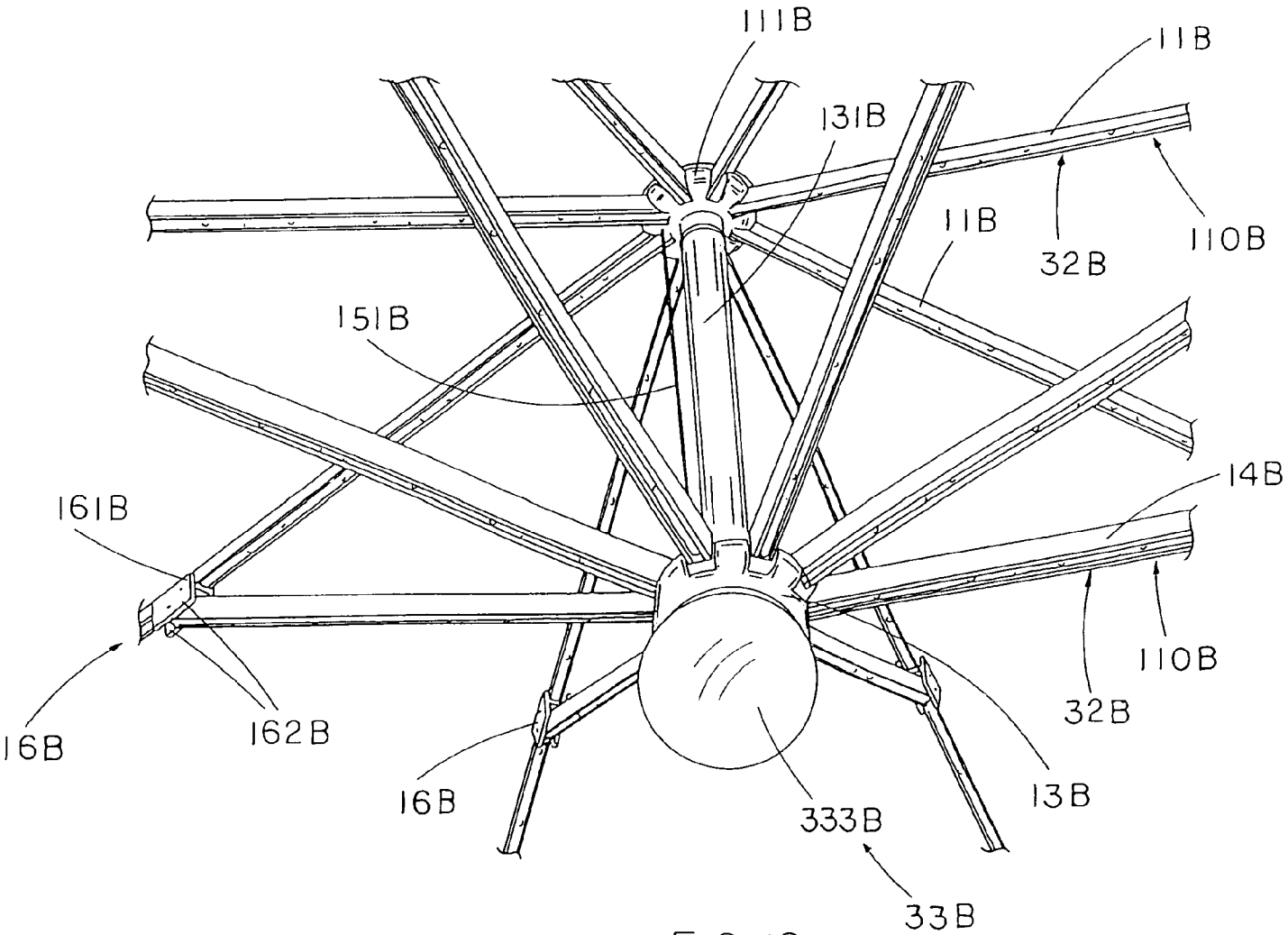
FIG. 18 is a partially perspective view of the outdoor umbrella according to the above fourth preferred embodiment of the present invention.

As shown in FIG. 18, each of the awning arms 11B has an inner end and an outer end, wherein the inner ends of the awning arms 11B are pivotally connected with each other via an upper hub 111B such that the outer ends of the awning arms 11B are radially and outwardly extended from the upper hub 11B.

The awning frame 10B further comprises a central hub 13B and a plurality of folding ribs 14B pivotally and radially extended from the central hub 13B to pivotally connect with the awning arms 11B respectively such that when the central hub 13B is driven downwardly, the awning arms 11B are pivotally folded to fold up the awning 12B, and when the central hub 13B is driven upwardly, the awning arms 11B are pivotally folded to tensionally stretch out the awning 12B for providing the shadowing area 100B thereunder. Accordingly, the central hub 13B is coaxially positioned below the upper hub 11B such that when the central hub 13B is driven upwardly towards the upper hub 111B, the awning arms 11B are folded pivotally and outwardly to stretch the awning 12B in a tension manner. When the central hub 13B is driven downwardly away from the upper hub 111B, the awning arms 11B are folded pivotally and inwardly to fold up the awning 12B. Accordingly, a guiding shaft 131B is downwardly extended from the upper hub 111B to slidably couple with the central hub 13B such that the central hub 13B is slid along the guiding shaft 131B to fold and unfold the awning 12B.

The supporting frame 20B further comprises a ground stand 22B to support the awning frame 10B in stable manner, wherein a lower portion 212B of the supporting shaft 21B is upwardly extended from the ground stand 22B to connect with the awning frame 10B.

Accordingly, the upper portion 211B of the supporting shaft 21B is connected to the upper hub 11B at a position above the awning 12B, wherein the upper portion 211B of the supporting shaft 21B is pivotally connected to the lower portion 212B thereof for selectively adjusting a shadowing angle of the awning frame 10B. In other words, the upper portion 211B of the supporting shaft 21B is adapted to pivotally bend with respect to the lower portion 212B thereof to change the shadowing area 100B of the awning 12B.

The awning frame 10B further comprises a folding unit 15B for folding the awning 12B, wherein the folding unit 15B comprises an elongated element 151B having a control portion extended from the central hub 13B to the upper hub 111B within an interior of the guiding shaft 131B and a hidden portion extended within an interior of the supporting shaft 21B, and a hand crank 152B mounted at the supporting shaft 21B to connect the hidden portion of the elongated element 151B and arrange to control a length of the control portion of the elongated element 151B to drive the central hub 13B sliding along the guiding shaft 131B.

The power unit 31B, according to the fourth embodiment, a solar energy collector 311B pivotally mounted on top of the awning frame 10B for collecting solar energy and transforming said solar energy into an electrical energy to the lighting system 30B. Accordingly, the solar energy collector 311B is pivotally mounted on the upper portion 211B of the supporting shaft 21B at a position above the awning 12B wherein the solar energy collector 311B is adapted to be selectively adjusted its orientation for facing towards the sunlight so as to maximize the solar energy to be collected by the solar energy collector 311B. The power unit 31B further comprises a rechargeable battery 312B which is supported by the supporting frame 20B and is electrically connected to the solar energy collector 311B for storing the electrical energy as a power source for the lighting system 30B. Therefore, no external power source is needed to hook up with the outdoor umbrella so as to minimize the extension cable to electrically connect to the external power source. It is worth to mention that the solar energy collector 311B can be incorporated with the outdoor umbrella of the third embodiment as a power source without alternating the original structure of the illuminating units 32A thereof.

As shown in FIG. 18, the illuminating units 32B are mounted to the awning arms 11B and/or the folding ribs 14B respectively, as mentioned above the third embodiment, wherein the illumination unit 32B has the same structure of the illumination unit 32A of the third embodiment which comprises the illuminators 321A, extension wire 322A and light housing 323A. It is worth to mention that the illuminating units 32B can be either mounted along the awning arms 11B or the folding ribs 14B by forming the bottom opening slot 110B. Alternatively, the illuminating units 32B can be mounted along both the awning arms 11B and the folding ribs 14B, as shown in FIGS. 17 and 18, wherein the bottom opening slots 110B are formed on the awning arms 11B and the folding ribs 14B to receive the illuminating units 32B respectively.

In addition, a pivot joint 16B has a H-shaped cross section and defines two upper wings 161B pivotally connecting to the awning arm 11B and two lower wings 162B pivotally connecting to the folding rib 14B such that the illuminating unit 32B is received in the bottom opening slot 110B to extend between the two upper wings 161B of the pivot joint 16B. When the illuminating unit 32B is mounted along the folding rib 14B, the illuminating unit 32B is received in the bottom opening slot 110B of the folding rib 14B to extend between the two lower wings 162B of the pivot joint 16B.

As shown in FIG. 18, the lighting system 30B further comprises a central illuminator 33B suspendedly supported by the central hub 13B to electrically connect with the power unit 31B for providing extra illumination of the shadowing area 100B. Accordingly, the central illuminator 33B comprises a mounting hub 331B securely mounted to the central hub 13B and at least an illuminating element 333B mounted to the mounting hub 331B such that the illuminating element 333B is adapted to pivotally fold to selectively adjust an illumination orientation for illuminating the shadowing area 100B. Since the supporting shaft 21B is positioned out of the awning frame 10B, the mounting hub 331B is directly attached below the central hub 13B. Accordingly, the illuminating element 333B is a light bulb to provide extra illumination of the shadowing area 10B.

Figure 19:
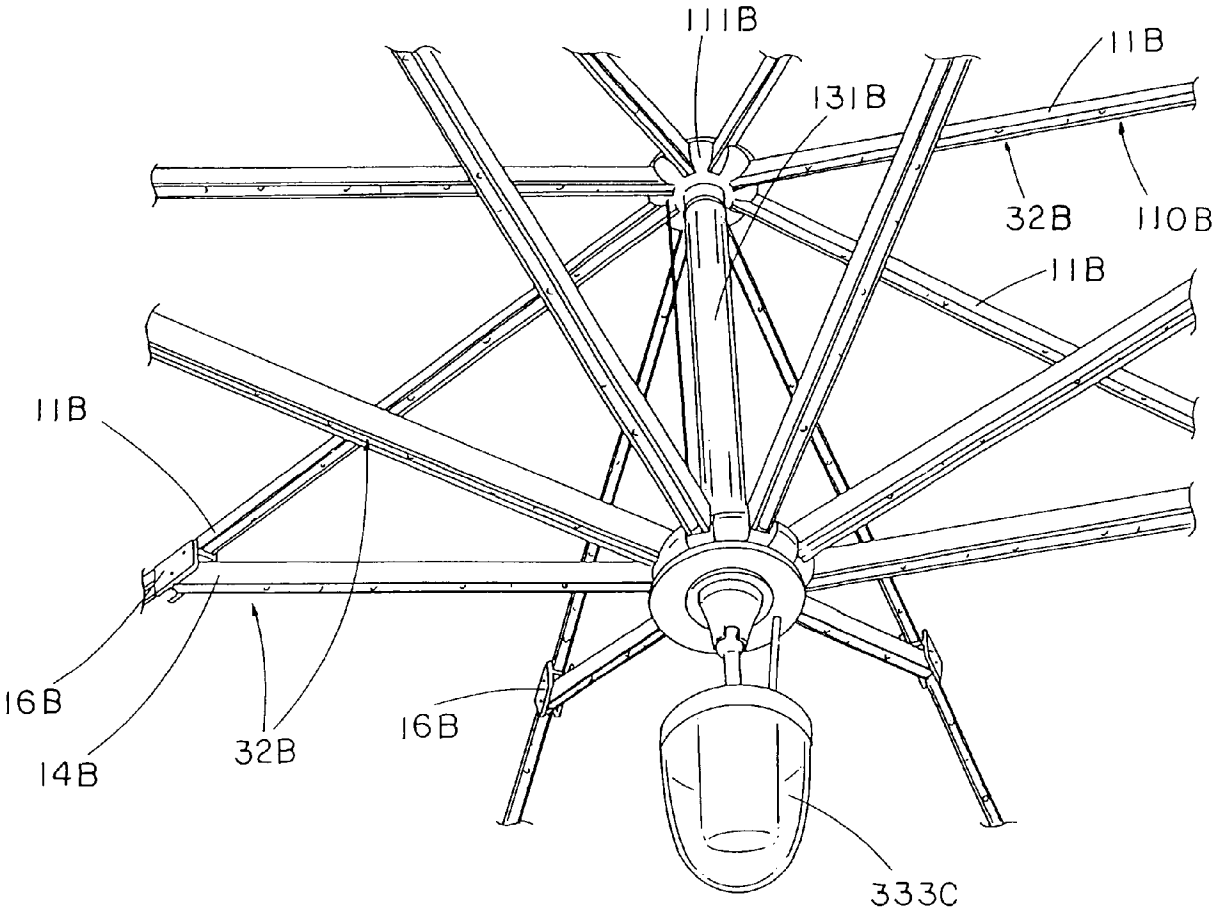
FIG. 19 illustrates an alternative mode of the central illuminator of the outdoor umbrella according to the above fourth preferred embodiment of the present invention.

FIG. 19 illustrates an alternative mode of the illuminating element 333C which is embodied as a high-intensity light bulb powered by solar energy for generating high-intensity light to provide extra illumination of the shadowing area 100B. Accordingly, in order to enhance the adjustment of the illumination orientation of the illuminating element 333C, the illuminating element 333C is connected to the mounting hub 331C via a ball joint that maximize the adjustment of the illumination orientation of the illuminating element 333C.

It is worth to mention that the detachable illuminator 34A of the third embodiment also can be detachably mounted to the awning frame 10B, such that the detachable illuminator 34A is adapted to be selectively mounted to the awning frame 10B to provide an illumination for the shadowing area 100B.

Figure 20:
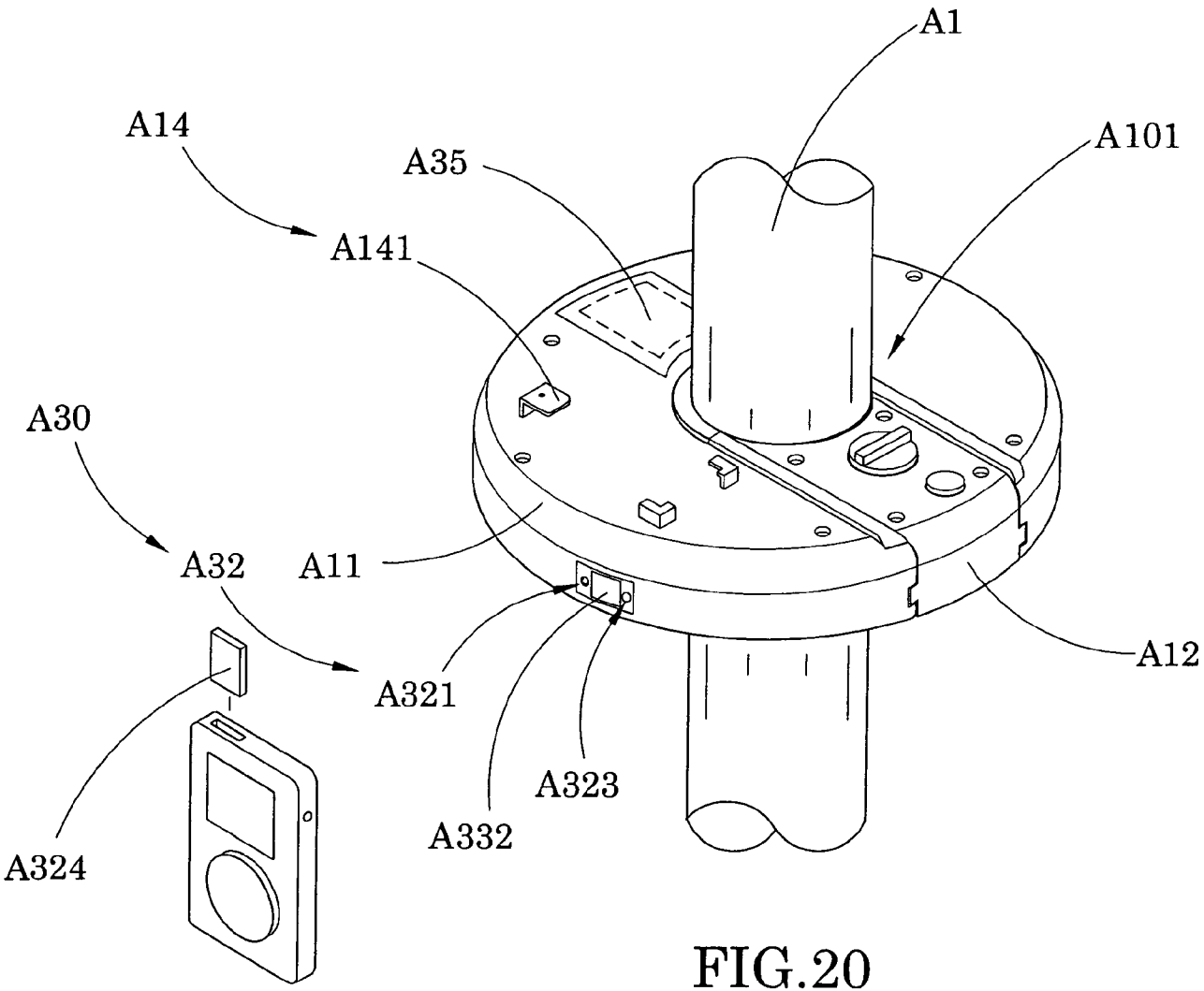
FIG. 20 is a top perspective view of an audio system for an outdoor umbrella according to a fifth preferred embodiment of the present invention.
Figure 21:
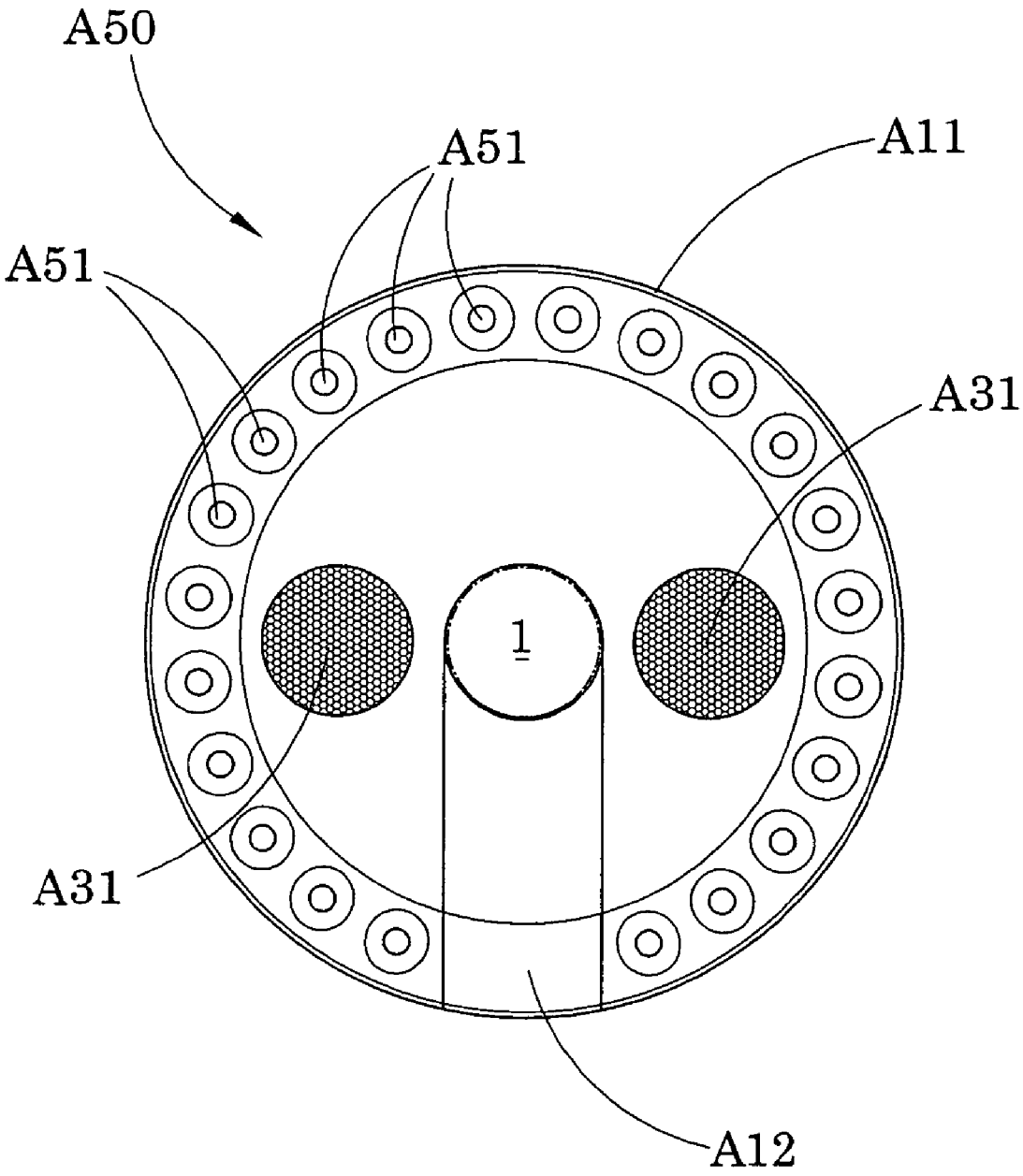
FIG. 21 is a bottom view of the audio system according to the above fifth preferred embodiment of the present invention.
Figure 22:
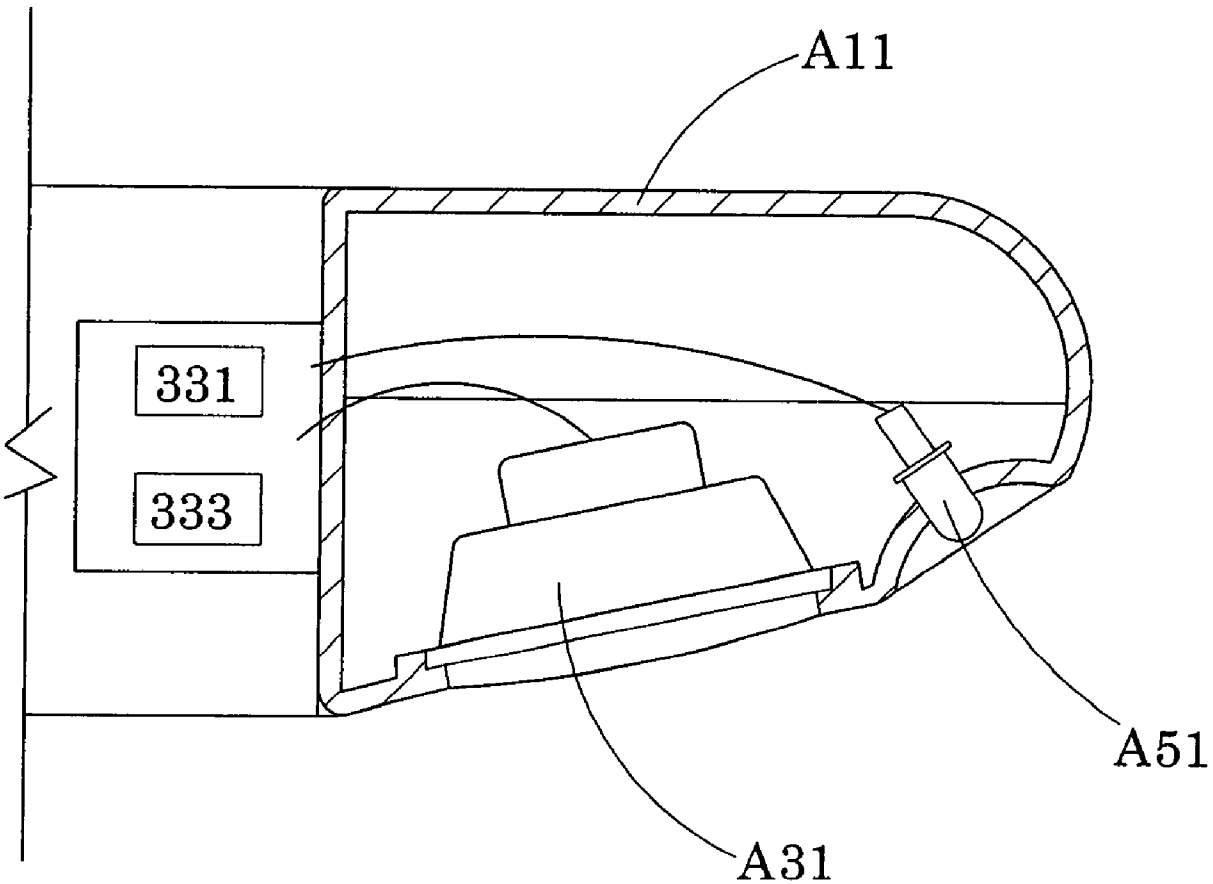
FIG. 22 is a partially sectional view of the audio system according to the above fifth preferred embodiment of the present invention.
Figure 32:
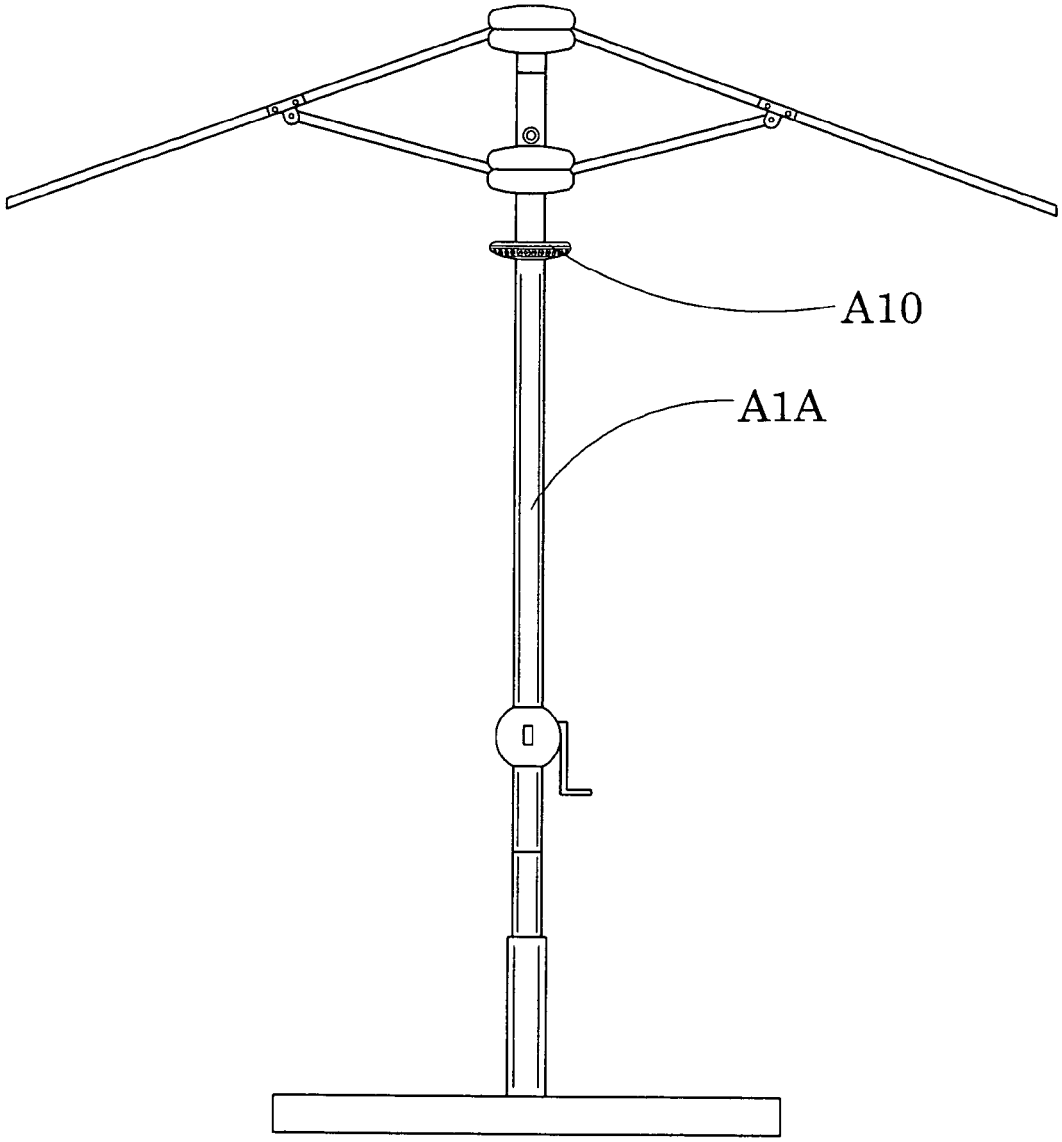
FIG. 32 illustrates the audio system of the present invention being mounted to the supporting shaft of the outdoor umbrella.
Figure 33:
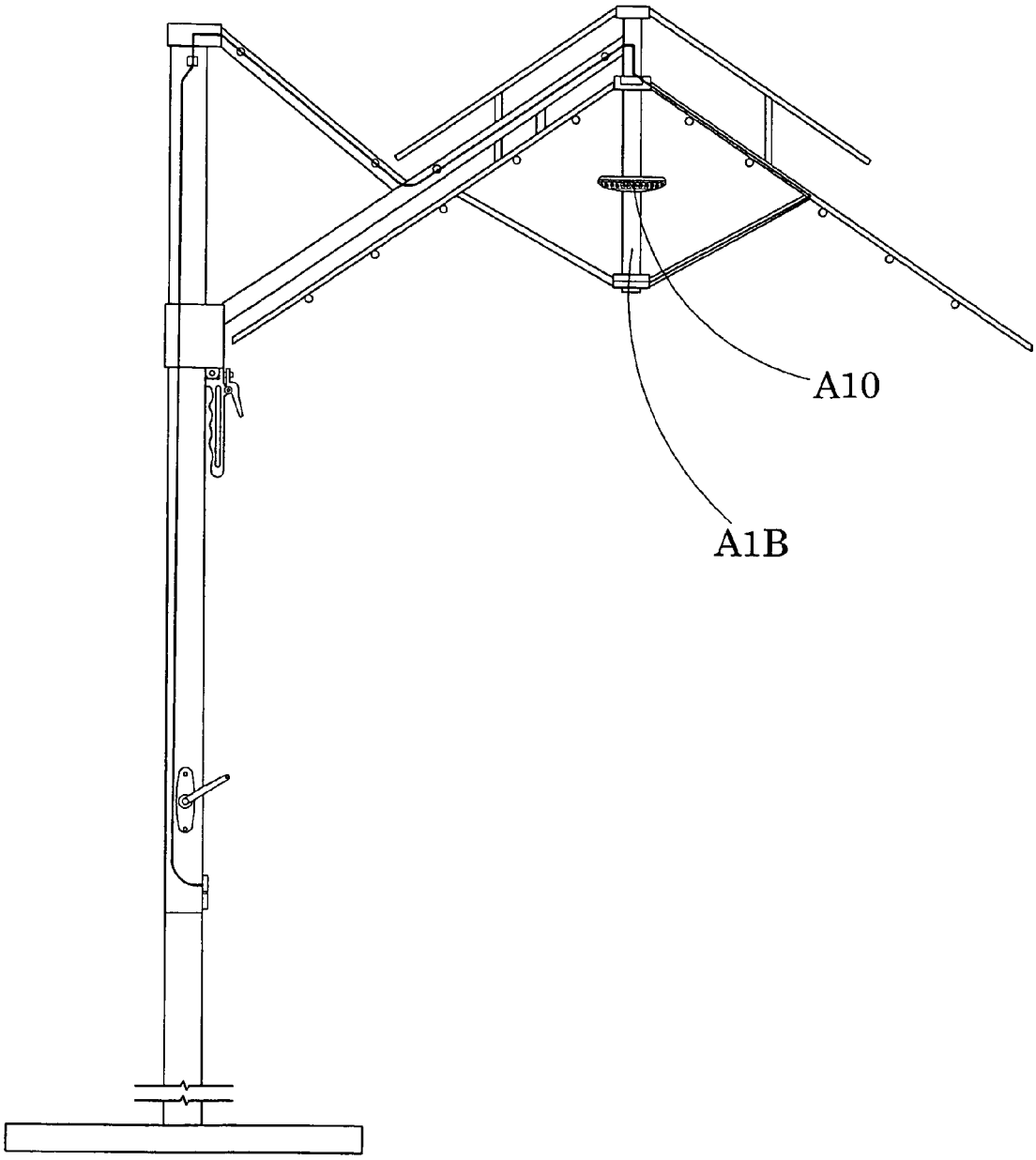
FIG. 33 illustrates the audio system of the present invention being mounted to the upper portion of the awning shaft of the outdoor umbrella.
Figure 34:
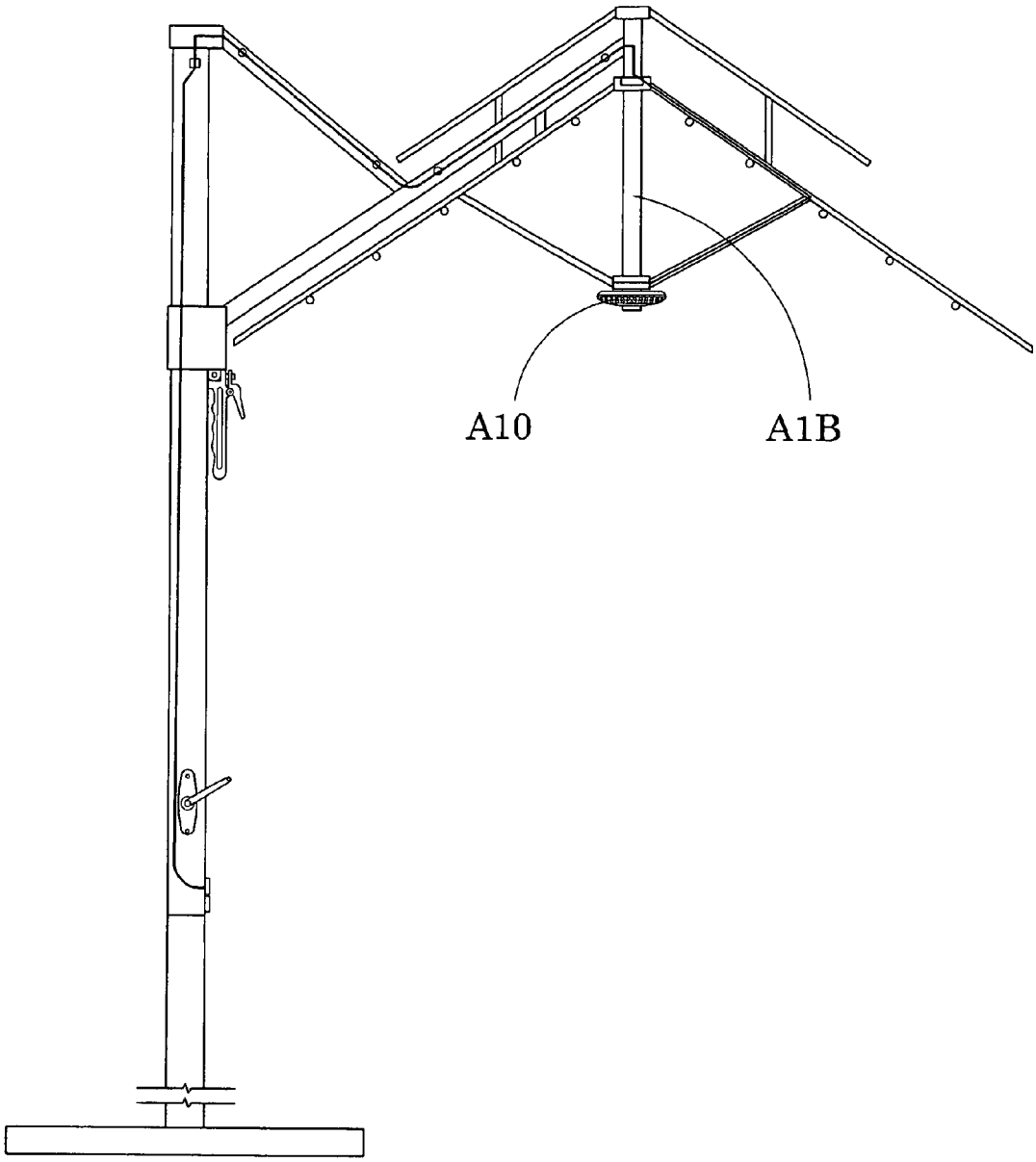
FIG. 34 illustrates the audio system of the present invention being mounted to the lower portion of the supporting shaft of the outdoor umbrella.

Referring to FIGS. 20 and 21 of the drawings, an outdoor umbrella with an audio system is illustrated, wherein the audio system is adapted to detachably mount to the shaft A1 of the outdoor umbrella. As shown in FIG. 32 the audio system of the present invention is detachably mounted to the supporting shaft A1A of the outdoor umbrella. As shown in FIGS. 33 and 34, the audio system of the present invention is detachably mounted to the upper and lower portions of the awning shaft A1B of the outdoor umbrella.

According to the preferred embodiment, the audio system comprises an audio housing A11, a detachable locker A20 and an audio device A30.

The audio housing A10 comprises a first housing body A11 and a second housing body A12 defining a mounting slot A101 when the first and second housing bodies A11, A12 are coupled with each other, wherein the mounting slot A101 has a size for the shaft A1 of the outdoor umbrella fitting therewithin.

The detachable locker A20 comprises a first locker A21 provided at the first housing body A11 and a second locker A22 which is provided at the second housing body A12 and is releasably locked with the first locker A21 so as to detachably lock up the second housing body A11 with the first housing body A12.

The audio device A30 comprises one of more speakers A31 supported in the audio housing A10 and an audio input A32 operatively coupling with the speaker A31 such that when the audio input A32 sends an audio signal to the speaker A31, the speaker A31 is adapted for producing audio sound as an additional function for the outdoor umbrella.

According to the fifth embodiment, the first housing body A11, having a U-shaped structure, has two inner guiding walls A111 defining a guiding channel A112 therebetween. The second housing body A12, having a corresponding elongated shape, has two outer guiding walls A121 engaging with the inner guiding walls A111 of the first housing body A11. When the first and second housing bodies 11, 12 are mounted with each other, the audio housing A11 is formed to have a donut shape and to define the mounting slot at a center of the audio housing A10.

The guiding channel A112 has a closed end defining the mounting slot A101 thereat and an opened end arranged when the second housing body A12 is slidably mounted to the first housing body A11 along the guiding channel A101 through the opened end thereof, the mounting slot A101 is formed at the closed end of the guiding channel A112. In other words, the mounting slot A101 is formed by the closed end of the guiding channel A112 and the inner side of the second housing body A12.

The audio housing A10 further comprises two first sliders A131 indent along the inner guiding walls A111 of the first housing body A11 respectively and two corresponding second sliders 132 protruded along the outer guiding walls A121 of the second housing body A12 respectively such that when the second sliders A132 are slidably engaged with the first sliders A131 respectively, the second housing A12 is slidably mounted to the first housing A11.

According to the fifth embodiment, there are two speakers A31 spacedly mounted in the first housing body A11 for generating the audio sound in stereo manner. The audio input A32 comprises an auxiliary input A321 provided on the audio housing for communicatively connecting a portable music player to receive the audio signal therefrom, such that the audio signal is transmitted to the speakers A31 for music broadcasting. Preferably, the auxiliary input A321 is provided on the outer surface of the first housing body A11 for the user to connect the portable music player to the speakers A31.

The audio input A32 further a wireless receiver A323 supported in the audio housing A10 to electrically connect with the speakers A31 and a wireless transmitter A324 which is wirelessly linked with the wireless receiver A323 and is adapted for connecting with the portable music player to wirelessly sending the audio signal from the portable music player to the speakers A31 for music broadcasting. Accordingly, the wireless receiver A323 is a FM receiver and the wireless transmitter A324 is a FM transmitter such that the wireless receiver A323 and the wireless transmitter A324 form a wireless link to wirelessly send the audio signal from the portable music player to the speakers A31. Therefore, when the wireless transmitter A324 is tuned automatically or manually to match the radio frequency of the wireless receiver A323, the audio device A30 is wirelessly connected with the portable music player. Accordingly, the audio housing A10 further comprises a device holder A14 provided at the first housing body A11 for detachably holding the portable music player in position, wherein the device holder A14 comprises a plurality of holder arms A141 spacedly extended from a top side of the first housing body A11 to define a holding compartment for securely receiving the portable music player therein.

The audio device A30 further comprises a control panel A33 which is provided at the audio housing A10, comprising a control circuitry A331 operatively connecting to the speakers A31 to selectively operate and control the speaker and a display screen A332 electrically connected to the control circuitry A331 for displaying an operation status thereof. It is worth to mention that the control circuitry A331 is also operatively connected to the wireless receiver A323 to operate and control the wireless receiver A323.

Accordingly, a remote controller can be incorporated to remote control the audio device A30.

The control panel A33 further comprises a radio broadcasting circuit A333 for receiving radio wave as the audio signal, such that the control panel A33 transmits the audio signal to the speakers A31 for radio broadcasting. In other words, the user is able to listen to the music from his or her portable music player or to the radio through the audio system of the present invention.

The audio device A30 further comprises a power supply A35 supported in the audio housing 10 to electrically connect with the speakers A31 and the control panel A33.

Accordingly, the power supply A35 can be a rechargeable battery or a replaceable battery such that the audio device A30 does not require any electrical power from the outdoor umbrella. Alternatively, the power supply A35 can be electrically connected to the power source of the outdoor umbrella, especially the outdoor umbrella incorporating with a solar energy.

The audio system further comprises a lighting device A50 for providing illumination under the audio housing 10. The lighting device A50 comprises a plurality of illuminators A51 spacedly supported in the outer circumferential portion of the first housing body A11 and electrically coupling with the control panel A33. Accordingly, each of the illuminators A51 is a LED having a head portion protruded from the bottom side of the first housing body A11 and a tail portion electrically connecting to the control panel A33.

Figure 23:
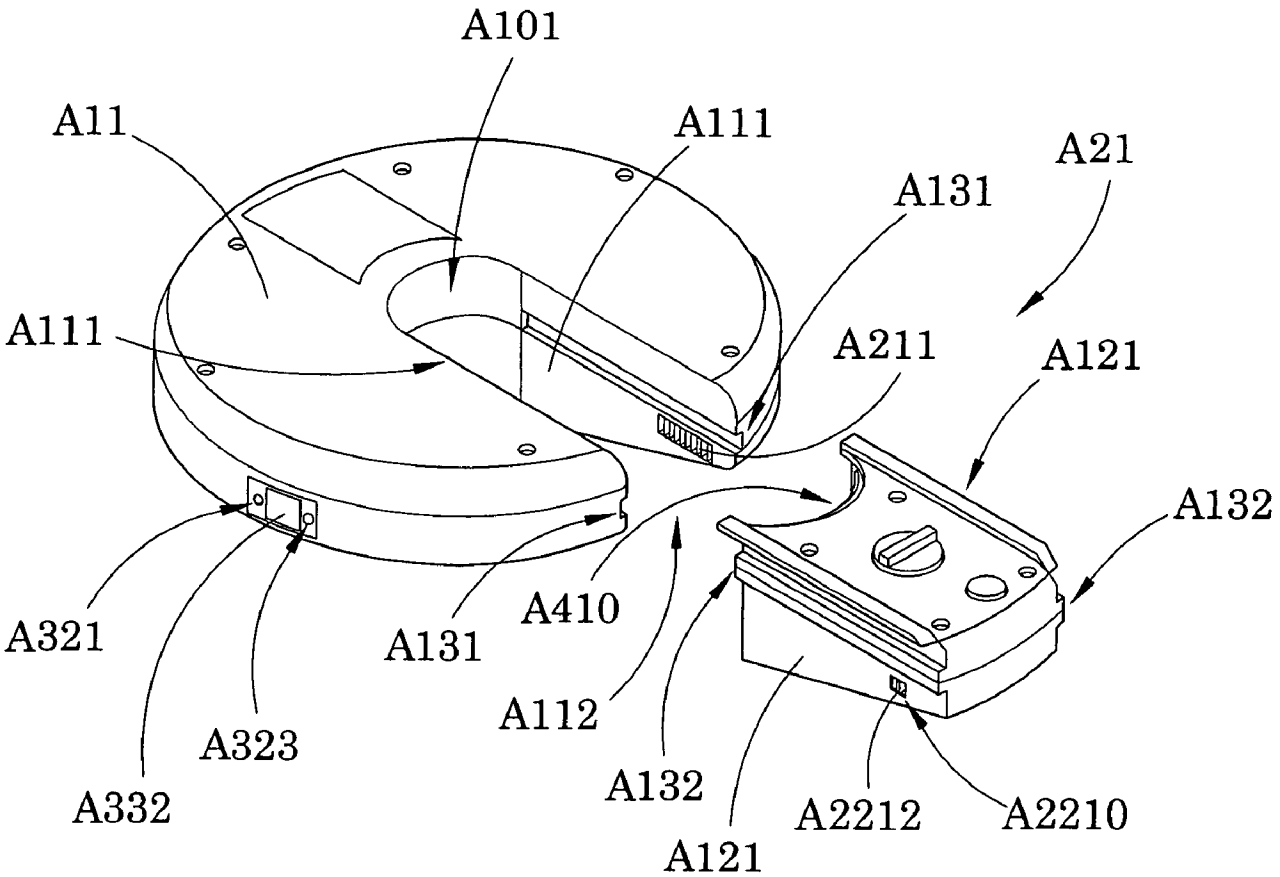
FIG. 23 is an exploded perspective view of the audio housing of the audio system according to the above fifth preferred embodiment of the present invention.
Figure 24:
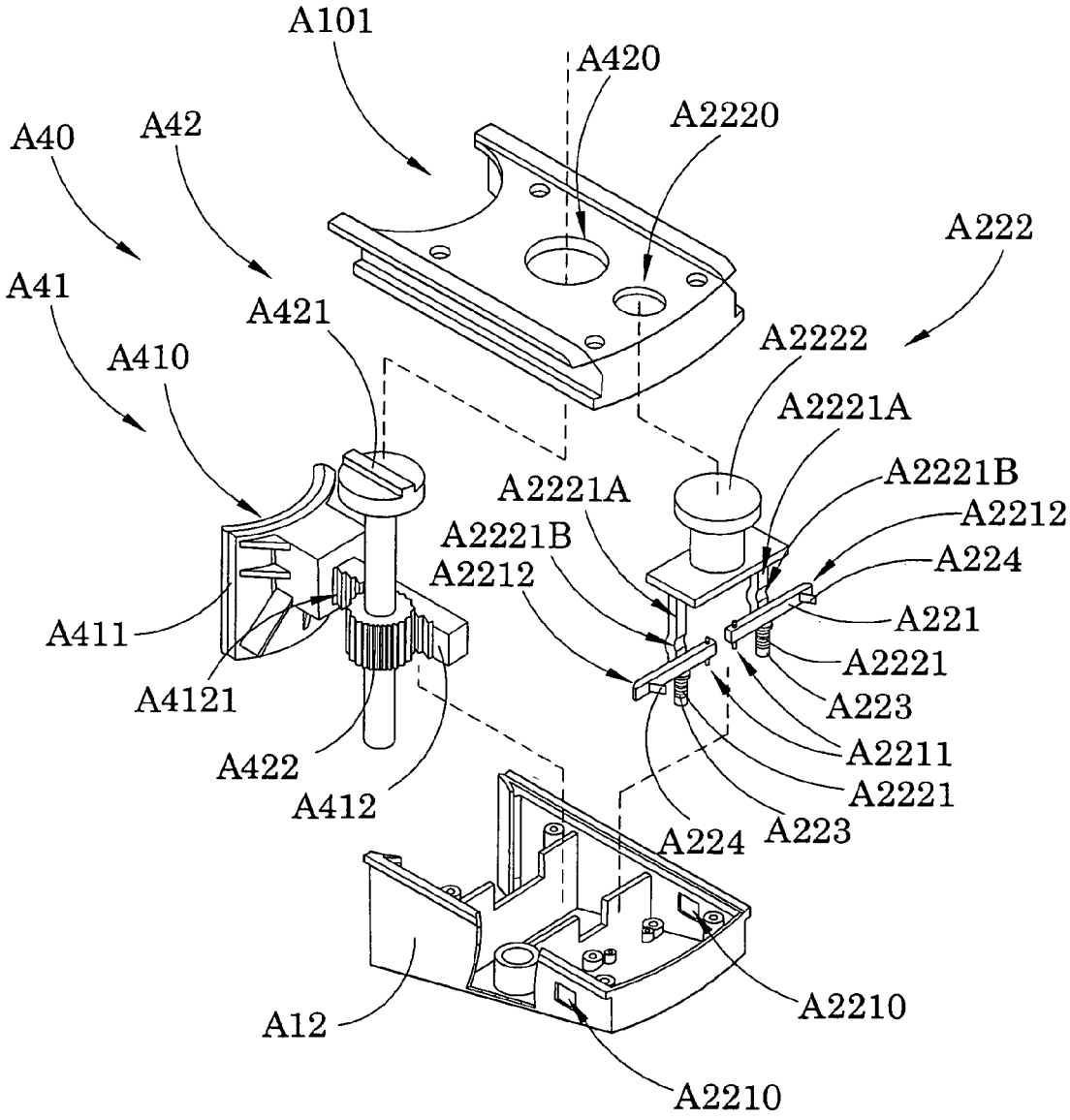
FIG. 24 is an exploded perspective view of the detachable locker and the adjustable retainer of the audio system according to the above fifth preferred embodiment of the present invention.

As shown in FIGS. 23 to 24, the first locker A21 comprises two toothed-locking tracks A211 provided at the inner guiding walls A111 of the first housing body A11 respectively. Accordingly, each of the toothed-locking tracks A211 is formed at the respective inner guiding wall A111 of the first housing body A11 at a position close to the opened end of the guiding channel A112.

The second locker A22 comprises two locking arms A221 outwardly extended from the outer guiding walls A121 of the second housing A12 and a lock actuator A222 actuating the locking arms A221 not only to engage with the toothed-locking tracks A211 respectively for locking up the second housing body A12 with the first housing body A11 but also to disengage with the toothed-locking tracks A211 respectively for releasing the second housing body A12 with the first housing body A11 so as to allow the second housing body A12 being detached from the first housing body A11.

As shown in FIG. 24, each of the locking arms A221 has an inner pivot end A2211 pivotally mounted in the second housing body A12 and an outer locking end A2212 outwardly protruded from the respective outer guiding wall A121 of the second housing body A12 through a locking hole A2210 to selectively engage with the respective toothed-locking track A211. Therefore, when the inner pivot end A2211 of each of the locking arm A221 is moved pivotally, the outer locking end A2212 of the locking arm A221 is driven to pivotally move to engage or disengage with the tooth-locking track A211.

The lock actuator A222 comprises two actuating legs A2221 movably mounted in the second housing body A12 to engage with the locking arms A221 respectively and a control pusher A2222 which is extended from the actuating legs A2221 to an exterior of the second housing body A12 and is arranged in such a manner that when the control pusher A2222 is depressed, the actuating legs A2221 are pushed to pivotally move the locking arms A221 at a position that the locking ends A2212 of the locking arms A221 are moved into an interior of the second housing body A12 through the locking holes A2210 so as to disengage the locking ends A2212 of the locking arms A221 with the toothed-locking tracks A211 respectively.

Accordingly, a bottom portion of the lock actuator A222 has a U-shaped structure defining the two actuating legs A2221 extending downwardly to couple with the locking arms A221. The upper portion of the locking actuator A222 has an elongated structure defining the control pusher A2222 extending upwardly to protrude out of the second housing body A12 through a through pushing hole A2220, wherein when the control pusher A2222 is depressed, the two actuating legs A2221 are driven downwardly to pivotally move the two locking arms A221 respectively.

In order to pivotally move the locking arms A221 to engage/disengage with the toothed-locking tracks A211 respectively, each of the actuating legs A2221 has a straight biasing portion A2221A and a curved releasing portion A2221B that the locking arms A221 are normally engaged with the curved releasing portions A2221B of the actuating legs A2221 to retain the locking ends A2212 of the locking arms A221 engaging with the toothed-locking tracks A211 respectively. When the control pusher A2222 is depressed to move the actuating legs A2221, the locking arms A221 are engaged with the straight biasing portions A2221A of the actuating legs A2221 to pivotally move the locking ends A2212 of the locking arms A221 into the interior of the second housing body A12 through the locking holes A2210 so as to disengage the locking ends A2212 of the locking arms A221 with the toothed-locking tracks A211 respectively.

Accordingly, the straight biasing portion A2221A of the actuating leg A2221 is integrally extended from the curved releasing portion A2221B thereof such that when the actuating legs A2221 are driven to moved downwardly by the depression of the control pusher A2222, the locking arms A221 are moved from the curved releasing portion A2221B of the actuating legs A2221 to the straight biasing portion 2221A thereof so as to pivotally move the locking ends A2212 of the locking arms A221 to disengage with the toothed-locking tracks A211 respectively.

As shown in FIG. 24, the second locker A22 further comprises two first resilient elements A223 mounted at two free ends of the actuating legs A2221 for applying an urging force against the control pusher A222 to retain the control pusher A222 in a normal position and two second resilient elements A224 provided at the two locking arms A221 for applying a pushing force against the locking arms A221 with respect to sidewalls of the locking holes A2210 so as to retain the locking ends A2212 of the locking arms A221 to engage with the toothed-locking tracks A211 respectively.

The first resilient elements A223 are two compression springs mounted at the free ends of the actuating legs A2221 and held at the bottom wall of the second housing body A12, wherein the first resilient elements A223 normally apply the urging force against the lock actuator A222 to retain the locking arms A221 being normally engaged with the curved releasing portions A2221B of the actuating legs A2221. In other words, after the control pusher A222 is depressed, the first resilient elements A223 apply an upward pushing force to the lock actuator A222 so as to push the locking arms A221 back to engage with the curved releasing portions A2221B of the actuating legs A2221 from the straight biasing portion A2221A thereof.

The second resilient elements A224 are two spring pieces mounted at the two locking arms A221 close to the locking ends A2212 thereof respectively, wherein the second resilient elements A224 normally apply the urging force against the locking arms A221 to push the locking ends thereof to engage with the toothed-locking tracks A211 respectively. Therefore, after the locking arms A221 is returned back to engage with the curved releasing portions A2221B of the actuating legs A2221, the second resilient elements A224 will push the locking arms A221 to pivotally moved back to engage with the toothed-locking tracks A211 respectively.

As shown in FIG. 24, the audio system further comprises an adjustable retainer A40 for adjusting the size of the mounting slot A101 for the shaft A1 of the outdoor umbrella, wherein the adjustable retainer A40 comprises a retention arm A41, having a pusher surface A410 facing towards the mounting slot A101, slidably mounted the second housing body A12 and an adjustable locker A42 controllably driving the retention arm A41 at a position that when the retention arm A41 is driven towards mounting slot A101, the pusher surface A410 is arranged for biasing against an outer surface of the shaft A1 of the outdoor umbrella until the shaft A1 thereof being fitted at the mounting slot A101 so as to substantially mount the audio housing A10 at the outdoor umbrella.

According to the preferred embodiment, the retention arm A41 comprises a pusher head A411 defining the pusher surface A410 thereat and a driving arm A412, having a toothed track A4121, extended from the pusher head A411. The pusher head A411 is extended out of the second housing body A12 at the inner side thereof such that when the pusher head A411 is moved in the second housing body A12, the size of the mounting slot A101 is adjustably enlarged. In other words, when the pusher head A411 is moved out of the second housing body A12, the size of the mounting slot A101 is substantially reduced.

It is worth to mention that when the shaft A1 of the outdoor umbrella has a circular cross section, the pusher surface A410 is formed as a curved surface corresponding to the curvature of the outer surface of the shaft A1 of the outdoor umbrella such that when the pusher surface A410 is engaged with the outer surface of the shaft A1 of the outdoor umbrella, the audio housing A10 can be securely mounted around the shaft A1 of the outdoor umbrella. In other words, when the shaft A1 of the outdoor umbrella has a flat outer surface, the pusher surface A410 is formed to have a flat surface to substantially bias against the flat outer surface of the shaft A1 of the outdoor umbrella.

The adjustable locker A42 has a control portion A421 extended out of the second housing body A12 through a through hole A420 and a gear portion A422 which is extended from the control portion A421 and is engaged with the toothed track A4121 of the driving arm A412 such that when the control portion A421 of the adjustable locker A42 is rotated, the driving arm A412 is slidably moved to selectively drive the pusher head A411 towards the mounting slot A101 for selectively adjusting the size of the mounting slot A101 with respect to the shaft A1 of the outdoor umbrella.

As shown in FIG. 24, the adjustable locker A42 has an elongated circular shape defining an upper portion as the control portion A421 and a mid-portion as the gear portion A422 such that when the control portion A421 of the adjustable locker A42 is rotated, the gear portion A422 is driven to rotate so as to drive the driving arm A412 to move. For example, when the control portion A421 of the adjustable locker A42 is rotated at a clockwise direction, the driving arm A412 is driven to move to push the pusher head A411 towards the mounting slot A101 so as to reduce the size thereof. When the control portion A421 of the adjustable locker A42 is rotated at a counter clockwise direction, the driving arm A412 is driven to move to pull the pusher head A411 away from the mounting slot A101 so as to maximize the size thereof. Therefore, the user is able to adjustably control the size of the mounting slot A101 by turning the control portion A421 of the adjustable locker A42 to mount or detach the audio housing 10 at the shaft A1 of the outdoor umbrella.

Figure 25:
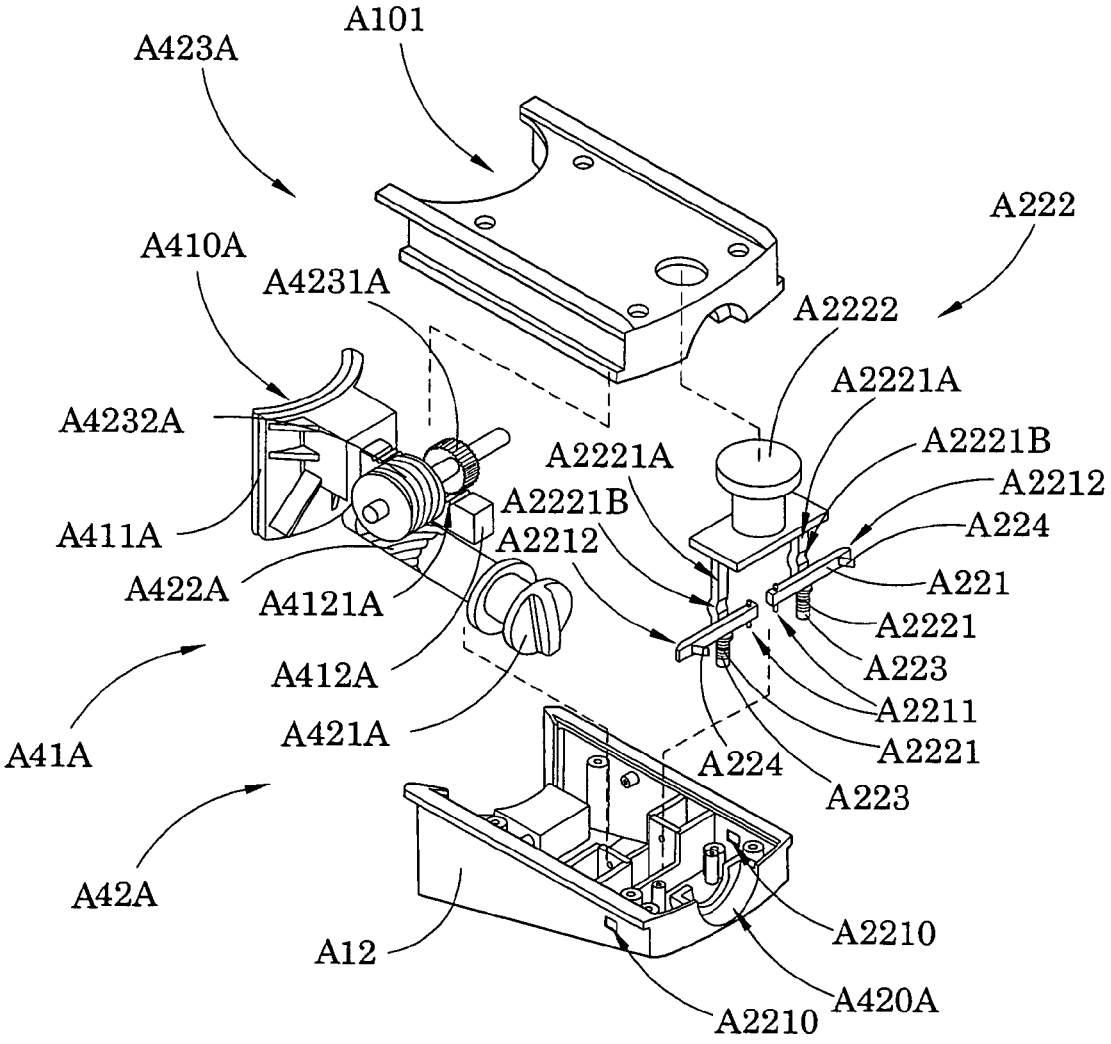
FIG. 25 illustrates an alternative mode of the adjustable retainer according to the above fifth preferred embodiment of the present invention.

FIG. 25 illustrates an alternative mode of the adjustable retainer A42A according to the above first preferred embodiment of the present invention. As shown in FIG. 24, the adjustable locker A42 is transversely positioned with respect to the retention arm 41, wherein the control portion A421 of the adjustable locker A42 is extended through a top panel of the second housing body A12. The alternative mode of the adjustable retainer A42A has the same structure of the adjustable retainer A42 except a transmission gear A423A. As shown in FIG. 25, the adjustable locker A42A is parallelly positioned with respect to the retention arm A41A wherein the control portion A421A of the adjustable locker A42A is extended through a through hole A420A on a side panel of the second housing body A12A. The transmission gear A423A has a first gear portion A4231A engaging with the toothed track A4121A of the retention arm A41A and a second gear portion A4232A engaging with the gear portion A422A of the adjustable locker A42A such that when the control portion A421A of the adjustable locker A42A is rotated, the driving arm A412A is driven to move via the transmission gear A43A to move the position of the pusher surface A410A of the pusher head A411A.

Figure 26:
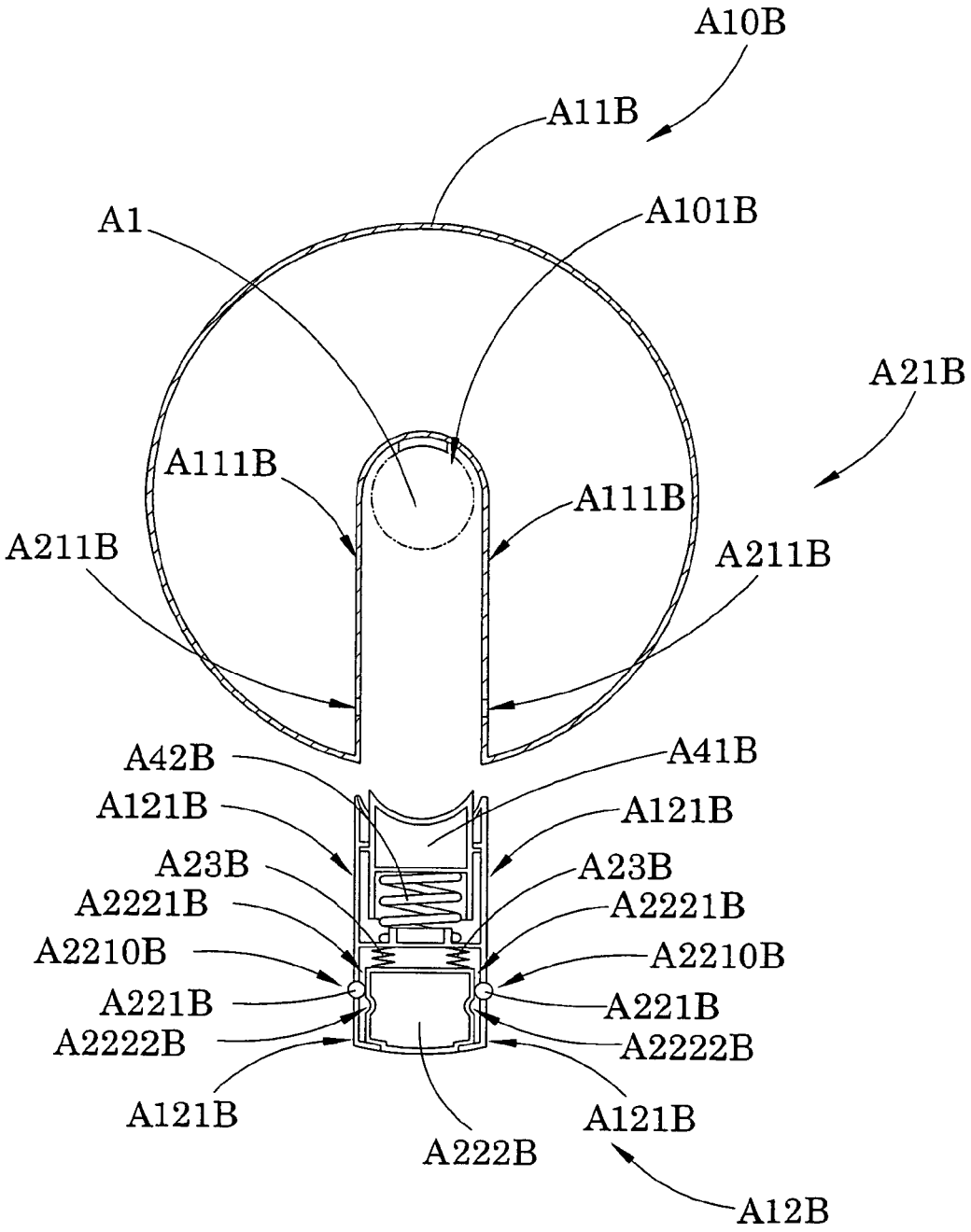
FIG. 26 illustrates another alternative mode of the detachable locker and the adjustable retainer of the audio system according to the above fifth preferred embodiment of the present invention.

FIG. 26 illustrates another alternative of the detachable locker A20B and the adjustable retainer A40B of the audio system. The detachable locker A20B comprises a first locker A21B provided at the first housing body A11B and a second locker A22B which is provided at the second housing body A12B and is releasably locked with the first locker A21B so as to detachably lock up the second housing body A11B with the first housing body A12B.

The first locker A21B contains two locking slots A211B formed at the inner guiding walls A111B of the first housing body A10B respectively at a position close to the opened end of the guiding channel A112B.

The second locker A22B comprises two ball-shaped locking elements A221B movably provided at the outer guiding walls A121B of the second housing body A12B respectively and a lock actuator A222B actuating the locking elements A221B not only to engage with the locking slots A211B respectively for locking up the second housing body A12B with the first housing body A11B but also to disengage with the locking slots A211B respectively for releasing the second housing body A12B with the first housing body A11B so as to allow the second housing body A12B being detached from the first housing body A11B.

The lock actuator A222B has two sidewalls A2221B and two indentions A2222B formed thereon, wherein when the locking elements A221B are biased against the sidewalls A2221B of the lock actuator A222B, locking portions of the locking elements A221B are protruded from the outer guiding walls A121B of the second housing body A12B through two locking holes A2210B to engage with the locking slots A211B respectively so as to lock up the second housing body A12B with the first housing body A11B.

When the lock actuator A222B is pressed until the locking elements A221B are retained at the indentions A2222B of the locking actuator A222B respectively, the locking portions of the locking elements A221B are moved into an interior of the second housing body A12B through the locking holes A2210B so as to disengage the locking elements A221B with the locking slots A211B respectively. In other words, the two locking elements A221B are normally biased against the two sidewalls A2221B of the lock actuator such that the locking portions of the locking elements A221B are protruded from the outer guiding walls A121B of the second housing body A12B through two locking holes A2210B to engage with the locking slots A211B respectively. When the lock actuator A222B is slid to align the two indentions A2222B with the two locking holes A2210B respectively, the locking elements A221B are disposed at the indentions A2222B respectively. Therefore, the locking portions of the locking elements A221B are moved into an interior of the second housing body A12B to disengage with the locking slots A211B respectively. As shown in FIG. 26, the lock actuator A222B further has a control portion A2223B extended through the second housing body A12B for the user to press on the control portion A2223B to unlock the second housing body A12B from the first housing body A11B.

In order to retain the locking elements A221B at the locking position, the second locker A22B further comprises a first resilient element A23B mounted in the second housing body A12B for applying an urging force against the lock actuator A222B so as to normally retain the locking elements A221B being biased against the sidewalls A2221B of the lock actuator A222B. Accordingly, the first resilient element A23B is a compression spring having two ends biasing against an inner wall of the second housing body A12B and the lock actuator A222B respectively. Therefore, after the control portion A2223B of the lock actuator A222B is pressed to dispose the locking elements A221B at the indentions A2222B respectively, the first resilient element A23B applies the urging force to push the lock actuator A222B back to its original position that the locking elements A221B are biased against the sidewalls A2221B of the lock actuator A222B.

As shown in FIG. 26, the audio system further comprises an adjustable retainer A40B for adjusting the size of the mounting slot A101B for the shaft A1 of the outdoor umbrella, wherein the adjustable retainer comprises a retention arm A41B, having a pusher surface A410B facing towards the mounting slot A101B, slidably mounted the second housing body A10B and an adjustable locker A42B controllably driving the retention arm A41B at a position that when the retention arm A41B is driven towards mounting slot A101B, the pusher surface A410B is arranged for biasing against an outer surface of the shaft A1 of the outdoor umbrella until the shaft A1 thereof being fitted at the mounting slot so as to substantially mount the audio housing A10B at the outdoor umbrella.

Accordingly, the adjustable locker A42B comprises a compression spring supported in the second housing body A10B for applying a pushing force against the retention arm A41B so as to normally push the pusher surface A410B towards the mounting slot A101B. It is worth to mention that the size of the mounting slot A101B is automatically fitted for the size of the shaft A1 of the outdoor umbrella by the self-adjustment of the retention arm A41B via the adjustable locker A42B.

Figure 27:
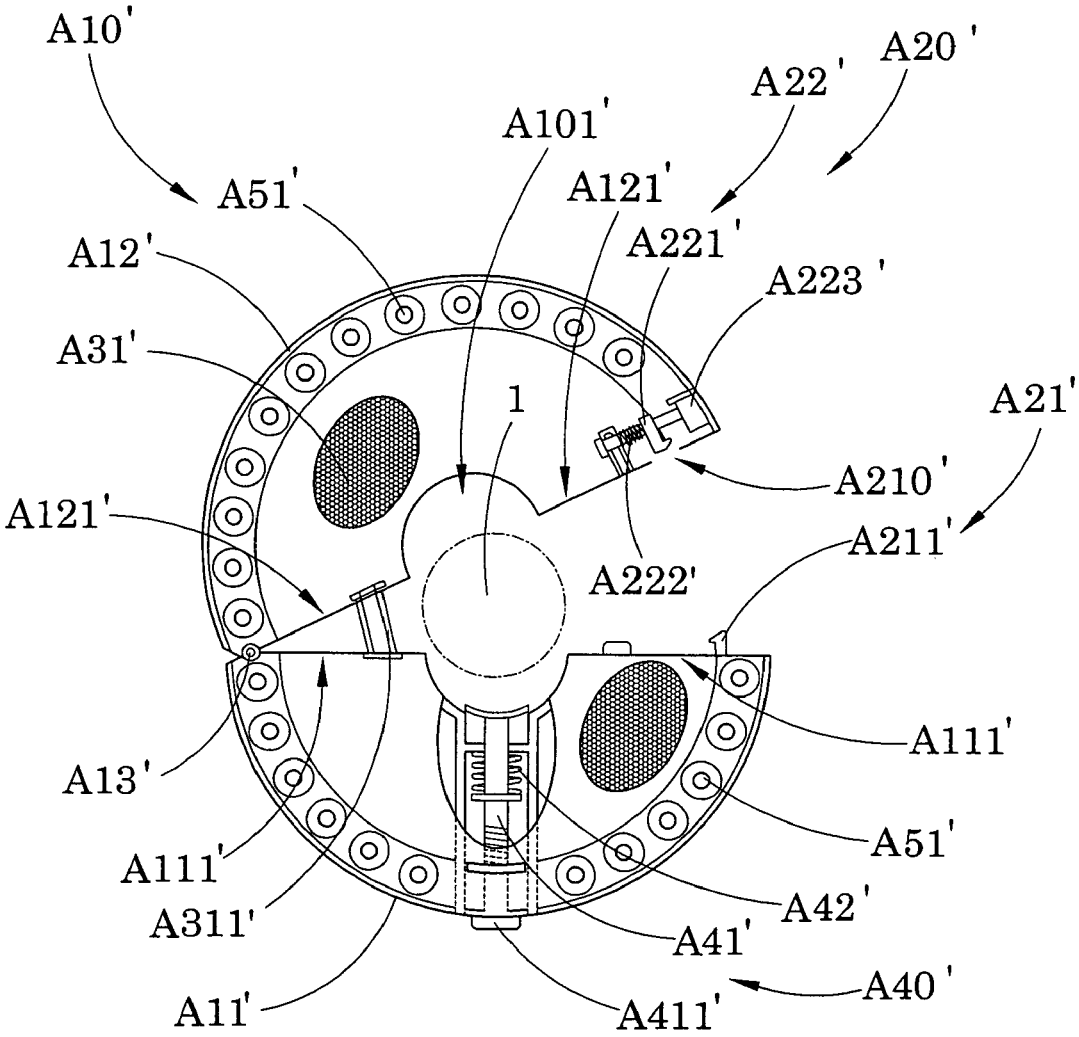
FIG. 27 is a bottom view of an audio system according to a sixth preferred embodiment of the present invention, illustrating the first and second housing bodies being pivotally coupled with each other via a pivot hinge.

As shown in FIG. 27, an audio system of a sixth embodiment illustrates an alternative mode of the fifth embodiment of the present invention, wherein the audio system comprises an audio housing A10', a detachable locker A20' and an audio device A30'. Accordingly, the audio device A30' of the sixth embodiment has the same configuration of the audio device A30 of the fifth embodiment.

The audio housing A10' comprises a first housing body A11' and a second housing body A12' defining a mounting slot A101' when the first and second housing bodies A11', A12' are coupled with each other, wherein the mounting slot A101' has a size for the shaft A1 of the outdoor umbrella fitting therewithin.

The detachable locker A20' comprises a first locker A21' provided at the first housing body A11' and a second locker A22' which is provided at the second housing body A12' and is releasably locked with the first locker A21' so as to detachably lock up the second housing body A11' with the first housing body A12'.

As shown in FIG. 27, the first and second housing bodies A11', A12' are two identical half circular bodies pivotally coupling with each other via a pivot hinge A13', wherein each of the first and second housing bodies A11', A12' has two biasing surfaces A111', A121' arranged when the biasing surfaces A111' of the first housing body A11' engage with the biasing surfaces A121' of the second housing body A12' respectively, the audio housing A10' is formed to have a donut shape and to define the mounting slot A101' at a center of the audio housing A10'.

The audio system further comprises a lighting device A50' for providing illumination under the audio housing A10'. The lighting device A50' comprises a plurality of illuminators A51' spacedly supported in the outer circumferential portion of the first and second housing bodies A11', A12' and electrically coupling with the audio device A30'. Accordingly, each of the illuminators A51' is a LED having a head portion protruded from the bottom sides of the first and second housing bodies A111', A12' and a tail portion electrically connecting to the audio device 30'.

The first locker A21' comprises a first locking latch A211' outwardly protruded from one of the biasing surfaces A11' of the first housing body A11'. The second locker A22' comprises a second locking latch A221' movably supported in the second housing body A12' to align with a locking hole A210' on the respective biasing surface A121' of the second housing body A12', wherein when the first locking latch A211' is engaged with the second locking latch A221' through the locking hole A210', the second housing body A12' is locked up with the first housing body A11'.

Accordingly, the second locker A22' further comprises a resilient element A222' supported in the second housing body A12' for applying an urging force against the second locking latch A221' so as to normally retain the second locking latch A221' being locked up with the first locking latch A211', and a lock actuator A223' coupling with the second locking latch A221' and actuating the second locking latch 221' to disengage with the first locking latch A211'. The resilient element A222' is a compression spring having two ends coupling with an inner wall of the second housing body A12' and the second locking latch A221' to apply the urging force against the second locking latch A221'. The lock actuator A223' is coupled with the second locking latch A221' such that when the lock actuator A223' is actuated, the second locking latch A221' is driven to move to disengage with the first locking latch A221' so as to unlock the second housing body A12' from the first housing body A11'. Once the lock actuator A223' is released from its actuated position, the resilient element A222' will drive the second locking latch A221' backs to its original position.

Figure 28:
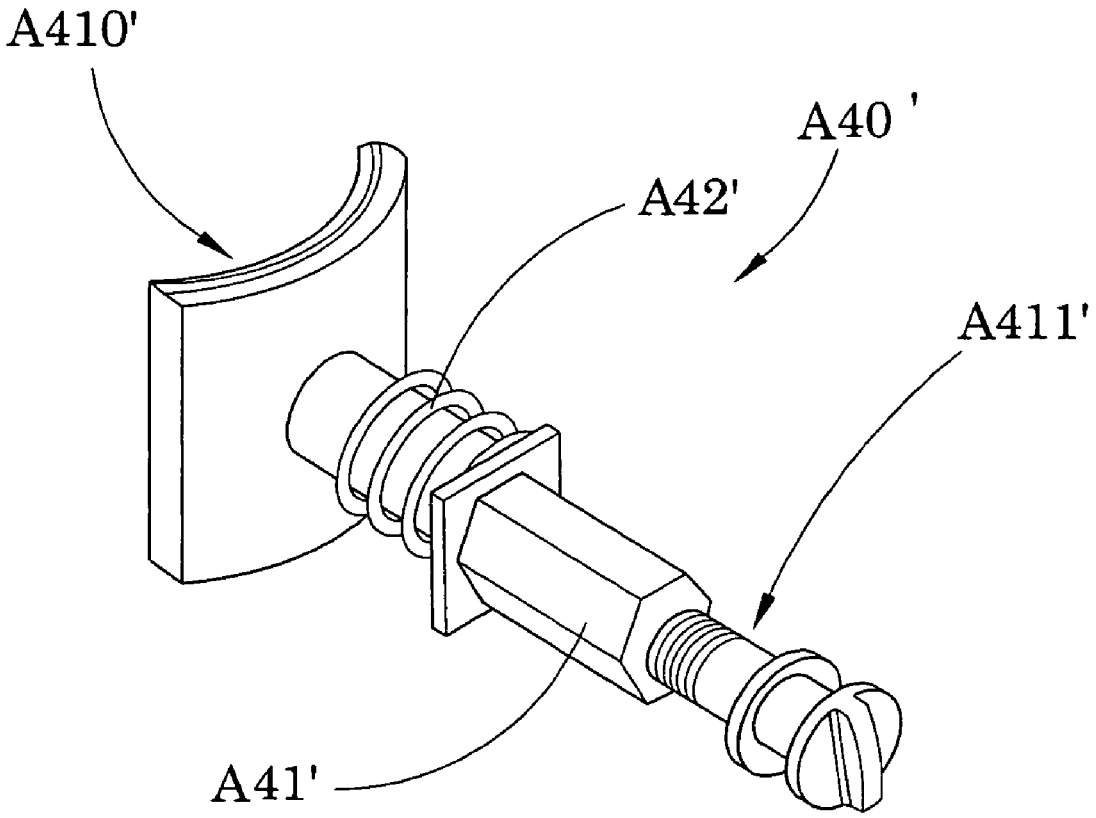
FIG. 28 is a sectional view of the adjustable retainer according to the above sixth preferred embodiment of the present invention.

The audio system, according to the sixth embodiment, further comprises an adjustable retainer A40' for adjusting the size of the mounting slot A101' for the shaft A1 of the outdoor umbrella. The adjustable retainer A40' comprises a retention arm A41' having a pusher surface A410' facing towards the mounting slot A101' and a control portion A411' rotatably coupling with the second housing body A12' such that when the control portion A411' is driven to rotate, the pusher surface A410' is adjustably move to adjust the size of the mounting slot A101'. As shown in FIG. 28, the control portion A411' of the retention arm A41' has an outer threaded portion engaging with an inner threaded portion of a sidewall of the second housing body A12'. The adjustable retainer A40' further comprises a compression spring A42' coaxially mounted at the retention arm A41' for applying an urging force against the retention arm A41' to push the pusher surface A410' away from the mounting slot A101'. In other words, when the control portion A411' of the retention arm A41' is rotated to move the pusher surface A410' towards the mounting slot A101', the compression spring A42' is being compressed.

As shown in FIG. 27, the speakers A31' are supported in the first and second housing bodies A11', A12' respectively, wherein an electric cable A311' are extended between the two corresponding biasing surfaces A111', A121' of the first and second housing bodies A11', A12' to electrically connect the speaker A31' with each other. Accordingly, the electric cable A311' not only electrically connects the speakers A31' with each other but also limits a pivot angle between the first and second housing bodies A11', A12'.

Figure 29:
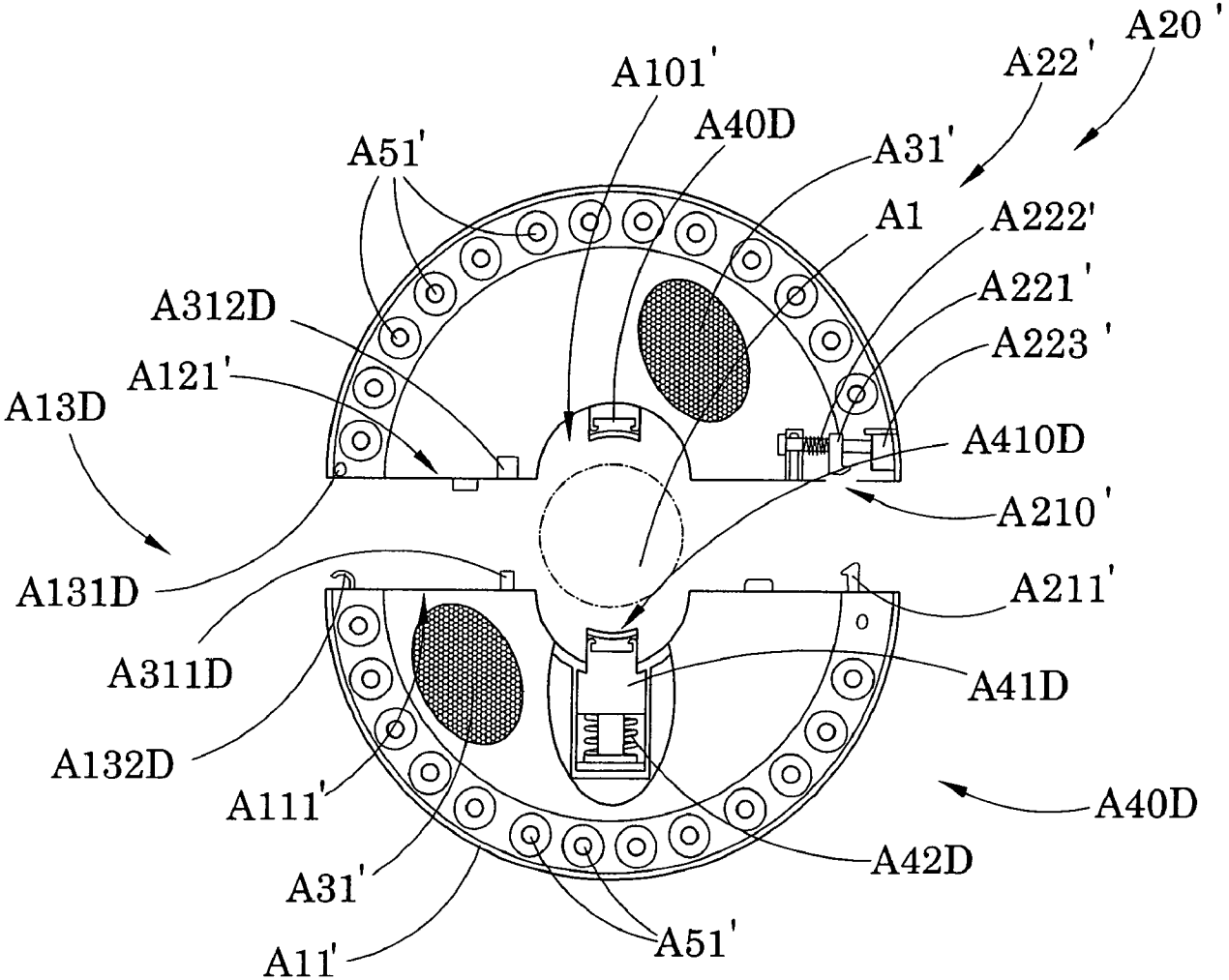
FIG. 29 illustrates an alternative mode of the pivot hinge according to the above sixth preferred embodiment of the present invention, illustrating the first and second housing bodies being detached with each other via a pivot hinge.

FIG. 29 illustrates an alternative mode of the pivot hinge A13D. As shown in FIG. 29, the first housing body A111' is pivotally coupled with the second housing body A12' via a pivot hinge A13D. The pivot hinge A13D comprises a pivot shaft A131D provided at the first housing body A11' and a detachable coupler A132D which is extended from the second housing body A11' and is detachably coupled with the pivot shaft A131D to pivotally connect the second housing body A12' with the first housing body A11'. Therefore, once the detachable coupler A132D couples with the pivot shaft A131D, the first and second housing bodies A11', A12 are pivotally moved with respect to the pivot shaft A131D. In other words, the pivot hinge A13D not only pivotally connects the first and second housing bodies A11', A12 with each other but also detachably mounts the first and second housing bodies A11', A12 with each other.

The adjustable retainer A40D comprises a retention arm A41D, having a pusher surface A410D facing towards the mounting slot A101', slidably mounted the first housing body A111' and an adjustable locker A42D controllably driving the retention arm A41D at a position that when the retention arm A41D is driven towards mounting slot A10', the pusher surface A410D is arranged for biasing against an outer surface of the shaft A1 of the outdoor umbrella until the shaft A1 thereof being fitted at the mounting slot A101' so as to substantially mount the audio housing A10' at the outdoor umbrella.

Figure 30:
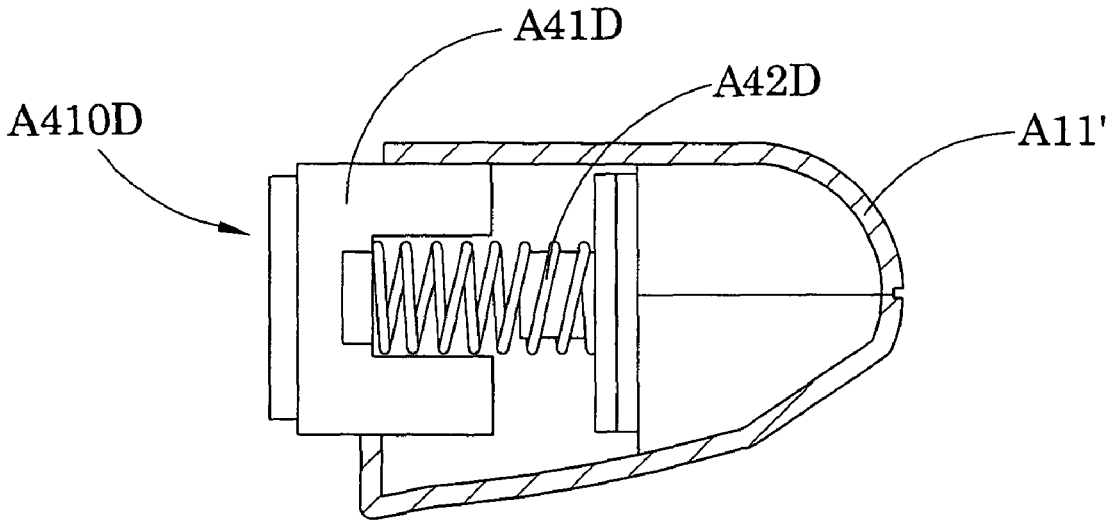
FIG. 30 illustrates an alternative mode of the adjustable retainer according to the above sixth preferred embodiment of the present invention.

As shown in FIG. 30, The adjustable locker A42D comprises a compression spring supported in the first housing body A11' for applying a pushing force against the retention arm A41D so as to normally push the pusher surface A410D towards the mounting slot A101'.

In addition, since the first housing body A111' can be detached from the second housing body A12' via the pivot hinge A13D, the electric cable A311' should be omitted. In order to electrically connect the speakers A31' at the first and second housing bodies A11', A12', an electric plug A311D is extended from the corresponding biasing surface 111' of the first housing body A11' and is electrically coupled with the speaker A31' thereat. An electric socket A312D is extended from the corresponding biasing surface A121' of the second housing body A12' and is electrically coupled with the speaker A31' thereat, wherein the electric plug A311D is electrically coupled to the electric socket A312D when the first and second housing bodies A11', A12' are coupled with each other via the pivot hinge A13D.

Figure 31:
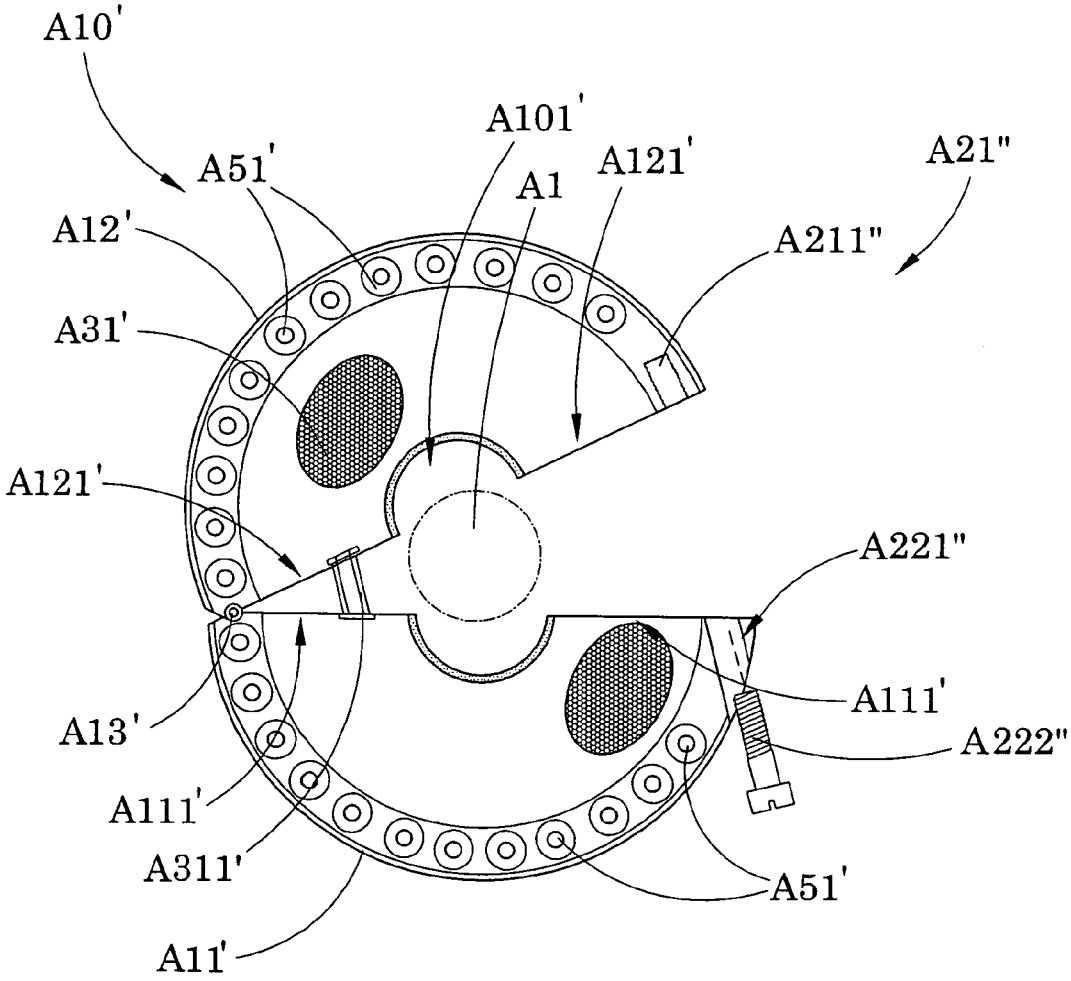
FIG. 31 is a bottom view of an audio system according to a seventh preferred embodiment of the present invention.

As shown in FIG. 31, an audio system of a seventh embodiment illustrates an alternative mode of the sixth embodiment of the present invention, wherein the audio system comprises an audio housing A10", a detachable locker A20" and an audio device A30". Accordingly, the audio device A30" of the third embodiment has the same configuration of the audio devices A30, A30' of the first and second embodiments and the alternatives thereof.

The audio housing A10" comprises a first housing body A11" and a second housing body A12" defining a mounting slot A101" when the first and second housing bodies A11", A12" are coupled with each other, wherein the mounting slot A101" has a size for the shaft A1 of the outdoor umbrella fitting therewithin.

The detachable locker A20" comprises a first locker A21" provided at the first housing body A11" and a second locker A22" which is provided at the second housing body A12" and is releasably locked with the first locker A21" so as to detachably lock up the second housing body A11" with the first housing body A12".

As shown in FIG. 31, the first and second housing bodies A11", A12" are two identical half circular bodies pivotally coupling with each other via a pivot hinge A13", wherein each of the first and second housing bodies A11", A12" has two biasing surfaces A111", A121" arranged when the biasing surfaces A111" of the first housing body A11" engage with the biasing surfaces A121" of the second housing body A12" respectively, the audio housing A10" is formed to have a donut shape and to define the mounting slot A101" at a center of the audio housing A10".

The audio system further comprises a lighting device A50" for providing illumination under the audio housing A10". The lighting device A50" comprises a plurality of illuminators A51" spacedly supported in the outer circumferential portion of the first and second housing bodies A11", A12" and electrically coupling with the audio device A30". Accordingly, each of the illuminators A51" is a LED having a head portion protruded from the bottom sides of the first and second housing bodies A11", A12" and a tail portion electrically connecting to the audio device A30".

The first locker A21" contains a first locking channel A211" formed at the first housing body 11", wherein the first locking channel A211" has an opening formed at one of the biasing surfaces A111' of the first housing body A11".

The second locker A22" contains a second locking channel A221" formed at the second housing body A12", wherein the second locking channel A221" has an opening formed at the corresponding biasing surface A121' of the second housing body A12" to align with the opening of the first locking channel A211" when the biasing surfaces A111", A121" of the first and second housing bodies A11", A12" are engaged with each other. In other words, when the first and second housing bodies A11", A12" are coupled with each other, the first locking channel A211" is coaxially aligned with the second locking channel A212".

The second locker A22" further comprises an elongated locking shaft A222" rotatably extended from the second locking channel A212" to the first locking channel A211" to lock up the second housing body A12" with the first hosing body A11". Accordingly, each of the first and second locking channels A211", A221" has an inner threaded portion wherein the locking shaft A222" has a corresponding outer threaded portion arranged in such a manner that when the locking shaft A222" is rotatably extended from the second locking channel A212" to the first locking channel A211", the second housing body A12" is locked up with the first hosing body A11".

It is worth to mention that the detachable locker A20" of the third embodiment can be incorporated with the audio housing A10 of the first embodiment that the first locking channel A211" of the first locker A21" contains two portions formed at the first housing body 11 while the second locking channel A212" of the second locker A22" can be formed at the second housing body A12 to coaxially align between the two portions of the first locking channel A211" such that the locking shaft A222" is rotatably extended to portions of the first locking channel A211" through the second locking channel A221" to lock the second housing body A12 to the first housing body A11.

The audio system further comprises an adjustable retainer A40" for adjusting the size of the mounting slot A101" for the shaft A1 of the outdoor umbrella, wherein the adjustable retainer A40" comprises a first foaming element A41" provided at the first housing body A11" at the mounting slot A101" and a second foaming element A42" provided at the second housing body A12" at the mounting slot 101" and arranged when the first and second housing bodies A11", A12" are engaged with each other, the first and second foaming elements A41", A42" are adapted for biasing against the outer side of the shaft 1 of the outdoor umbrella to securely retain the audio housing A10" around the shaft 1 of the outdoor umbrella. It is worth to mention that when the shaft A1 of the outdoor umbrella is sandwiched between the first and second foaming elements A41", A42", the first and second foaming elements A41", A42" are self-deformed to fit the size of the shaft 1 of the outdoor umbrella, so as to hold the audio housing A10" at the shaft 1 of the outdoor umbrella by means of frictional force. Preferably, the first and second foaming elements A41", A42" are two arc shaped elements to encircle with the shaft A1 of the outdoor umbrella.

It is worth to mention that the audio housing A10, A10', A10", the detachable locker A20, A20', A20", the audio device A30", and the adjustable retainer A40, A40', A40" of the fifth to seventh embodiments and their alternatives are interchangeable that the first and second foaming elements A41", A42" of the adjustable retainer A40" can be used in the fifth embodiment of the present invention while the detachable locker A20' can be used in the seventh embodiment of the present invention.

Figure 35:
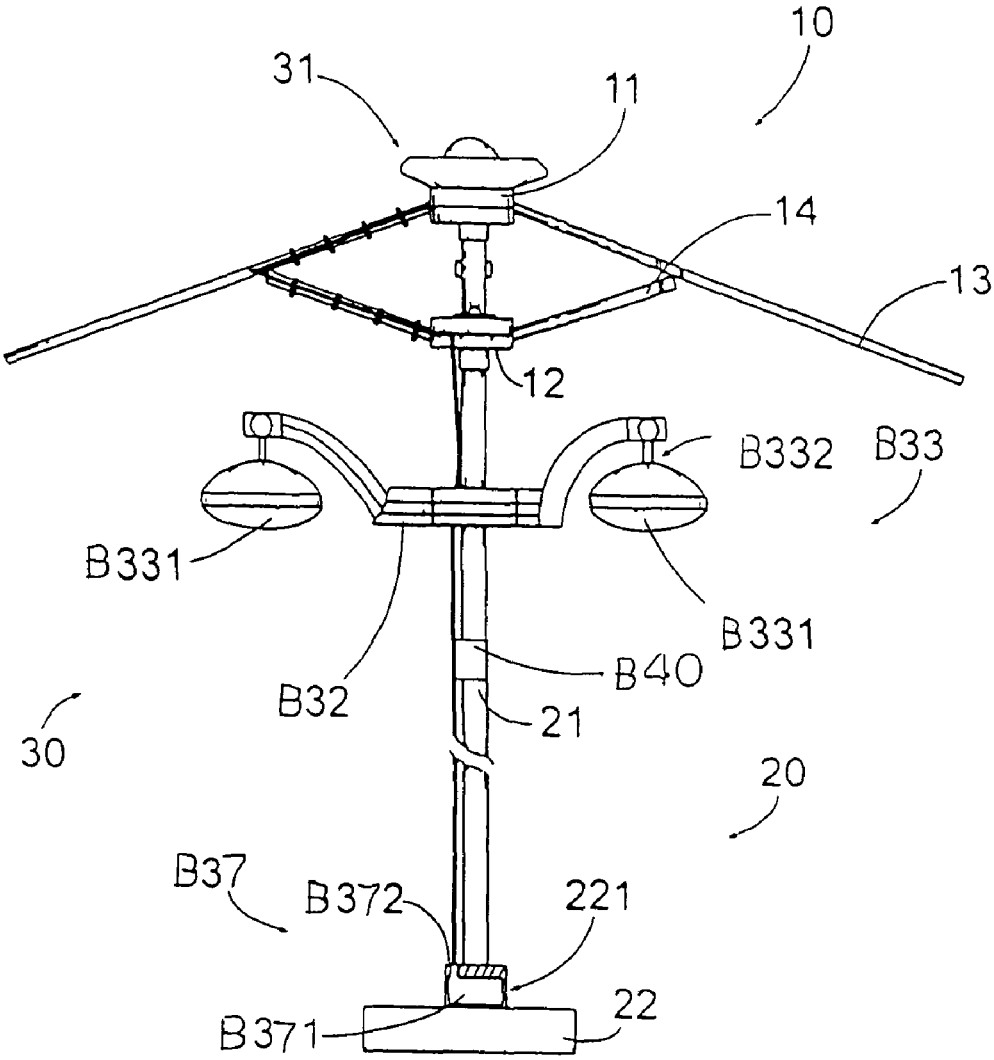
FIG. 35 is a schematic diagram of an outdoors umbrella according to an eighth preferred embodiment of the present invention.

Referring to FIG. 35 of the drawings, an outdoor umbrella according to an eighth preferred embodiment of the present invention is illustrated, wherein the outdoor umbrella, such as the first embodiment, comprises an umbrella frame and an audio system.

The umbrella frame comprises an awning frame 10 defining a shadowing area 101 thereunder and a supporting frame 20 comprising a supporting shaft 21 having an upper portion connected to the awning frame 10.

The outdoor umbrella further comprises a solar system 30 comprising a solar energy collector 31 mounted on top of the awning frame 10 for collecting solar energy. The audio system comprises an audio support B32 and a plurality of audio units B33.

The audio support B32, which is adjustably mounted along the supporting shaft 21 at a position within the shadowing area 101 of the awning frame 10, comprises a plurality of supporting arms B321 radially extended from the supporting shaft 21.

Each of the audio units B33 comprises a speaker element B331 electrically connected to the solar energy collector 31 through the awning frame 10 and a coupling joint B332 connecting the speaker element 331 to the respective supporting arm B321 in a movably suspended manner such that by selectively adjusting a position of the audio support B32 along the supporting shaft 21, the speaker elements B331 are suspendedly self-repositioned for maximizing a coverage area within the shadowing area 101.

According to the preferred embodiment, the awning frame 10 comprises an upper housing 11 affixed on top of the supporting shaft 21, a lower housing 12 slidably connected to the supporting shaft 21 at a position below the upper housing 11, a plurality of awning arms 13 radially and pivotally extended from the upper housing 11 to support an awning shelter 15 thereon, and a plurality of awning ribs 14 pivotally connecting the lower housing 12 with the awing arms 13 respectively in such a manner that when the lower housing 12 is slid along the supporting shaft 21 towards the upper housing 11, the awning arms 13 are pivotally driven by the awning ribs 14 to radially extended from the upper housing 11 so as to provide the shadowing area 101 under the awning shelter 15.

The supporting frame 20 further comprises a ground stand 22 wherein the supporting shaft 21 is upwardly extended from the ground stand 22 to support the awning frame 10.

Accordingly the solar energy collector 31 comprises a collector base 311, having a circular shaped, coaxially mounted on a top end portion of the supporting shaft 21 at a position above the upper housing 11, and a solar energy collecting device 312 which is provided on a platform of the collector base 311 and is upwardly oriented for collecting the solar energy so as to convert the solar energy into electrical energy to the speaker elements B331.

In order to further secure the attachment between the solar energy collector 31 and the supporting shaft 21, the solar energy collector 31 further comprises a protective cover 313 substantially affixed to the upper housing 11 on top of the supporting shaft 21 so as to securely sandwich the collector base 311 between the upper housing 11 and the protective cover 313. In order to facilitate the secure attachment, two connecting elements 314, which are preferably two rivets, can be utilized to mount the protective cover 313 to the upper housing 11 through the upper housing 11 to securely clamp the collector base 311 between the upper housing 11 and the protective cover 313, so as to retain the solar energy collecting device 312 in position.

Figure 36:
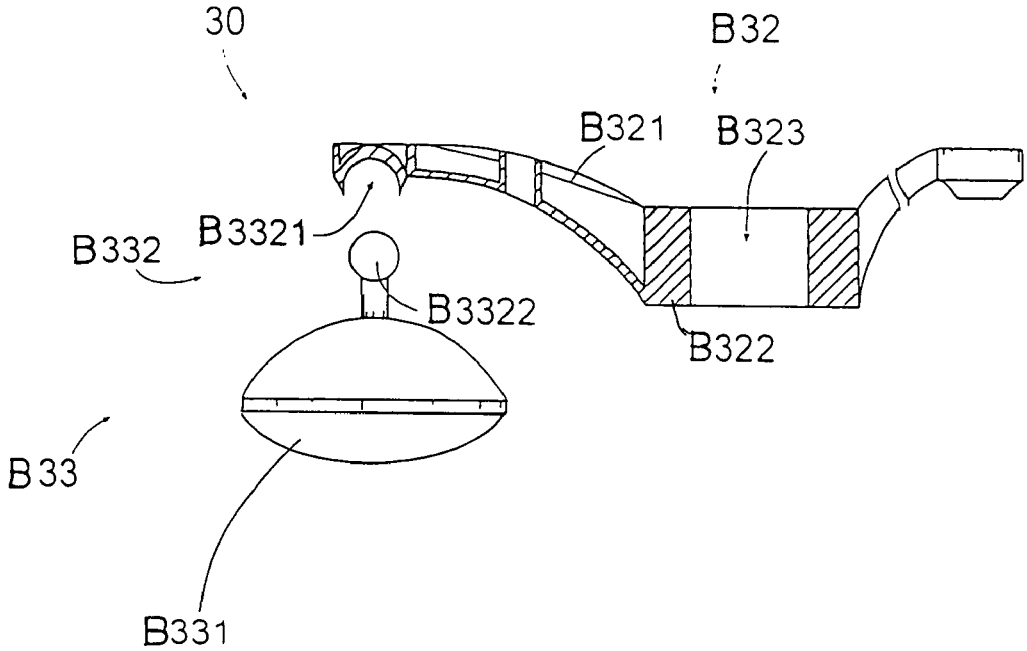
FIG. 36 is a partially sectional view of the audio system of the outdoors umbrella according to the above eighth preferred embodiment of the present invention.

As shown in FIG. 36, the audio support B32 further comprises a central hub B322 having a central sliding through slot B323 for the supporting shaft 21 sliding therethrough, wherein the supporting arms B321 are spacedly and radially extended from the central hub B322.

Each of the speaker elements B331 is embodied as a speaker. Preferably, the speaker elements B331 are electrically connected to the solar energy collecting device 312 of the solar energy collector 31 along one of the awning arms 13 and the respective awning rib 14 via an electric cable, as shown in FIG. 35, in such a manner that the electrical connection between the speaker elements B331 and the solar energy collector 31 will not be interfered by the awning frame 10, especially the folding and unfolding operation of the awning frame 10 of the outdoor umbrella. Accordingly, the awning arms 13 and the awning ribs 14 are constructed to have a hollow shape such that the electric cable is adapted to pass through the respective awning arm 13 and the awning rib 14 to electrically connect the solar energy collector 31 to the respective speaker element B331. Accordingly, the speaker elements B331 can be electrically connected to a power source, such as a battery or an external power source.

It is worth to mention that each speaker element B331 is preferably embodied as an outdoor speaker in order to incorporate with the outdoor umbrella.

The audio system further comprises an audio input B40 operatively linked to the speaker unit B33 such that when the audio input B40 sends an audio signal to the speaker unit B33, the speaker unit B33 is adapted for producing audio effect within the shadowing area as an additional function for the outdoor umbrella. The audio input B40 comprises an auxiliary input provided at the supporting shaft 21 at a hand reachable position for communicatively connecting a portable music player to receive the audio signal therefrom, such that the audio signal is transmitted to the speaker unit B33 for music broadcasting. Accordingly, the audio input B40 has the same electrical configuration as the audio input A32 of the fifth embodiment as shown in FIG. 20.

Having the same wireless configuration as it is mentioned above and as shown in FIG. 20, the audio input B40 further a wireless receiver A323 to electrically connect with the speaker unit B33 and a wireless transmitter A324 which is wirelessly linked with the wireless receiver A323 and is adapted for connecting with the portable music player to wirelessly sending the audio signal from the portable music player to the speaker unit B33 for music broadcasting. Accordingly, the wireless receiver A323 is a FM receiver and the wireless transmitter A324 is a FM transmitter such that the wireless receiver A323 and the wireless transmitter A324 form a wireless link to wirelessly send the audio signal from the portable music player to the speaker unit B33.

Accordingly, the audio input B40 is provided at the supporting shaft 21 of the umbrella frame, wherein the audio input B40 comprises a control circuitry operatively linked to the speaker unit B33 to selectively operate and control the speaker unit B33. In addition, the audio input B40 further comprises a radio broadcasting circuit for receiving radio wave as the audio signal such that the audio signal is then transmit to the speaker unit B33 for radio broadcasting. In other words, the user is able to listen to the music from his or her portable music player or to the radio through the audio system of the present invention.

Furthermore, a chain arrangement B34 and an attachable arrangement B35 are respectively mounted on the body and the lower end of awning arms 13 for primarily providing audio effect to the shadowing area 101 defined by the awning frame 10 so as to enrich the audio effects.

Figure 37:
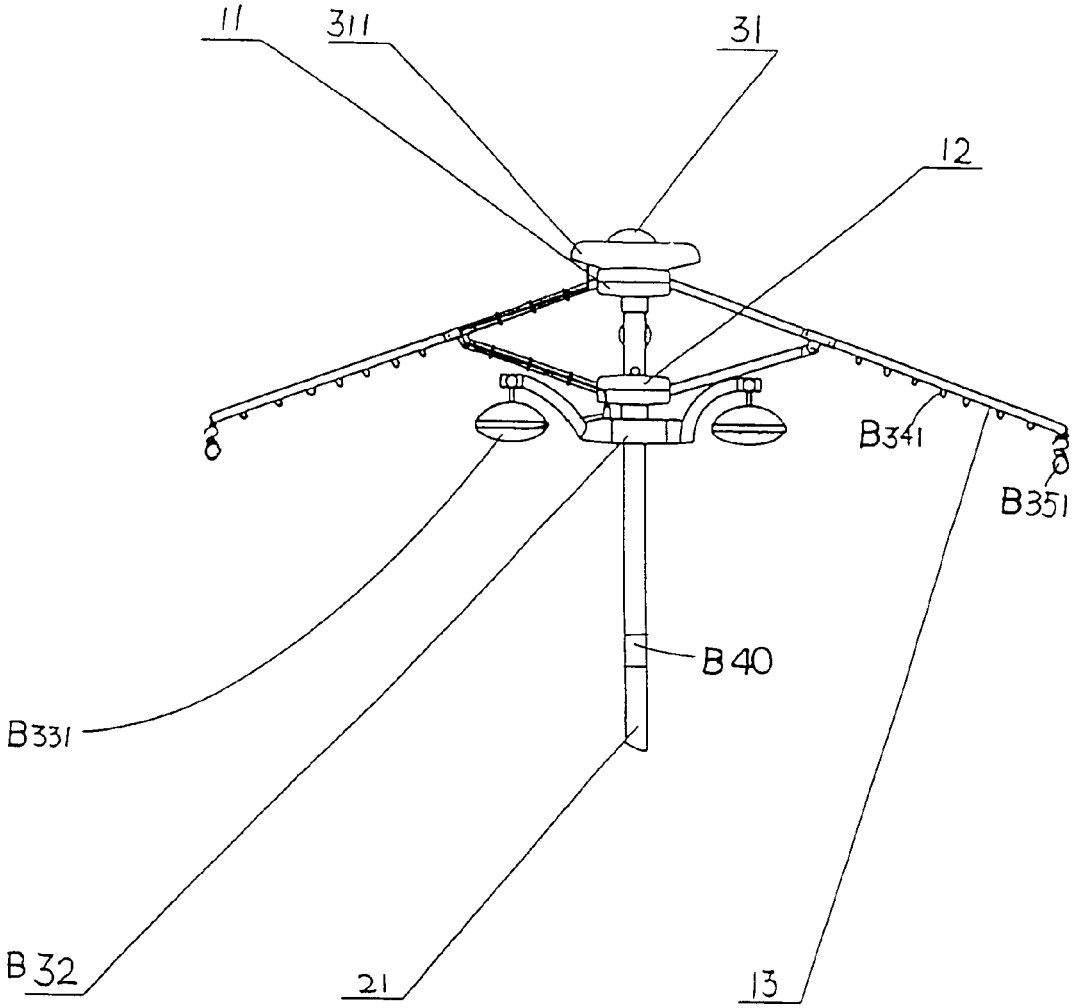
FIG. 37 is a schematic diagram of the outdoors umbrella showing the audio system according to the eighth preferred embodiment of the present invention.
Figure 38:
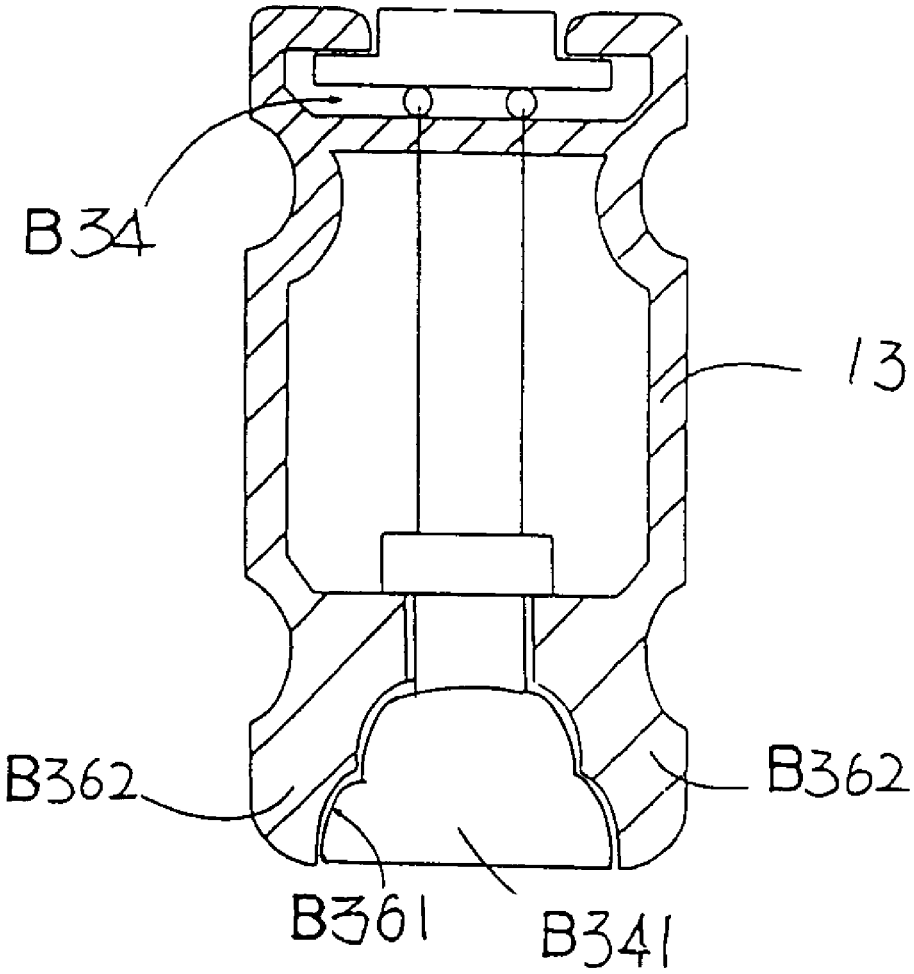
FIG. 38 is a sectional view of an elongated awning arm incorporated the audio system according to the eighth preferred embodiment of the present invention.

Referring to FIGS. 37-38 of the drawings, the chain arrangement B34 according to the eighth preferred embodiment of the present invention is illustrated. First of all, the chain arrangement B34 further comprises a plurality of holders B36 provided along the awning arm 13 respectively. Accordingly, each of the holders B36 is embodied as an elongated receiving groove B361 formed along a bottom side of the respective awning arm 13. According to the preferred embodiment of the present invention, two retaining walls B362 downwardly and integrally extended along the bottom side of each of the awning arms 13 wherein the receiving groove B361 is defined between the respective two retaining walls B362 and the bottom side along the respective awning arm 13. Accordingly, an inner side of each of the retaining walls B362 is concavely curved so that it can fit the chain units B341 thereat.

Second, the chain arrangement B34 comprises a plurality of chain units B341 alignedly received in the receiving grooves B361 respectively wherein the audio signal generated by the chain units B341 are substantially projected out of the receiving grooves B361 by the retaining walls B362 so as to provide the audio effect within the shadowing area 101 of the outdoors umbrella. Moreover, since the chain units B341 are substantially received in the receiving grooves B361 respectively, they are substantially protected from any potential damage resulting from any mechanical operation of the outdoors umbrella of the present invention, such as folding or unfolding. In other words, the chain arrangement B34 of the present invention substantially overcome the conventional disadvantage of frangibility of speaker elements caused by the umbrella's own mechanical operations, such as folding and unfolding movement.

According to the preferred embodiment, each of the awning arms 13 is a hollow body wherein the electrical wires could be inserted. As a result, it is convenient for communicating the interior of awning arm 13 and the receiving groove B361, for example, through a plurality of slots or a continuous slit, etc.

In order to further protect the chain arrangement B34 from potential physical damage by external objects, the chain arrangement B34 further comprises a plurality of speaker holders B343 slidably inserted into the awning arm 13 respectively. The chain units B341 are spacedly mounted at the respective speaker holder B343 such that the speaker holder B343 is capable of holding the chain units B341 in position along the awning arms 13 thus protecting the chain units B341 within the receiving grooves B361 respectively.

The chain units B341 disposed in each of the awning arm 13 are electrically connected in series through the respective awning arms 13 wherein an electric cord is received in the respective awning arm 13 for electrical connection. Further, the electric cord has one or more terminals which are extended to the upper housing 11 and then electrically connected to a power source for the provision of energy so as to power up the chain units B341.

From the forgoing description, it is shown that the outdoors umbrella of the present invention comprises the chain units B341 which are embedded in the awning arms 13 respectively to form an integral awning body. As a result, users of the present invention can enjoy music without fear of any storage or operational damages to the outdoors umbrella.

Figure 39:
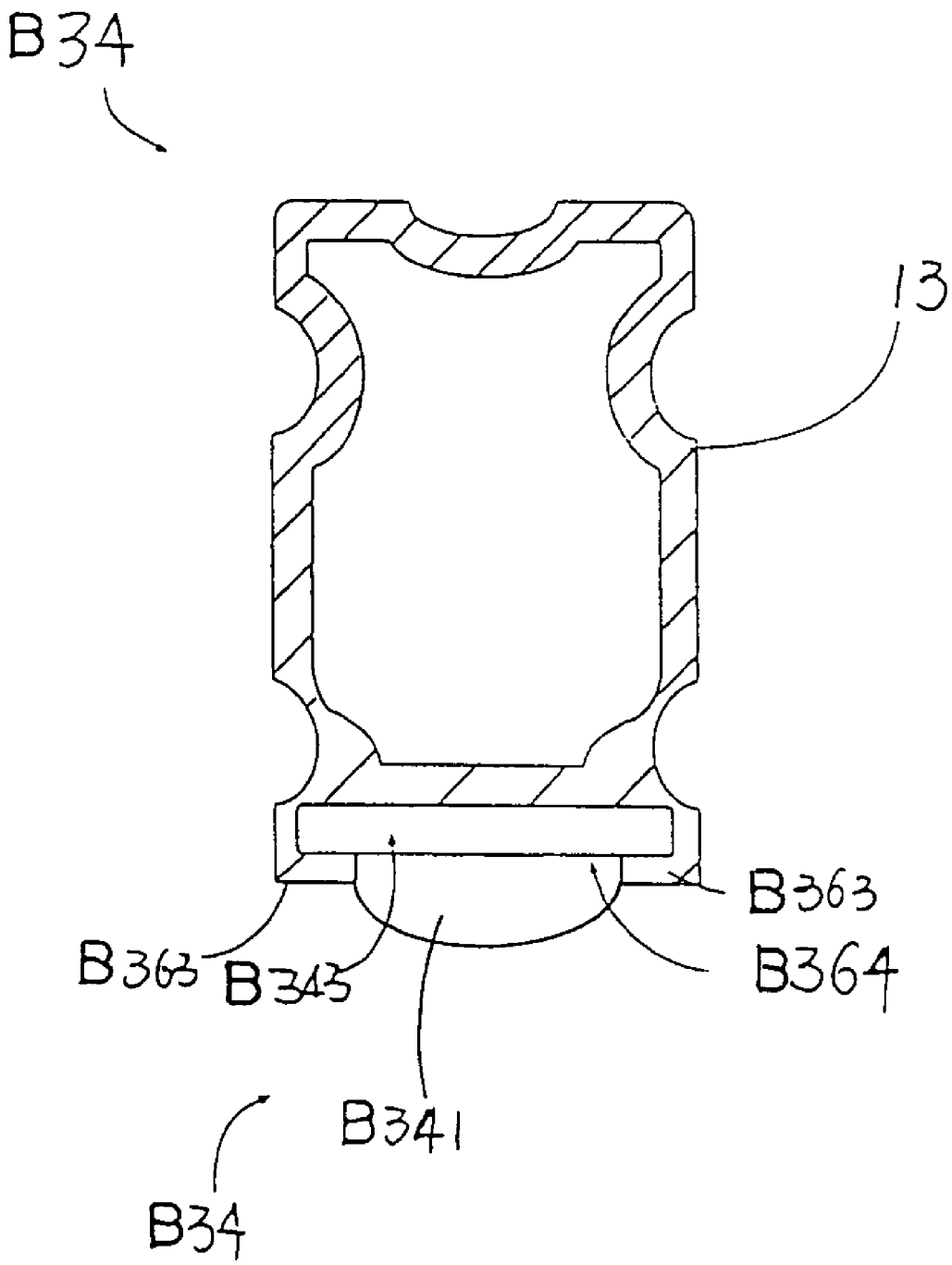
FIG. 39 is an alternative mode of the audio system according to the above preferred eighth embodiment of the present invention.

Referring to FIG. 39 of the drawings, an alternative mode of the chain arrangement B34 is illustrated. Here, the retaining wall B362 and the receiving groove B361 in the preferred embodiment cease to exist. Furthermore, the L-shaped electric boundaries B363 are provided at a bottom side of each of the awning arms 13 to define a receiving groove B364, while the speaker holders B343 is embodied as an elongated protective strip being slidably mounted into the receiving groove B364. The electric cord connecting to the chain units B341 is arranged to be embedded or totally buried into the elongated protective strip to prevent any possible direct contact with external objects, thus reducing the possibility of being damaged thereby. Likewise, the electric cord is then extended to a power source for acquiring transmitting electricity to the chain units B341.

Figure 40:
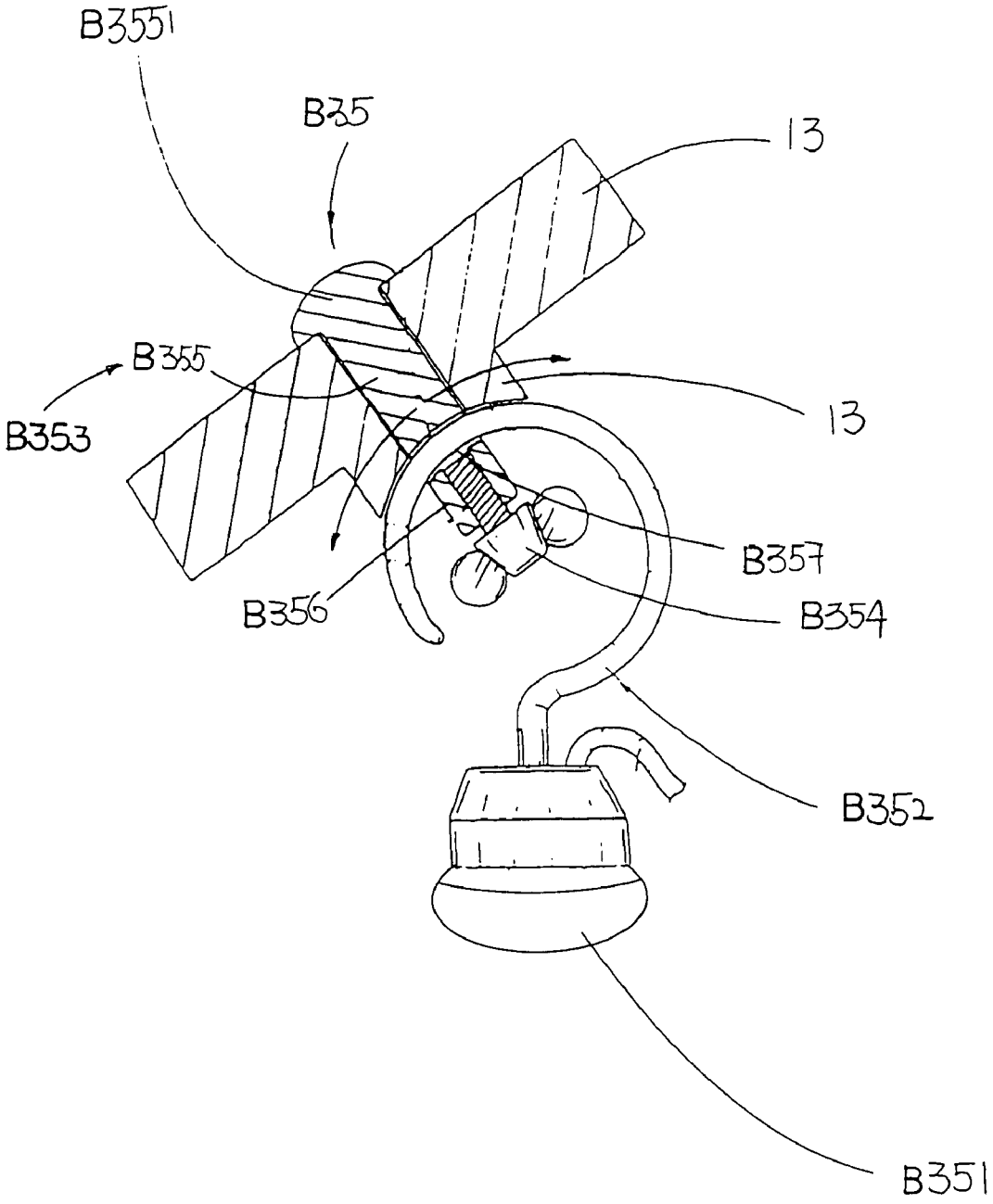
FIG. 40 is a sectional view of the attachable audio arrangement according to the above eighth preferred embodiment of the present invention illustrating how the audio unit maintains its substantially vertical orientation while the awning arm is extended in an inclined position.

Referring to the FIG. 40 of the drawing, the attachable arrangement B35 is illustrated. Here, the attachable arrangement B35 comprises at least an attachable speaker unit B351 for generating audio signal, and means for attaching the attachable speaker unit B351 to the lower end of the respective awning arm 13 in a vertically down hanging manner so as to maintain the audio signal generated by the attachable speaker unit B351 directing downwards no matter the awning frame 10 is in the unfolded position or in folded position. Preferably, the attachable speaker unit B351 is an outdoor speaker.

As shown in the FIG. 40, the attaching means comprises a speaker unit adaptor B352 connected to the attachable speaker unit B351 and a speaker unit supporter B353 provided at the respective lower end of the awning arm 13, wherein the speaker unit adaptor B352 is detachably mounted to the speaker unit supporter B353 in a suspending manner. Moreover, the attachable arrangement B35 further comprises a locking means B354 for locking the speaker unit B351 at any position with respect to the awning frame 10.

Furthermore, the attachable arrangement B35 is embodied to be detachably mounted at the lower end of the respective awning arm 13. According to the preferred embodiment, the speaker unit supporter B353 is embodied as (but not limited to) a shank body B355 transversely extended therethrough, which has an enlarged head B3551 mounted on an outer side of lower end of the respective awning arm 13 and a connecting member B356 protruded from an inner side of the lower end of the awning arm 13, wherein a mounting slot B357 is transversely penetrating through the connecting member B356 that the speaker unit adaptor B352 is slidably coupled with the mounting slot B357.

Figure 41:
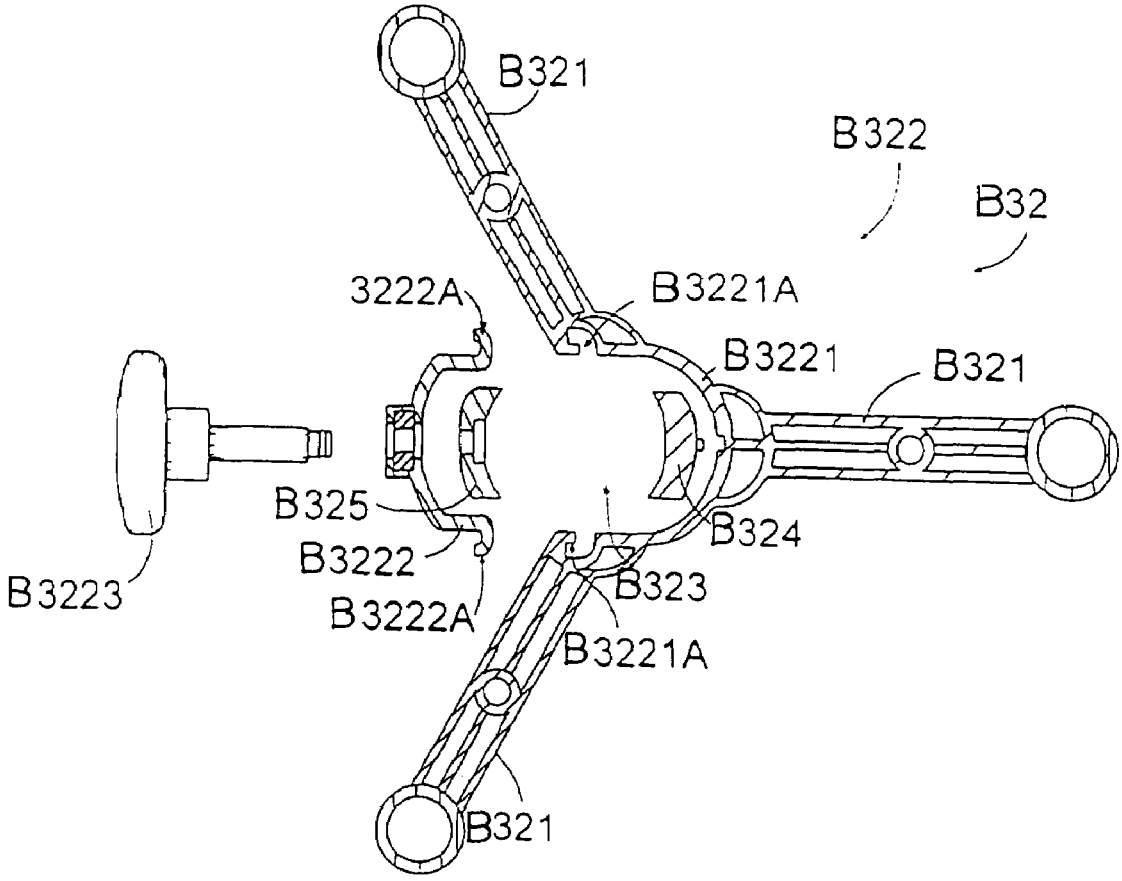
FIG. 41 is an exploded sectional view of the audio support according to the above eighth preferred embodiment of the present invention.

Here, as shown in the FIG. 41, each of the coupling joints B332 has a ball slot B3321 formed at a distal end of the respective supporting arm B321 and comprises a spherical head B3322 which is formed on top of the respective speaker unit B331 and is arranged to engage with the respective ball slot B3321 in a rotatably movable manner, so as to provide a ball joint to connect the each of the speaker units B331 with the respective supporting arm B321. In other words, the speaker units B331 are capable of self-rotating while being suspendedly supported by the supporting arms B321 so as to enhance the flexibility of the provision of audio effect to the outdoors umbrella.

It is worth to mention that a size of the spherical head B3322 is slightly smaller than the size of the respective ball slot B3321 wherein an outer wall of the ball slot B3321 is fabricated by elastic materials, such as plastic, so that by slightly pressing the spherical head B3322 to the respective ball slot B3321, the spherical head B3322 is capable of moving within the respective ball slot B3321 in free-swinging manner.

According to the preferred embodiment, there are three supporting arms B321 radially and suspendedly extended from the central hub B322 wherein there are three speaker units B331 are suspendedly supported by the supporting arms B321 via the coupling joints B332 respectively.

Figure 42:
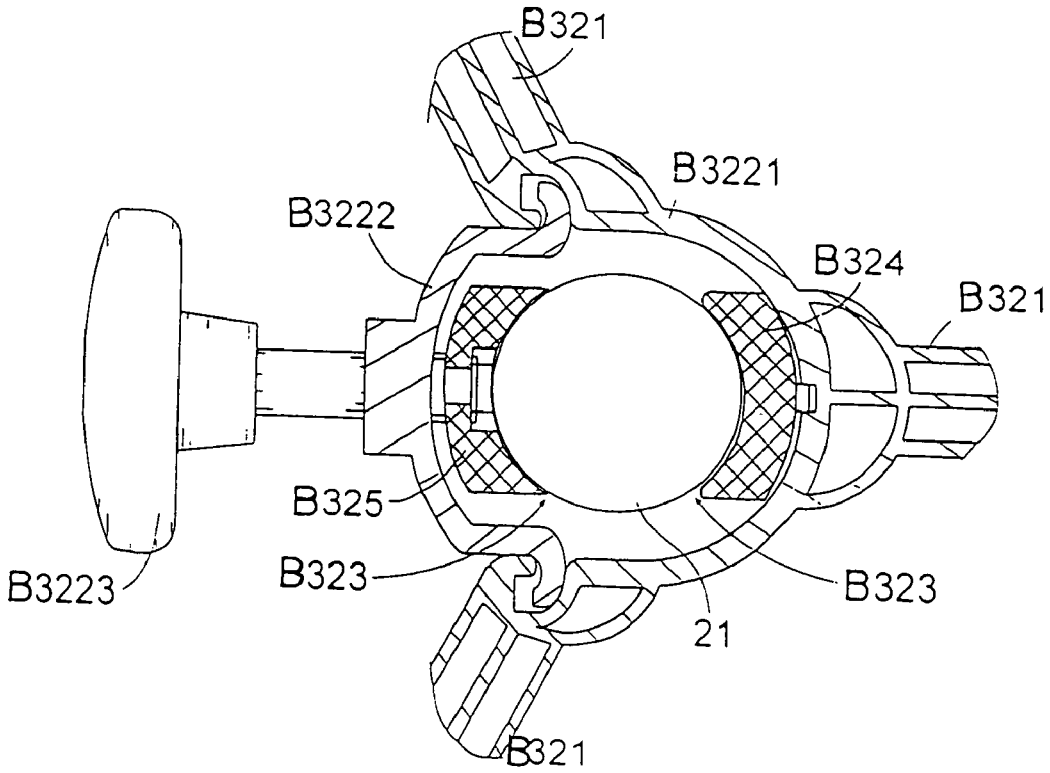
FIG. 42 is a partially sectional view of the audio support according to the above eighth preferred embodiment of the present invention, illustrating the audio support being mounted on the supporting shaft.

Referring to FIGS. 41 to 42 of the drawings, the central hub B322 comprises a boundary sleeve B3221 having an arc-shaped and a boundary cover B3222 interlocked with the boundary sleeve B3221 to form the central sliding through slot B323 within inner walls of the boundary sleeve B3221 and the boundary cover B3222, and a locking member B3223 having a locking end rotatably penetrated through the boundary cover B3222 to bias against the supporting shaft 21 so as to lock up the central hub B322 at the supporting shaft 21 in position.

As shown in FIG. 42 of the drawings, the boundary sleeve B3221 has two locking grooves B3221A formed along two edge portions and the boundary cover B3222 has two locking edges B3222A, each having a hook shaped corresponding to the locking groove B3221A, fittedly engaged with the locking grooves B3221A so as to interlock the boundary cover B3222 with the boundary sleeve B3221. Therefore, when the boundary cover B3222 is interlocked with the boundary sleeve B3221 to retain the supporting shaft 21 within the central sliding through slot B323, the locking member B3223 is rotated through the boundary cover B3222 until the locking end of the locking member B3223 is driven to bias against the supporting shaft 21 to lock up the audio support B32 on the supporting shaft 21.

The audio support B32 further comprises a first securing member B324 detachably attached to the inner wall of the boundary sleeve B3221 to bias against the supporting shaft 21 and a second securing member B325 attached to the locking end of the locking member B3223 at the inner wall of the boundary cover B3222 wherein the second securing member B325 is driven by the locking member B3223 to adjust a size of the central sliding through slot B323 for fittingly biasing against the supporting shaft 21 such that the supporting shaft 21 is securely clamped between the first and second securing members B324, B325. In other words, the audio support B32 is capable of fittingly mounting on different sizes of the supporting shafts having various diameters by selectively adjusting a distance between the first and second securing members B324, B325.

As shown in FIG. 35, a power source unit B37 comprises a power source B371 supported by the supporting frame 20 to receive in a power source compartment 221 provided at the ground stand 22 and to electrically connect with the audio units B33 and an recharging device B372 electrically connecting the solar energy collector 31 with the power source B371 for converting the solar energy into the electrical energy so as to recharge the power source B371. Accordingly, during the daytime, the solar energy collector 31 collects the solar energy and charges up the power source B371 via the recharging device B372 such that the power source B371 is capable of providing electrical energy to the audio units B33 during the nighttime. It is worth to mention that the recharging device B372 functions as an auto switch to automatically recharging the power source B371. Therefore, the recharging device B372 is capable of determining an electric capacity of the power source B371 wherein when the electric capacity of the power source B371 is full of charge, the recharging device B372 stops recharging the power source B371. However, when the electric capacity of the power source B371 is below a predetermined level, the recharging device B372 will start recharging the power source B371 from the solar energy collector 31 until the electric capacity of the power source B371 is full of charge.

It is also worth mentioning that from the forgoing elaboration, one can easily see that the solar system 30 is capable of securing mounting onto the supporting shaft 21 of the supporting frame 20 without affecting the operation of the outdoors umbrella as a whole. Moreover, the audio units B33 of the solar system 30 are capable of freely orientating so that when the outdoors umbrella occasionally requires inclined erection or open partially, the solar system 30 will always provide optimal audio effect, irrespective of such occasions.

Figure 43:
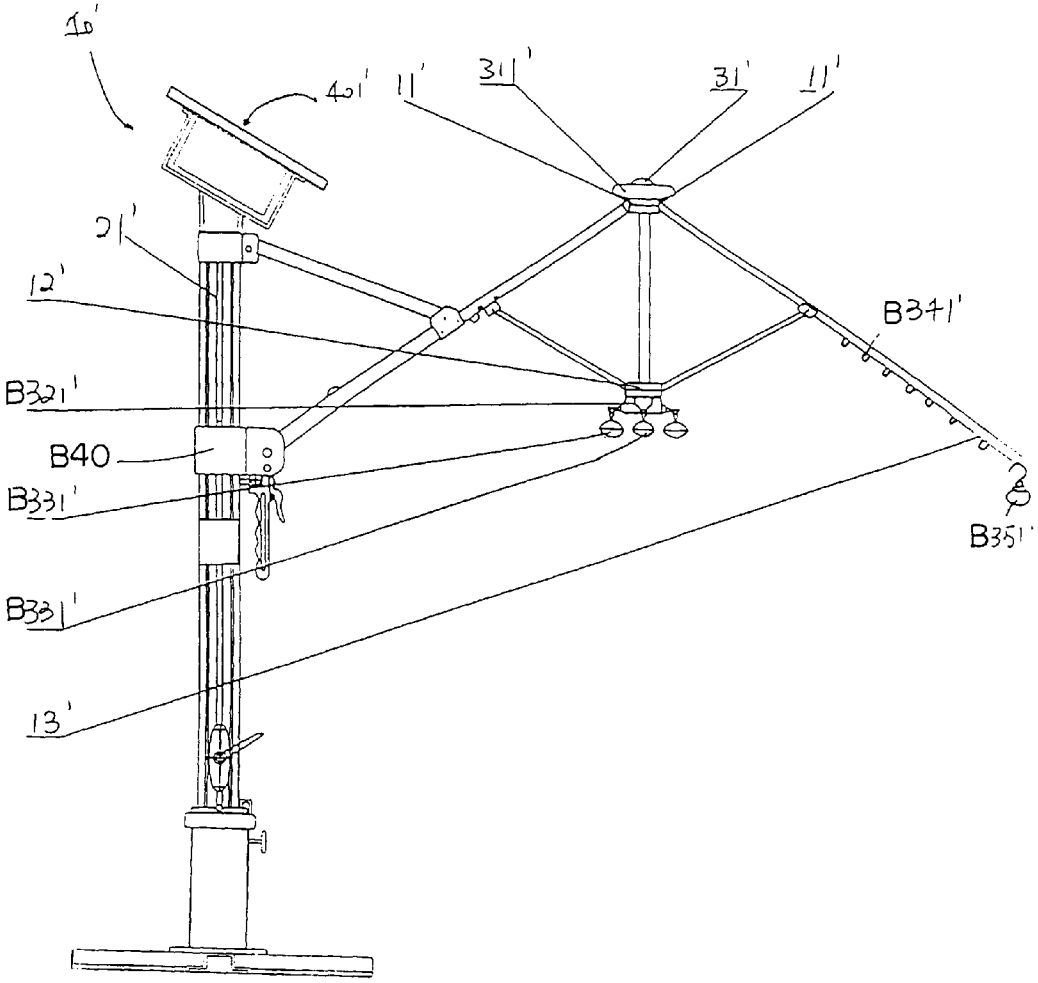
FIG. 43 is schematic view of the outdoors umbrella according to a ninth preferred embodiment of the present invention.

Referring to FIG. 43 of the drawings, an outdoor umbrella according to a ninth preferred embodiment of the present invention is illustrated, wherein the outdoor umbrella, such as a conventional outdoor umbrella, comprises an awning frame defining a shadowing area thereunder and a supporting frame comprising a supporting shaft 21' having an upper portion connected to the awning frame.

The solar energy collector 31' mounted on top of the awning frame and top of the supporting shaft 21' for collecting solar energy. The audio support B32' is adjustably mounted on the lower housing 12' for strengthening the audio effects. Preferably, the awning frame comprises a plurality of supporting arms B321' radially extended from the lower housing 12'.

Each of audio units B333' comprises a speaker unit 331' electrically connected to the solar energy collector 31' through the awning frame and a coupling joint B332' connecting the speaker unit B331' to the respective supporting arm B321' in a movably suspended manner such that by selectively adjusting a position of the audio support B32' along the awning shaft, the speaker unit B331' are suspendedly self-repositioned for maximizing the coverage area within the shadowing area.

It is worth to mention that audio unit B33' could be embodied as a regular outdoor speaker mounted on the lower housing 12'. The audio system further comprises an audio input B40 operatively linked to the speaker unit B33 such that when the audio input B40 sends an audio signal to the audio units B33', the audio units B33' is adapted for producing audio effect within the shadowing area as an additional function for the outdoor umbrella.

Compared with the first preferred embodiment of the present invention, the awning frame is further extended away from the supporting shaft 21'. As a result, the user is able to adjust the outdoor umbrella according to the sun's position from the dawn to twilight.

Furthermore, the solar system 30 further comprises a chain arrangement and an attachable arrangement, respectively mounted on the body and the lower end of awning arms 13' for primarily providing audio effect to the shadowing area defined by the awning frame so as to enrich the audio effects.

It is noted that the above chain arrangement and attachable arrangement, are with identical structure and design with chain arrangement B34 and attachable arrangement B35 of the above preferred embodiment of the present invention.

A plurality of chain units B341' are mounted on the awning frame for primarily providing audio effect to the shielding zone defined by the plurality of awning arms 13'. The chain units B341' are mini speakers mounted on the plurality of awning arms 13' respectively for providing audio effect for the shielding zone.

Likewise, there is a solar energy collector 31' comprises a collector base 311', having a circular shaped, coaxially mounted on a top end portion of the awning shaft at a position above the upper housing 11' for collecting the solar energy so as to convert the solar energy into electrical energy to the speaker unit B331'.

In addition, in the preferred embodiment, there is a solar energy collecting device 40' nested on a top portion of the supporting shaft 21', wherein the solar collecting device 40' has a collecting surface 401' arranged to face upward so that it can be exposed to sunlight for extensively collecting solar energy. Moreover, the solar collecting device 40' is adapted to collect solar energy from sunlight impinged on the collecting surface 401', and converts the collected solar energy into electrical energy, wherein the solar system 30' is electrically connected with the solar collecting device 401' so that the converted electrical energy is supplied to the audio system 30'.

Conclusively, the solar collecting device 40' is mounted on top of the supporting shaft 21' while the solar energy collector 31' is mounted on the upper housing 11', so that the user of the outdoors umbrella can be able to adjust its orientation for maximizing the absorption of solar energy and enjoy the maximum solar energy.

At the meanwhile, it is worth to mention that in the preferred embodiment of the present invention, the speaker units B331' are with same structure and design as the speaker unit B331 in the above preferred embodiment.

Each of the speaker units B331' is embodied as an outdoor umbrella wherein the speaker units B331' are electrically connected to the solar energy collecting device 312' of the solar energy collector 31'.

Figure 44:
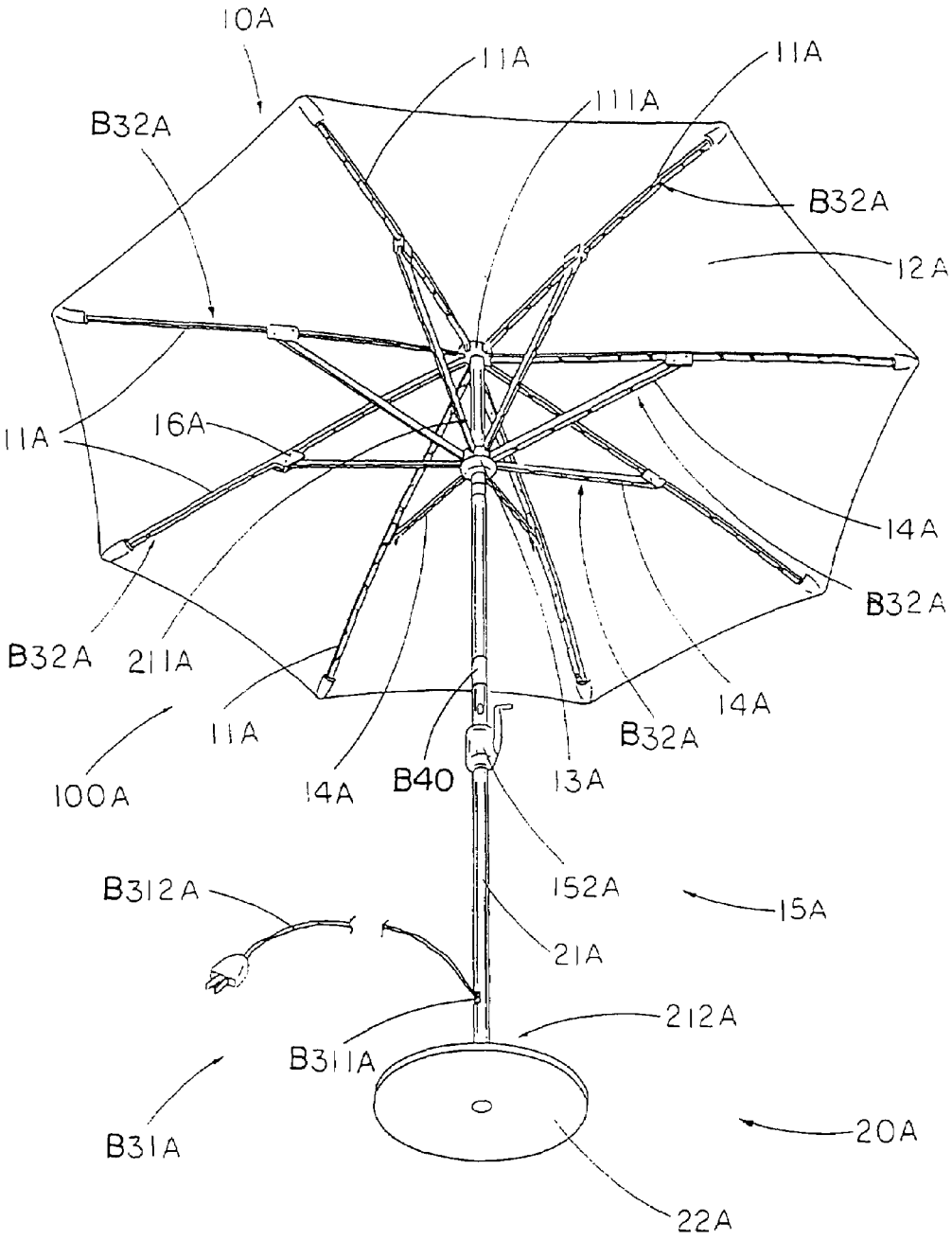
FIG. 44 is a perspective view of an outdoor umbrella according to a tenth preferred embodiment of the present invention.

As shown in FIG. 44, an outdoor umbrella of a tenth embodiment illustrates an alternative mode of the eighth embodiment of the present invention, wherein the outdoor umbrella comprises an awning frame 10A, a supporting frame 20A and an audio system B30A.

The awning frame 10A comprises a plurality of elongated awning arms 11A radially extended in a pivotally movable manner and a fabric awning 12A substantially supported by the awning arms 11A to define a shadowing area 100A thereunder.

The supporting frame 20A comprises a supporting shaft 21A having an upper portion 211A connected to the awning frame 10A.

The audio system B30A comprises a power unit B31A and a plurality of speaker units B32A mounted to the awning frame 10A and electrically connected to the power unit B31A along the awning frame 10A for providing audio effect the shadowing area 100A under the awning 12A.

Figure 45:
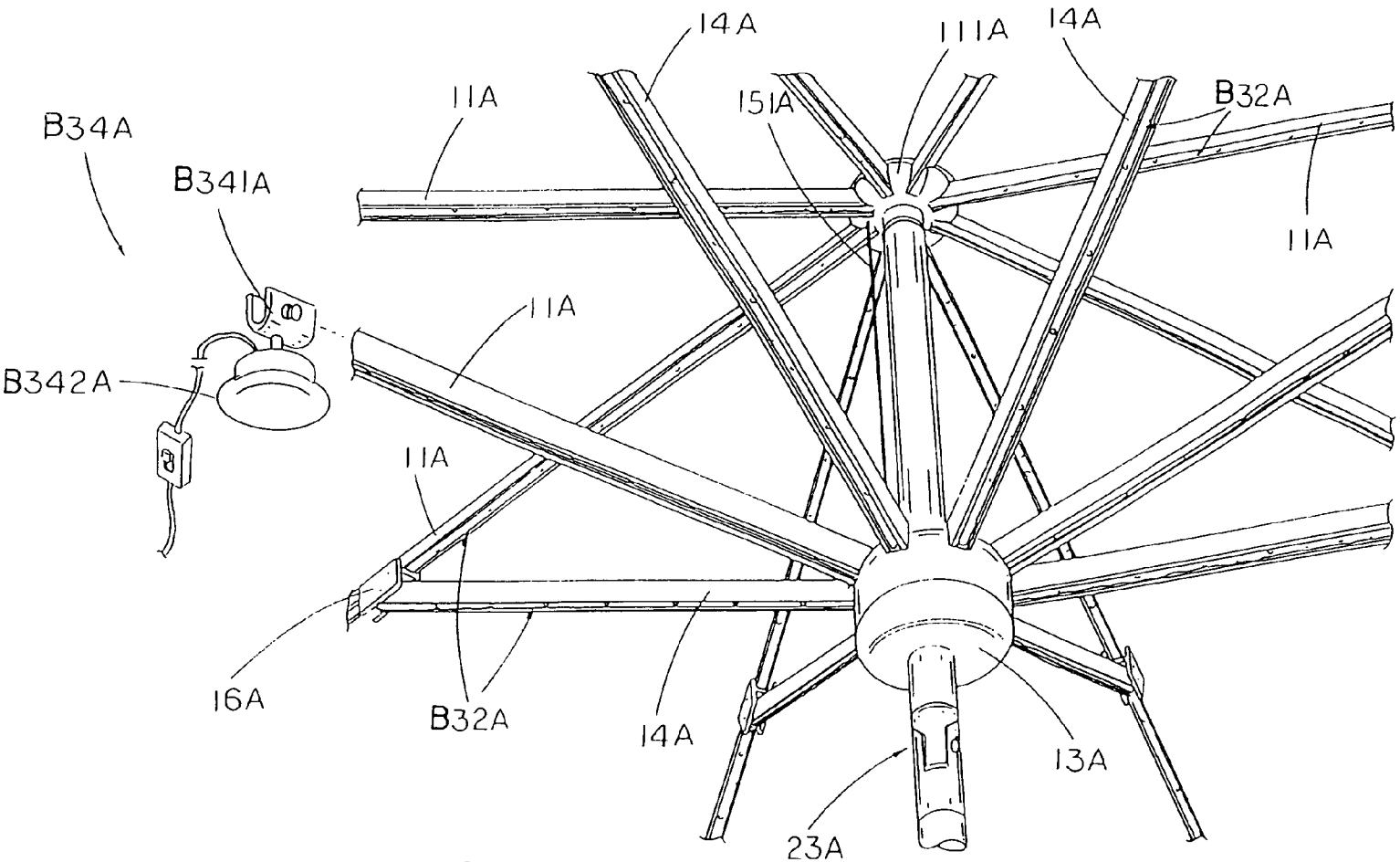
FIG. 45 is a partially perspective view of the outdoor umbrella according to the above tenth preferred embodiment of the present invention.

As shown in FIGS. 44 and 45, each of the awning arms 11A has an inner end and an outer end, wherein the inner ends of the awning arms 11A are pivotally connected with each other via an upper hub 111A such that the outer ends of the awning arms 11A are radially and outwardly extended from the upper hub 111A.

The awning frame 10A further comprises a central hub 13A and a plurality of folding ribs 14A pivotally and radially extended from the central hub 13A to pivotally connect with the awning arms 11A respectively such that when the central hub 13A is driven downwardly, the awning arms 11A are pivotally folded to fold up the awning 12A, and when the central hub 13A is driven upwardly, the awning arms 11A are pivotally folded to tensionally stretch out the awning 12A for providing the shadowing area 100A thereunder. Accordingly, the central hub 13A is coaxially positioned below the upper hub 111A such that when the central hub 13A is driven upwardly towards the upper hub 111A, the awning arms 11A are folded pivotally and outwardly to stretch the awning 12A in a tension manner. When the central hub 13A is driven downwardly away from the upper hub 11A, the awning arms 11A are folded pivotally and inwardly to fold up the awning 12A.

The supporting frame 20A further comprises a ground stand 22A to support the awning frame 10A in stable manner, wherein a lower portion 212A of the supporting shaft 21A is upwardly extended from the ground stand 22A to connect with the awning frame 10A. Accordingly, the upper portion 211A of the supporting shaft 21A is slidably penetrated through the central hub 13A to connect the upper hub 111A such that the central hub 13A is adapted to slide along the supporting shaft 21A to fold and unfold the awning 12A. Furthermore, the supporting frame 20A further comprises a pivot joint 23A pivotally connecting the upper portion 211A of the supporting shaft 21A with the lower portion 212A thereof for selectively adjusting a shadowing angle of the awning frame 10A. In other words, the upper portion 211A of the supporting shaft 21A is adapted to pivotally bend with respect to the lower portion 212A thereof via the pivot joint 23A to change the shadowing area 100A of the awning 12A.

The awning frame 10A further comprises a folding unit 15A for folding the awning 12A, wherein the folding unit 15A comprises an elongated element 151A having a control portion extended from the central hub 13A to the upper hub 111A and a hidden portion extended within an interior of the supporting shaft 21A, and a hand crank 152A mounted at the supporting shaft 21A to connect the hidden portion of the elongated element 151A and arrange to control a length of the control portion of the elongated element 151A to drive the central hub 13A sliding along the supporting shaft 21A.

As shown in FIG. 45, the elongated element 151A is a durable cable extended from the central hub 13A to the hand crank 152A through the upper hub 111A such that when the hand crank 152A rolls up the elongated element 151A to shorten the length of the control portion of the elongated element 151A, the central hub 13A is slid upwardly along the supporting shaft 21A to stretch out the awning 12A. Likewise, when the hand crank 152A is released to prolong the length of the control portion of the elongated element 151A, the central hub 13A is dropped downwardly along the supporting shaft 21A to fold up the awning 12A.

The power unit B31A according to the tenth embodiment comprises a power outlet B311A provided on the supporting shaft 21A to electrically extend from the audio units B32A, an extension cable B312A electrically extended from the power outlet 311A for electrically plugging into an external power source, and a power switch B313A provided on the supporting shaft 21A to control the audio units B32A in an on and off manner. It is worth to mention that the power unit B31A comprises a transformer to convert an AC power from the external power source into a desired DC power for the audio units B32A.

Figure 46:
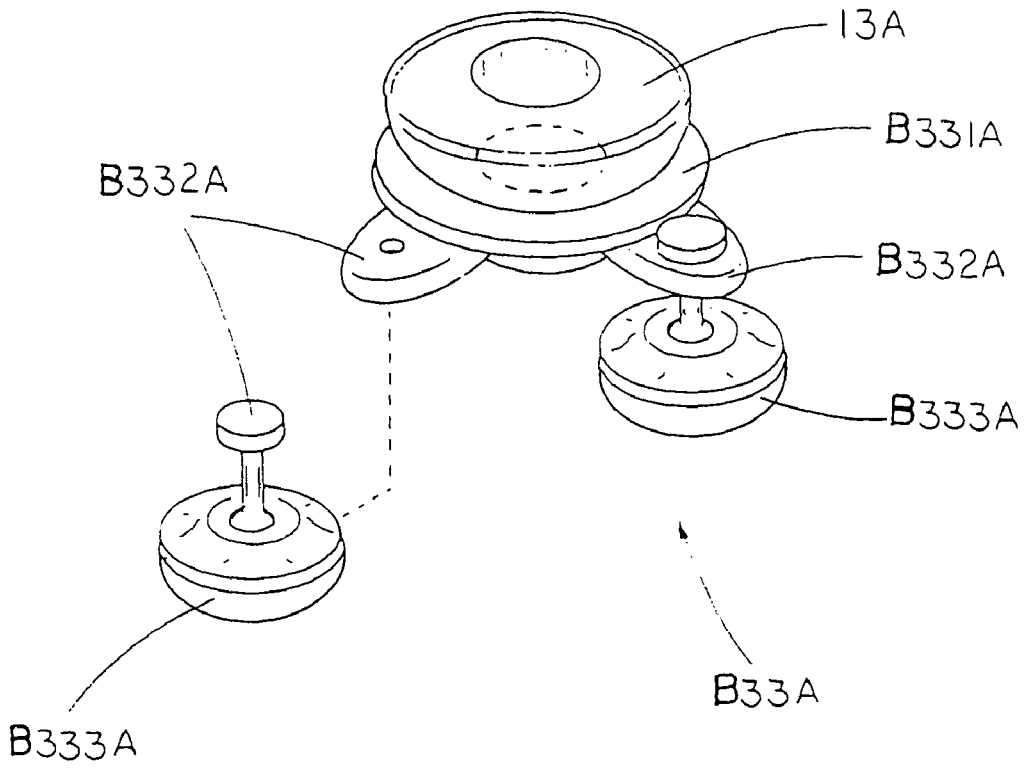
FIG. 46 is a perspective view of the central speaker unit of the outdoor umbrella according to the above tenth preferred embodiment of the present invention.

As shown in FIG. 46, the audio system B30A further comprises a central speaker unit B33A suspendedly supported by the central hub 13A to electrically connect with the power unit B31A for providing audio effect of the shadowing area 100A. Accordingly, the central speaker unit B33A comprises a mounting hub B333A, having a plurality of radial extending arms B332A, securely mounted to the central hub 13A and a plurality of speaker elements B333A pivotally mounted to the radial extending arms B332A respectively such that each of the speaker elements B333A is suspendedly support within the shadowing area 100A and is adapted to pivotally fold to selectively adjust an audio orientation for providing audio effect the shadowing area 100A.

The mounting hub B331A, having a ring shape, is coaxially attached to the central hub 13A to slide along the supporting shaft 21A corresponding to the sliding movement of the central hub 13A, wherein the radial extending arms B332A are outwardly and radially extended from the mounting hub B331A to pivotally connect the speaker elements B333A respectively.

Each of the speaker elements B333A is preferably embodied as an outdoor speaker for generating audio signal to provide audio effect of the shadowing area 100A. Accordingly, in order to enhance the adjustment of the audio orientation of each of the speaker elements B333A, each of the speaker elements B333A is connected to the respective radial extending arm B332A via a ball joint that maximize the adjustment of the audio orientation of the speaker element B333A.

As shown in FIG. 45, a detachable speaker B34A is provided for detachably mounting to the awning frame 10A, wherein the detachable speaker B34A comprises a detachable clip B341A detachably mounting to one of the awning arms 11A and the folding ribs 14A and a supplement speaker B342A (as one of the speaker units) downwardly extended from the detachable clip B341A to electrically connect to the power unit B31A such that the detachable speaker B34A is adapted to be selectively mounted to the awning frame 10A to suspendedly support within the shadowing area 100A so as to provide an audio effect for the shadowing area 100A.

The audio system further comprises an audio input B40 operatively linked to the speaker unit B33 and the central speaker unit B33A such that when the audio input B40 sends an audio signal to the audio units B32A and the central speaker unit B33A, the audio units B32A and the central speaker unit B33A are adapted for producing audio effect within the shadowing area as an additional function for the outdoor umbrella.

Figure 47:
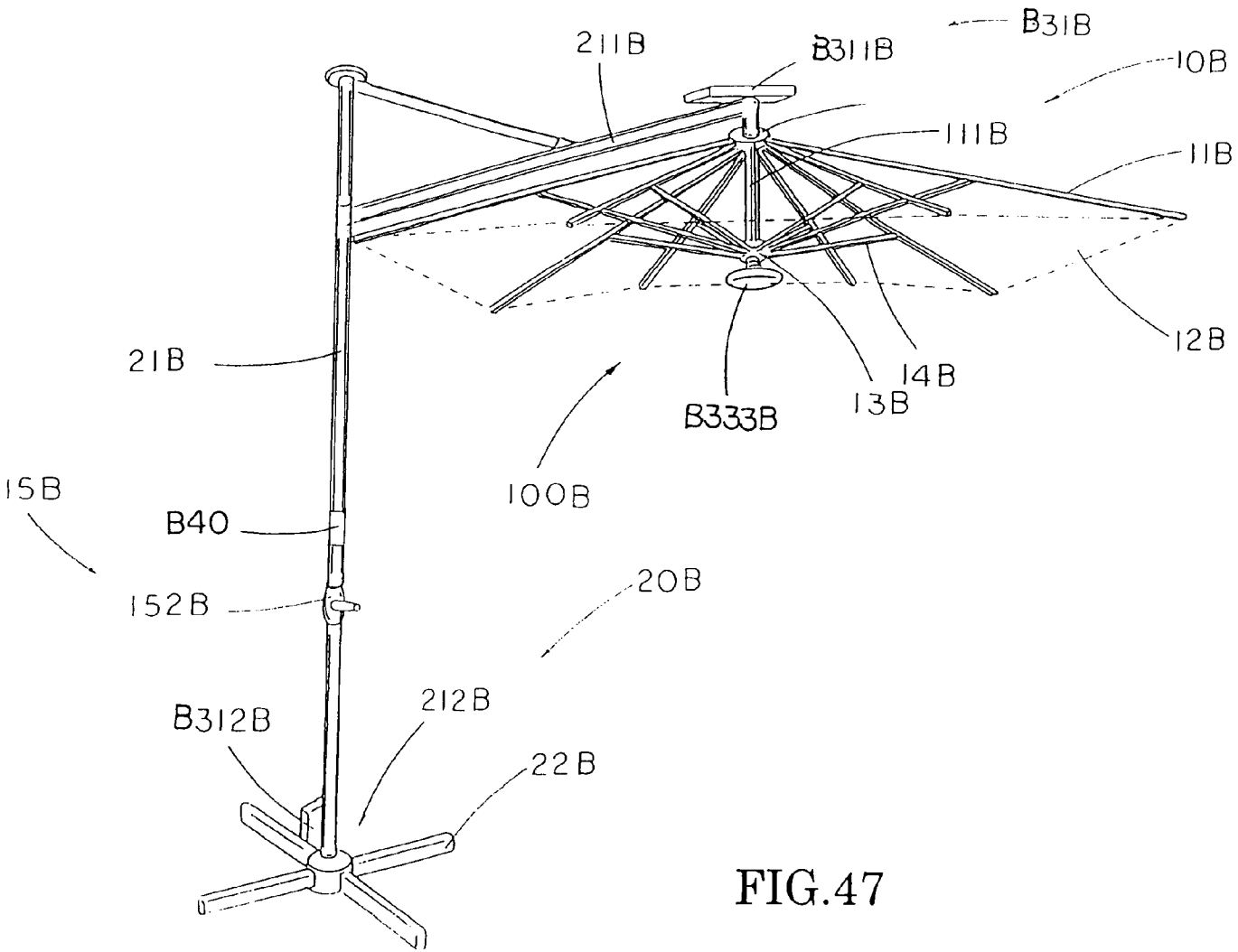
FIG. 47 is a perspective view of an outdoor umbrella according to an eleventh preferred embodiment of the present invention.

As shown in FIG. 47, an outdoor umbrella of an eleventh embodiment illustrates an alternative mode of the tenth embodiment of the present invention, wherein the outdoor umbrella comprises an awning frame 10B, a supporting frame 20B and an audio system B30B. Accordingly, the outdoor umbrella of the eleventh embodiment illustrates another type of outdoor umbrella of the tenth embodiment wherein the outdoor umbrella of the eleventh embodiment illustrates the supporting frame 20B is not positioned within the awning frame 10B.

Having the same structural design of the outdoor umbrella of the tenth embodiment, the awning frame 10B comprises a plurality of elongated awning arms 11B radially extended in a pivotally movable manner and a fabric awning 12B substantially supported by the awning arms 11B to define a shadowing area 100B thereunder. The supporting frame 20B comprises a supporting shaft 21B having an upper portion 211B connected to the awning frame 10B. The audio system B30B comprises a power unit B31B and a plurality of audio units B32B mounted to the awning frame 10B and electrically connected to the power unit B31B along the awning frame 10B for providing an audio effect within the shadowing area 100B under the awning 12B.

Figure 48:
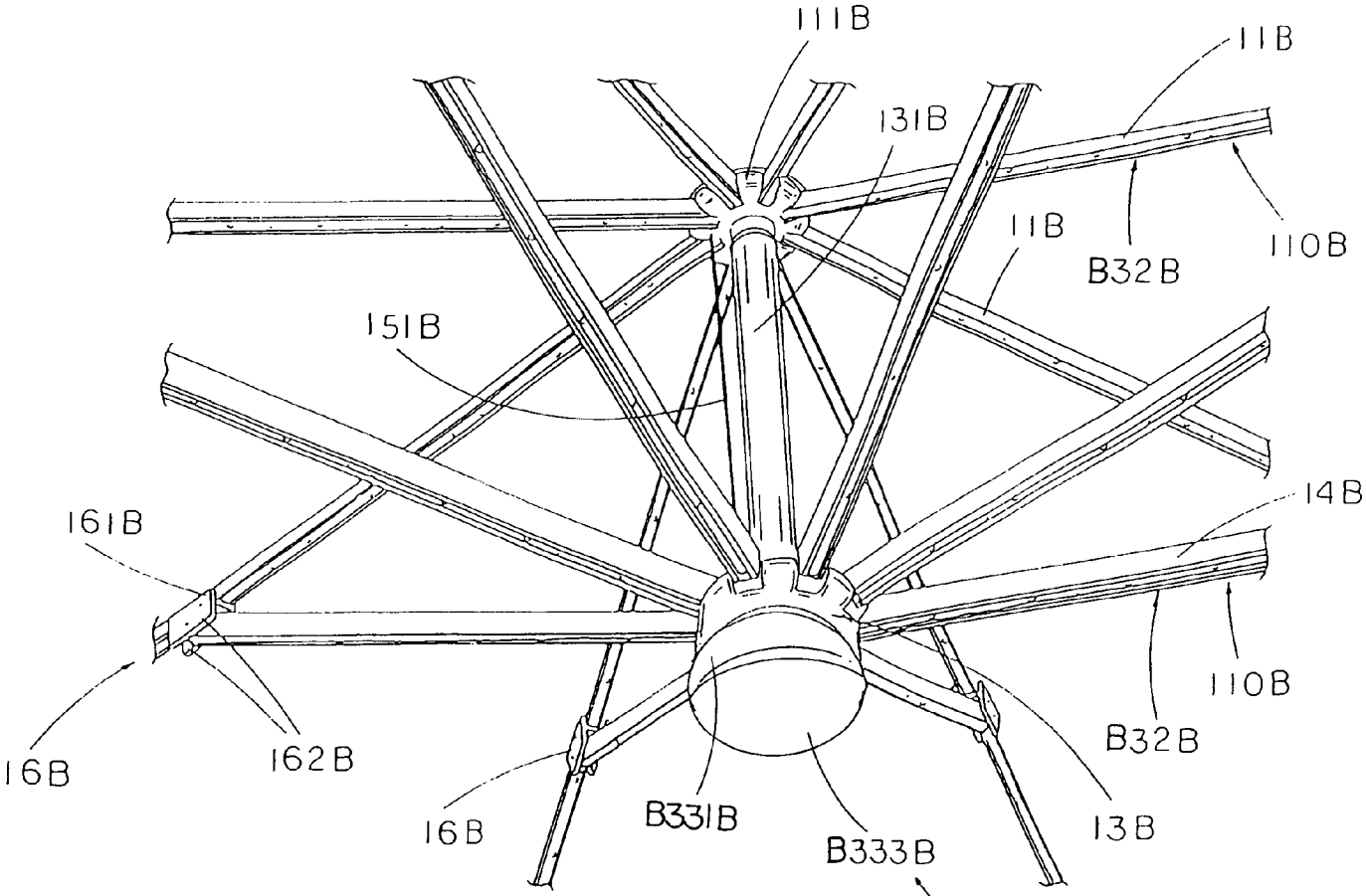
FIG. 48 is a partially perspective view of the outdoor umbrella according to the above eleventh preferred embodiment of the present invention.

As shown in FIG. 48, each of the awning arms 11B has an inner end and an outer end, wherein the inner ends of the awning arms 11B are pivotally connected with each other via an upper hub 111B such that the outer ends of the awning arms 11B are radially and outwardly extended from the upper hub 111B.

The awning frame 10B further comprises a central hub 13B and a plurality of folding ribs 14B pivotally and radially extended from the central hub 13B to pivotally connect with the awning arms 11B respectively such that when the central hub 13B is driven downwardly, the awning arms 11B are pivotally folded to fold up the awning 12B, and when the central hub 13B is driven upwardly, the awning arms 11B are pivotally folded to tensionally stretch out the awning 12B for providing the shadowing area 100B thereunder. Accordingly, the central hub 13B is coaxially positioned below the upper hub 11B such that when the central hub 13B is driven upwardly towards the upper hub 111B, the awning arms 11B are folded pivotally and outwardly to stretch the awning 12B in a tension manner. When the central hub 13B is driven downwardly away from the upper hub 111B, the awning arms 11B are folded pivotally and inwardly to fold up the awning 12B. Accordingly, a guiding shaft 131B is downwardly extended from the upper hub 111B to slidably couple with the central hub 13B such that the central hub 13B is slid along the guiding shaft 131B to fold and unfold the awning 12B.

The supporting frame 20B further comprises a ground stand 22B to support the awning frame 10B in stable manner, wherein a lower portion 212B of the supporting shaft 21B is upwardly extended from the ground stand 22B to connect with the awning frame 10B.

Accordingly, the upper portion 211B of the supporting shaft 21B is connected to the upper hub 11B at a position above the awning 12B, wherein the upper portion 211B of the supporting shaft 21B is pivotally connected to the lower portion 212B thereof for selectively adjusting a shadowing angle of the awning frame 10B. In other words, the upper portion 211B of the supporting shaft 21B is adapted to pivotally bend with respect to the lower portion 212B thereof to change the shadowing area 100B of the awning 12B.

The awning frame 10B further comprises a folding unit 15B for folding the awning 12B, wherein the folding unit 15B comprises an elongated element 151B having a control portion extended from the central hub 13B to the upper hub 111B within an interior of the guiding shaft 131B and a hidden portion extended within an interior of the supporting shaft 21B, and a hand crank 152B mounted at the supporting shaft 21B to connect the hidden portion of the elongated element 151B and arrange to control a length of the control portion of the elongated element 151B to drive the central hub 13B sliding along the guiding shaft 131B.

The power unit B31B, according to the eleventh embodiment, a solar energy collector B311B pivotally mounted on top of the awning frame 10B for collecting solar energy and transforming said solar energy into an electrical energy to the audio system B30B. Accordingly, the solar energy collector B311B is pivotally mounted on the upper portion 211B of the supporting shaft 21B at a position above the awning 12B wherein the solar energy collector B311B is adapted to be selectively adjusted its orientation for facing towards the sunlight so as to maximize the solar energy to be collected by the solar energy collector B311B. The power unit B31B further comprises a rechargeable battery B312B which is supported by the supporting frame 20B and is electrically connected to the solar energy collector B311B for storing the electrical energy as a power source for the audio system B30B. Therefore, no external power source is needed to hook up with the outdoor umbrella so as to minimize the extension cable to electrically connect to the external power source. It is worth to mention that the solar energy collector B311B can be incorporated with the outdoor umbrella of the tenth embodiment as a power source without alternating the original structure of the audio units B32A thereof.

As shown in FIG. 48, the audio units B32B are mounted to the awning arms 11B and/or the folding ribs 14B respectively, as mentioned above the tenth embodiment and as shown in FIG. 38, wherein the audio unit B32B has the same structure of the audio unit B32A of the tenth embodiment. It is worth to mention that the audio units B32B can be either mounted along the awning arms 11B or the folding ribs 14B. Alternatively, the audio units B32B can be mounted along both the awning arms 11B and the folding ribs 14B, as shown in FIGS. 47 and 48.

In addition, a pivot joint 16B has a H-shaped cross section and defines two upper wings 161B pivotally connecting to the awning arm 11B and two lower wings 162B pivotally connecting to the folding rib 14B such that the audio unit 32B is received in the bottom opening slot 110B to extend between the two upper wings 161B of the pivot joint 16B.

As shown in FIG. 48, the audio system B30B further comprises a central speaker B33B, as one of the speaker unit, suspendedly supported by the central hub 13B within the shadowing area to electrically connect with the power unit B31B for providing audio effect within the shadowing area 100B. Accordingly, the central speaker B33B comprises a mounting hub B331B securely mounted to the central hub 13B and at least a speaker element B333B mounted to the mounting hub B331B such that the speaker element B333B is adapted to pivotally fold to selectively adjust an audio orientation for providing audio effect within the shadowing area 100B. Since the supporting shaft 21B is positioned out of the awning frame 10B, the mounting hub B331B is directly attached below the central hub 13B.

The audio system further comprises an audio input B40 operatively linked to the speaker unit B33B and the central speaker unit B33B such that when the audio input B40 sends an audio signal to the audio units B32B and the central speaker B33B, the audio units B32B and the central speaker B33B are adapted for producing audio effect within the shadowing area as an additional function for the outdoor umbrella.

Figure 49:
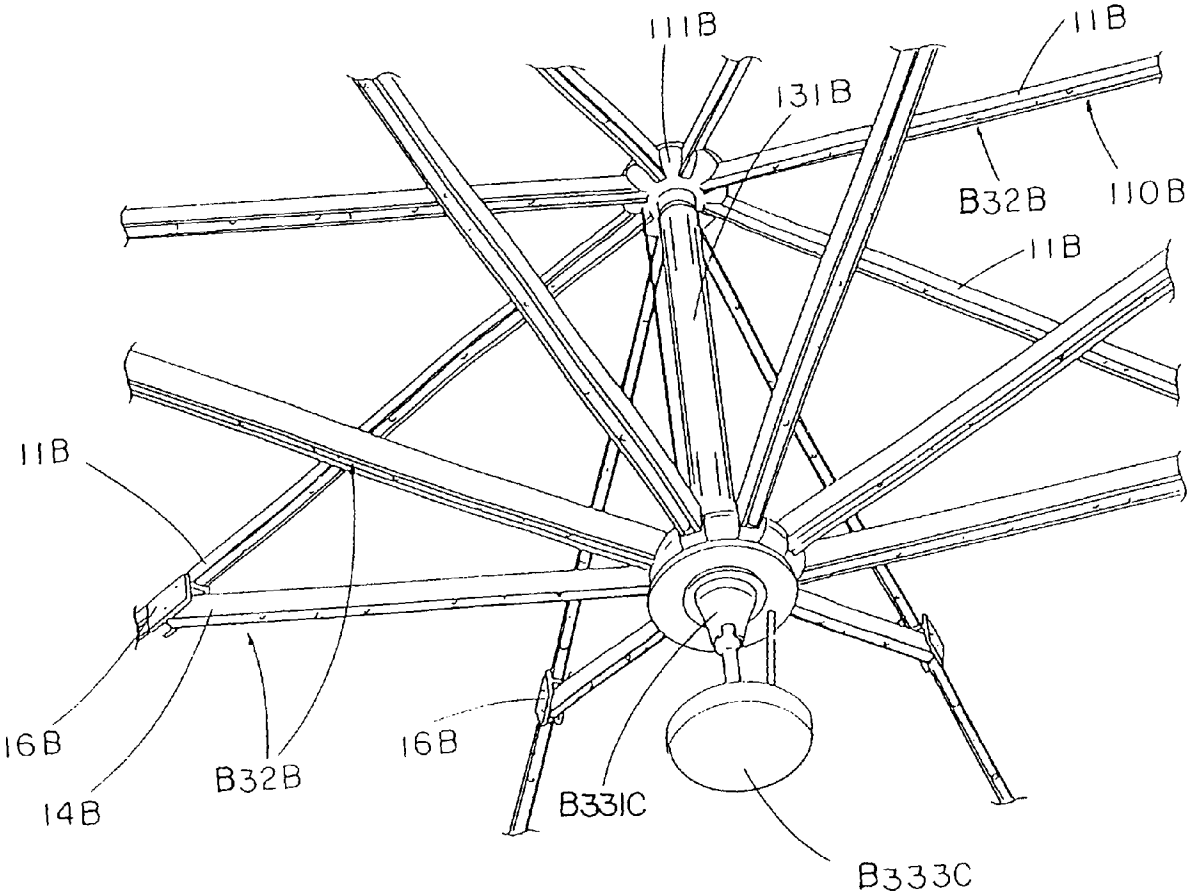
FIG. 49 illustrates an alternative mode of the speaker element of the outdoor umbrella according to the above eleventh preferred embodiment of the present invention.

FIG. 49 illustrates an alternative mode of the speaker element B333C which is embodied as an outdoor speaker powered by solar energy for generating an audio effect of the shadowing area 100B. Accordingly, in order to enhance the adjustment of the audio orientation of the speaker element B333C, the speaker element B333C is connected to the mounting hub B330C via a ball joint that maximize the adjustment of the audio orientation of the speaker element B333C.

It is worth to mention that the detachable speaker B34A of the tenth embodiment also can be detachably mounted to the awning frame 10B, such that the detachable speaker B34A is adapted to be selectively mounted to the awning frame 10B to provide audio effect for the shadowing area 100B.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor umbrella, comprising:

an umbrella frame which comprises a supporting frame and an awning frame supported by said supporting frame to define a shadowing area under said awning frame, wherein said awning frame comprises a plurality of awning arms radially extending in a pivotally movable manner and are moved between an unfolded position to define said shadowing area and a folded position; and an audio system, which comprises a plurality of speaker units supported by said umbrella frame without interfering a folding operation of said umbrella frame, and an audio input operatively linked to said speaker units such that when said audio input sends an audio signal to said speaker units, said speaker units are adapted for producing audio effect within said shadowing area as an additional function for said outdoor umbrella when said awning frame is moved at said unfolded position; and means for detachably attaching said speaker units to said umbrella frame, wherein said attaching means, which is an audio support, comprises a central hub having a central sliding through slot for a supporting shaft of said supporting frame and a plurality of supporting arms spacedly and radially extended from said central hub to support said speaker unit, wherein said central hub comprises a boundary sleeve having an arc-shape and a boundary cover interlocked with said boundary sleeve to form said central sliding through slot within inner walls of said boundary sleeve and said boundary cover, and a locking member having a locking end rotatably penetrated through said boundary cover to bias against said supporting shaft so as to lock up said central hub at said supporting shaft in position, wherein said speaker units are suspendedly supported at distal ends of said supporting arms respectively.

2. The outdoor umbrella, as recited in claim 1, wherein said attaching means further comprises a first securing member detachably attached to said inner wall of said boundary sleeve to bias against said supporting shaft and a second securing member attached to said locking end of said locking member at said inner wall of said boundary cover, wherein said second securing member is driven by said locking member to adjust a size of said central sliding through slot for fittingly biasing against said supporting shaft such that said supporting shaft is securely clamped between said first and second securing members.

3. The outdoor umbrella, as recited in claim 2, wherein said attaching means further comprises a plurality of coupling joints for coupling said speaker units with said supporting arms respectively, wherein each of said coupling joints has a ball slot formed at said distal end of said respective supporting arm and comprises a spherical head which is formed on top of said respective speaker unit and is arranged to engage with said respective ball slot in a rotatably movable manner, such that said speaker units are self-rotated while being suspendedly supported by said supporting arms.

4. The outdoor umbrella, as recited in claim 3, wherein said audio input comprises an auxiliary input provided at said umbrella frame for communicatively connecting to a portable music player to receive said audio signal therefrom, such that said audio signal is transmitted to said speaker unit for music broadcasting.

5. The outdoor umbrella, as recited in claim 2, further comprising a solar system which comprises a solar energy collector coupled to said umbrella frame at a position above said shadowing area, and a power source unit electrically connecting said solar energy collector for storing electrical power being converted from a solar energy, wherein said speaker unit is electrically powered by said power source unit.

6. The outdoor umbrella, as recited in claim 3, further comprising a solar system which comprises a solar energy collector coupled to said umbrella frame at a position above said shadowing area, and a power source unit electrically connecting said solar energy collector for storing electrical power being converted from a solar energy, wherein said speaker unit is electrically powered by said power source unit.

7. The outdoor umbrella, as recited in claim 4, further comprising a solar system which comprises a solar energy collector coupled to said umbrella frame at a position above said shadowing area, and a power source unit electrically connecting said solar energy collector for storing electrical power being converted from a solar energy, wherein said speaker unit is electrically powered by said power source unit.

* * * * *